US010533780B2

(12) United States Patent
Yi et al.

(10) Patent No.: US 10,533,780 B2
(45) Date of Patent: Jan. 14, 2020

(54) FEEDBACK DEVICE AND METHOD OF PROVIDING THERMAL FEEDBACK USING THE SAME

(71) Applicant: TEGway Co., Ltd., Daejeon (KR)

(72) Inventors: Kyoung Soo Yi, Daejeon (KR); Ock Kyun Oh, Daejeon (KR); Se Hwan Lim, Daejeon (KR)

(73) Assignee: TEGWAY CO., LTD., Daejeon (KR)

( * ) Notice: Subject to any disclaimer, the term of this patent is extended or adjusted under 35 U.S.C. 154(b) by 26 days.

(21) Appl. No.: 15/858,351

(22) Filed: Dec. 29, 2017

(65) Prior Publication Data

US 2019/0063797 A1 Feb. 28, 2019

(30) Foreign Application Priority Data

Aug. 31, 2017 (KR) ..... 10-2017-0111462
Aug. 31, 2017 (KR) ..... 10-2017-0111463
(Continued)

(51) Int. Cl.
*F25B 21/04* (2006.01)
*A41D 1/00* (2018.01)

(52) U.S. Cl.
CPC ..... *F25B 21/04* (2013.01); *A41D 1/002* (2013.01); *F25B 2321/0212* (2013.01); *F25B 2321/0252* (2013.01)

(58) Field of Classification Search
CPC ..... F25B 21/04; F25B 2321/0212; F25B 2321/0252; A41D 1/002; A41D 13/005;
(Continued)

(56) References Cited

U.S. PATENT DOCUMENTS 5,709,219 A 1/1998 Chen et al.
6,362,740 B1 * 3/2002 Jung ..... G08B 3/1041 340/573.1
(Continued)

FOREIGN PATENT DOCUMENTS

JP 2008-227178 A1 9/2008
JP 2012-217861 A 11/2012
(Continued)

*Primary Examiner* — Ryan W Sherwin
(74) *Attorney, Agent, or Firm* — Maschoff Brennan

(57) ABSTRACT

Disclosed herein are a feedback device and a method of providing thermal feedback using the same. The feedback device according to an embodiment of the present disclosure includes a thermoelectric module including a substrate having flexibility, a thermoelement disposed on the substrate and configured to perform a thermoelectric operation for thermal feedback, and a contact surface disposed on the substrate, and configured to transfer heat generated through the thermoelectric operation to a user through the substrate and the contact surface to output the thermal feedback; and a feedback controller configured to control the thermoelectric module, and wherein the feedback controller controls the thermoelectric module so that, after a temperature of the contact surface reaches a maximum temperature, the temperature of the contact surface is maintained within a predetermined temperature range during an entire thermoelectric operation time interval.

19 Claims, 65 Drawing Sheets

(30) Foreign Application Priority Data

Aug. 31, 2017 (KR) ..... 10-2017-0111464
Aug. 31, 2017 (KR) ..... 10-2017-0111465
Aug. 31, 2017 (KR) ..... 10-2017-0111466
Aug. 31, 2017 (KR) ..... 10-2017-0111467

(58) Field of Classification Search
CPC ..... A41D 13/0051; A41D 13/0053; G06F 3/016; G08B 6/00; A47C 7/74; A47C 7/742; A47C 7/748; A47C 7/72; A61F 7/00; B60N 2/56; B60N 2/5678
See application file for complete search history.

(56) References Cited

U.S. PATENT DOCUMENTS 8,016,673 B2 9/2011 Takatsuka
8,550,905 B2 * 10/2013 Mikhailov ..... G06F 3/016 463/30
9,672,702 B2 * 6/2017 Coish ..... H04M 19/04
10,101,810 B2 * 10/2018 Li ..... G06F 3/016
2003/0002899 A1 * 1/2003 Furukawa ..... B41J 2/04541 400/120.01
2005/0091989 A1 5/2005 Leija et al.
2009/0149928 A1 * 6/2009 Relin ..... A61F 7/02 607/96
2012/0198616 A1 * 8/2012 Makansi ..... H01C 1/16 5/423
2012/0258800 A1 10/2012 Mikhailov
2013/0021234 A1 1/2013 Umminger et al.
2014/0165607 A1 * 6/2014 Alexander ..... A47G 19/2288 62/3.3
2014/0338713 A1 * 11/2014 Nakanuma ..... H01L 35/30 136/204
2016/0098095 A1 4/2016 Gonzalez-Banos et al.
2016/0153508 A1 6/2016 Battlogg
2016/0246370 A1 8/2016 Osman
2017/0354190 A1 * 12/2017 Cauchy ..... A47C 7/744
2018/0095534 A1 4/2018 Omote

FOREIGN PATENT DOCUMENTS

JP 2013-175627 A 9/2013
KR 10-2007-0066931 A 6/2007
KR 10-2010-0051386 A 5/2010
KR 10-1056950 B1 8/2011
KR 10-2013-0137417 A 12/2013
KR 10-1493792 B1 2/2015
KR 10-1493797 B1 2/2015
KR 10-2016-0033585 A 3/2016
KR 10-2016-0036383 A 4/2016
KR 10-2016-0117944 A 10/2016
KR 20170089441 A 8/2017

* cited by examiner $V1+/V1-=V2+/V2-=V3+/V3-=V4+/V4-=V5+/V5-=-1$ $|\Delta T1+|>|\Delta T1-|$, $|\Delta T2+|>|\Delta T2-|$, $|\Delta T3+|>|\Delta T3-|$, $|\Delta T4+|>|\Delta T4-|$, $|\Delta T5+|>|\Delta T5-|$ $\Delta T1+/\Delta T1-=\Delta T2+/\Delta T2-=\Delta T3+/\Delta T3-=\Delta T4+/\Delta T4-=\Delta T5+/\Delta T5-=-1$ $|V1+|<|V1-|$, $|V2+|<|V2-|$, $|V3+|<|\Delta T3-|$, $|V4+|<|V4-|$, $|V5+|<|V5-|$

FIG. 26

| GRADE | FORWARD VOLTAGE | HOT FEEDBACK SATURATION TEMPERATURE | FORWARD VOLTAGE | HOT FEEDBACK SATURATION TEMPERATURE |
|---|---|---|---|---|
| 1 | V1+ | ΔT1+ | V1+ | ΔT1−=−ΔT1+ |
| 2 | V2+ | ΔT2+=2ΔT1+ | V2+ | ΔT2−=−2ΔT1+ |
| 3 | V3+ | ΔT3+=3ΔT1+ | V3+ | ΔT3−=−3ΔT1+ |
| 4 | V4+ | ΔT4+=4ΔT1+ | V4+ | ΔT4−=−4ΔT1+ |
| 5 | V5+ | ΔT5+=5ΔT1+ | V5+ | ΔT5−=−5ΔT1+ |

| NEUTRAL PROPORTION | VOLTAGE APPLIED TO FIRST THERMOELEMENT | VOLTAGE APPLIED TO SECOND THERMOELEMENT |
|---|---|---|
| 2 | V1+, V2+ | V2−, V4− |
| 2.5 | V2+ | V5− |
| 3 | V1+ | V3− |
| 4 | V1+ | V4− |
| 5 | V1+ | V5− |

(a)

| | High density | | | Low density | | |
|---|---|---|---|---|---|---|
| TIME(MINUTES) | 10 | 30 | 60 | 10 | 30 | 60 |
| POWER DENSITY(μw/cm²) | 90.7 | 37.7 | 25.9 | 90.7 | 54.1 | 28.8 |

(b)

(a)

(b)

FEEDBACK DEVICE AND METHOD OF PROVIDING THERMAL FEEDBACK USING THE SAME

CROSS-REFERENCE TO RELATED APPLICATION

This application claims priority to and the benefit of Korean Patent Application Nos. 10-2017-0111462, 10-2017-0111463, 10-2017-0111464, 10-2017-0111465, 10-2017-0111466 and 10-2017-0111467, filed on Aug. 31, 2017, the disclosure of which is incorporated herein by reference in its entirety.

TECHNICAL FIELD

The present disclosure relates to a feedback device for outputting thermal feedback and a method of providing thermal feedback using the same.

BACKGROUND

Recently, due to development of technologies related to virtual reality (VR) or augmented reality (AR), there has been an increase in demand for providing feedback through various sensations to increase user engagement with content. VR technology in particular was mentioned as one of the most promising future technologies at the 2016 Consumer Electronics Show (CES). Following such a trend, research for providing, beyond current user experience mostly limited to the visual and auditory senses, user experience through all senses of the human body including the olfactory and tactile senses has been actively conducted.

A thermoelement (TE), which is an element that receives electrical energy and causes an exothermic reaction or an endothermic reaction due to the Peltier effect, has been expected to be used in providing thermal feedback to a user. However, a conventional TE, which mainly uses a planar substrate, is difficult to attach to a body part of a user, and thus applications of the conventional TE have been limited.

However, as development of a flexible TE (FTE) is close to success, it is expected that the problems of the conventional TE will be overcome and thermal feedback will be effectively provided to a user.

SUMMARY

It is an aspect of the present disclosure to provide a feedback device for providing thermal feedback to a user and a method of providing thermal feedback using the same.

It is another aspect of the present disclosure to provide a feedback device for effectively dissipating waste heat generated in the feedback device.

It is still another aspect of the present disclosure to provide a feedback device with improved cold sensation providing performance.

It is yet another aspect of the present disclosure to provide a method of providing thermal feedback for improving a user's degree of thermal feedback perception.

Aspects of the present disclosure are not limited to the above-mentioned aspects, and other unmentioned aspects should be clearly understood by one of ordinary skill in the art to which the present disclosure pertains from the present specification and the accompanying drawings.

In accordance with one aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, and a feedback controller configured to control the thermoelectric module, wherein the feedback controller controls the thermoelectric module so that, after a temperature of the contact surface reaches a maximum temperature, the temperature of the contact surface is maintained within a predetermined temperature range during an entire thermoelectric operation time interval and controls the thermoelectric module so that, after the temperature of the contact surface reaches the predetermined temperature range a temperature rise or a temperature drop of exceeding a predetermined threshold value periodically occurs in the contact surface. The technical solutions of the present disclosure are not limited to the above-described methods, and other unmentioned methods should be clearly understood by one of ordinary skill in the art to which the present disclosure pertains from the present specification and the accompanying drawings.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 26 is a table related to voltages for providing neutral thermal grill feedback in the voltage adjustment method according to an embodiment of the present disclosure;

DETAILED DESCRIPTION

Figure 1:
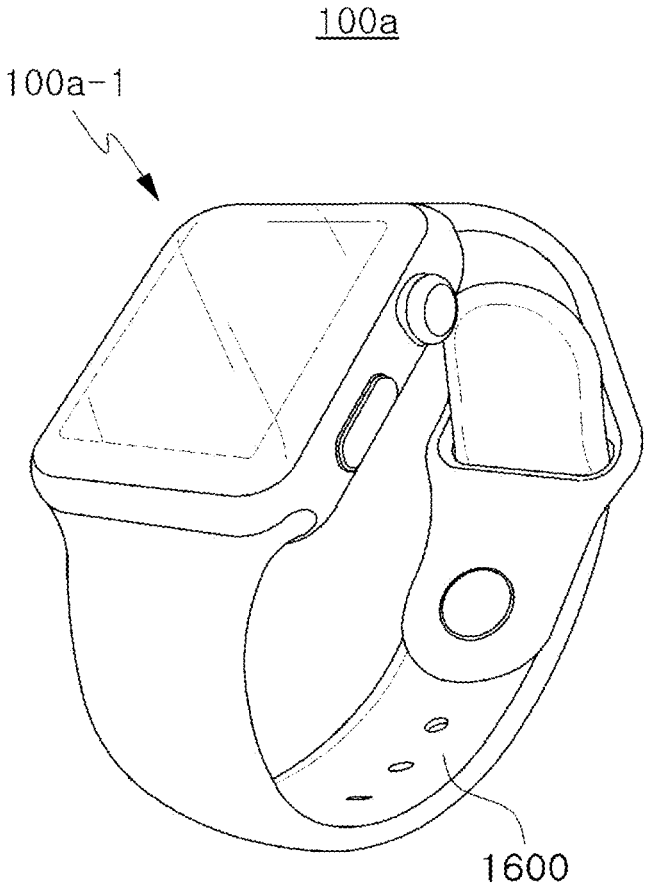
FIG. 1 is a schematic of a first embodiment of a feedback device according to an embodiment of the present disclosure.

To achieve the above-described objectives, in accordance with one aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, and a feedback controller configured to control the thermoelectric module, wherein the feedback controller controls the thermoelectric module so that, after a temperature of the contact surface reaches a maximum temperature, the temperature of the contact surface is maintained within a predetermined temperature range during an entire thermoelectric operation time interval and controls the thermoelectric module so that, after the temperature of the contact surface reaches the predetermined temperature range, a temperature rise or a temperature drop of exceeding a predetermined threshold value periodically occurs in the contact surface.

Because embodiments described herein are for clearly describing the spirit of the present disclosure to one of ordinary skill in the art to which the present disclosure pertains, the present disclosure is not limited by the embodiments described herein, and the scope of the present disclosure should be construed as including modifications that do not depart from the spirit of the present disclosure.

Terms used herein are currently widely used general terms that are selected in consideration of functions in the present disclosure, but the terms may vary depending on an intention, practice of one of ordinary skill in the art to which the present disclosure pertains or the advent of new technology. However, unlike this, when a specific term is arbitrarily defined and used, a definition of the term will be separately given. Consequently, the terms used herein should be interpreted on the basis of substantial meanings thereof and entire content herein instead of being interpreted simply on the basis of the names of the terms.

The accompanying drawings are for facilitating description of the present disclosure. Because shapes illustrated in the drawings may be exaggerated as necessary to assist in understanding the present disclosure, the present disclosure is not limited by the drawings.

When detailed descriptions of known configurations or functions related to the present disclosure are deemed as having the possibility of blurring the gist of the present disclosure, the detailed descriptions thereof will be omitted as necessary.

In accordance with one aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, and a feedback controller configured to control the thermoelectric module, wherein the feedback controller controls the thermoelectric module so that, after a temperature of the contact surface reaches a maximum temperature, the temperature of the contact surface is maintained within a predetermined temperature range during an entire thermoelectric operation time interval and controls the thermoelectric module so that, after the temperature of the contact surface reaches the predetermined temperature range, a temperature rise or a temperature drop of exceeding a predetermined threshold value periodically occurs in the contact surface.

Here, the feedback controller may apply a first voltage, which causes the thermoelectric module to perform the endothermic operation, to the thermoelectric module so that the feedback device provides cold sensation to the user.

Here, the feedback device may apply the first voltage, which is in the form of a duty signal.

Here, the feedback controller may control the thermoelectric module so that, after the temperature of the contact surface reaches a minimum temperature from an initial temperature, the temperature of the contact surface is maintained within a predetermined saturation temperature range during an entire thermoelectric operation time interval.

Here, the predetermined saturation temperature range may be from a temperature higher than the minimum temperature to a temperature lower than the initial temperature.

Here, waste heat may be accumulated inside the feedback device as the thermoelectric module performs the endothermic operation, and the temperature of the contact surface may rise from the minimum temperature to a temperature within the predetermined saturation temperature range due to the waste heat.

Here, the feedback device may further include a heat radiator configured to dissipate at least a portion of the waste heat to the outside of the feedback device, and as at least a portion of the waste heat is dissipated to the outside of the feedback device by the heat radiator, the temperature of the contact surface may be maintained within the saturation temperature range.

Here, the feedback controller may control the thermoelectric module for a first time during which the endothermic operation is performed and a second time during which the endothermic operation is not performed to be periodically repeated so that, after the temperature of the contact surface reaches the saturation temperature range, a temperature rise or a temperature drop of exceeding a predetermined threshold value periodically occurs in the contact surface.

Here, the feedback controller may apply the first voltage to the thermoelectric module during the first time and not apply the first voltage to the thermoelectric module during the second time so that the first time and the second time are periodically repeated.

Here, the feedback controller may control the thermoelectric module so that a temperature variation of the contact surface during the first time and the second time is larger than or equal to a threshold temperature difference indicating a temperature difference that allows the user to perceive a temperature change.

Here, the threshold temperature difference may be changed according to the saturation temperature range.

Here, the temperature variation of the contact surface may be adjusted according to a proportion between the first time and the second time.

Here, the feedback controller may check the saturation temperature range, set the threshold temperature difference on the basis of the saturation temperature range, and set the proportion between the first time and the second time so that the temperature variation of the contact surface becomes larger than or equal to the threshold temperature difference.

Here, a temperature variation of the contact surface when the proportion between the first time and the second time is a first proportion may be a first temperature variation, a temperature variation of the contact surface when the proportion between the first time and the second time is a second proportion may be a second temperature variation, the first temperature variation and the second temperature variation may be larger than or equal to the threshold temperature difference, and when the first temperature variation is higher than the second temperature variation, the feedback controller may control the thermoelectric module so that the temperature variation of the contact surface becomes the first temperature variation.

Here, the feedback controller may set a sum of the first time and the second time to be less than 60 seconds.

Here, the feedback controller may control the thermoelectric module so that a proportion of the second time to the first time is higher than or equal to 0.9.

In accordance with another aspect of the present disclosure, a method of improving cold feeling of a user being performed by a feedback device, which includes a thermoelectric module including a substrate having flexibility, a thermoelement disposed on the substrate and configured to perform an endothermic operation for cold feedback, and a contact surface disposed on the substrate, and configured to transfer cold heat generated through the thermoelectric operation to a user through the substrate and the contact surface to output the cold feedback, and a feedback controller configured to control the thermoelectric module, includes controlling the thermoelectric module so that, after a temperature of the contact surface reaches a maximum temperature, the temperature of the contact surface is maintained within a predetermined temperature range during an entire thermoelectric operation time interval, and controlling the thermoelectric module so that, after the temperature of the contact surface reaches the predetermined temperature range a temperature rise or a temperature drop of exceeding a predetermined threshold value periodically occurs in the contact surface.

In accordance with still another aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, and a feedback controller configured to control the thermoelectric module, wherein the feedback controller applies a first voltage, which causes the thermoelectric module to perform the thermoelectric operation, to the thermoelectric module during a first voltage application time and applies a second voltage, which causes the thermoelectric module to perform the thermoelectric operation, to the thermoelectric module during a second voltage application time so that the user's degree of perception on warmth provided to the user by the thermoelectric operation is improved.

Here, the feedback controller applies the first voltage and the second voltage, which cause the thermoelectric module to perform the endothermic operation, to the thermoelectric module so that the feedback device provides cold sensation to the user.

Here, the feedback device may apply the first voltage and the second voltage, which are in the form of a duty signal.

Here, waste heat may be generated inside the feedback device as the thermoelectric module performs the endothermic operation, and the temperature of the contact surface may rise due to the waste heat.

Here, the feedback controller may set a level of the first voltage to be higher than that of a reference voltage so that the temperature of the contact surface during the first voltage application time becomes lower in comparison to a case in which the reference voltage is applied during the first voltage application time and the second voltage application time (when the reference voltage is applied to the thermoelectric module, thermal feedback of a reference intensity is output from the feedback device).

Here, the feedback controller may set the level of the first voltage to be lower than that of the reference voltage so that the amount of waste heat generated during the first voltage application time is reduced in comparison to when the reference voltage is applied during the first voltage application time and the second voltage application time (when the reference voltage is applied to the thermoelectric module, the thermal feedback of the reference intensity is output from the feedback device).

Here, the feedback controller may set a level of the second voltage to be higher than that of the reference voltage so that the temperature of the contact surface during the second voltage application time becomes lower in comparison to when the reference voltage is applied during the first voltage application time and the second voltage application time (when the reference voltage is applied to the thermoelectric module, the thermal feedback of the reference intensity is output from the feedback device).

Here, the feedback controller may set the level of the second voltage to be lower than that of the reference voltage so that the amount of waste heat generated during the second voltage application time is reduced in comparison to when the reference voltage is applied during the first voltage application time and the second voltage application time (when the reference voltage is applied to the thermoelectric module, the thermal feedback of the reference intensity is output from the feedback device).

Here, the feedback controller may control the thermoelectric module so that, after the temperature of the contact surface reaches a minimum temperature from an initial temperature during the first voltage application time, the temperature of the contact surface is maintained within a predetermined temperature range during the second voltage application time.

Here, the feedback controller may set the level of the first voltage to be larger than that of the second voltage.

Here, the feedback controller may apply the first voltage to the thermoelectric module during the first voltage application time so that the amount of time taken for the temperature of the contact surface to reach the minimum temperature is shortened.

Here, the feedback controller may apply the second voltage to the thermoelectric module during the second voltage application time so that the amount of time during which the temperature of the contact surface is maintained within the predetermined temperature range becomes longer.

Here, the feedback controller may apply the first voltage to the thermoelectric module during the first voltage application time so that a temperature within the predetermined temperature range becomes lower and may apply the second voltage or a third voltage (the third voltage has a level higher than that of the second voltage and lower than that of the first voltage) to the thermoelectric module during the second voltage application time.

In accordance with yet another aspect of the present disclosure, a method of improving cold feeling of a user being performed by a feedback device, which includes a thermoelectric module including a substrate having flexibility, a thermoelement disposed on the substrate and configured to perform an endothermic operation for cold feedback, and a contact surface disposed on the substrate, and configured to transfer cold heat generated through the thermoelectric operation to a user through the substrate and the contact surface to output the cold feedback, and a feedback controller configured to control the thermoelectric module, includes applying a first voltage, which causes the thermoelectric module to perform the endothermic operation, to the thermoelectric module during a first voltage application time, and applying a second voltage, which causes the thermoelectric module to perform the endothermic operation, to the thermoelectric module during a second voltage application time so that the user's degree of perception on the cold sensation provided to the user by the endothermic operation is improved.

In accordance with yet another aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, a heat radiator configured to dissipate waste heat to the outside when the waste heat is generated as the thermoelement performs the thermoelectric operation, and a liquid provider configured to supply a liquid to the heat radiator so that the waste heat is dissipated in the form of latent heat.

Here, the feedback device may apply a first voltage, which causes the thermoelectric module to perform the endothermic operation, to the thermoelectric module so that the feedback device provides cold sensation to the user.

Here, the feedback device may apply the first voltage, which is in the form of a duty signal.

Here, the heat radiator may include a heat transferer configured to transfer the waste heat and a heat dissipator configured to dissipate the waste heat to the outside in the form of latent heat.

Here, the heat radiator may be disposed on the thermoelectric module, and the liquid provider may be disposed inside the heat radiator so that a dissipation path of the waste heat consists of the thermoelectric module, the heat transferer, the liquid provider, and the heat dissipator.

Here, a thickness of the liquid provider may be adjusted so that the dissipation path of the waste heat is shortened.

Here, the heat radiator may be disposed on the thermoelectric module, and the liquid provider may be disposed at a side surface of the heat radiator and not come into contact with the thermoelectric module so that the dissipation path of the waste heat consists of the thermoelectric module and the heat radiator.

Here, the liquid provider may include a first liquid provider and a second liquid provider, the first liquid provider may be disposed at one side surface of the heat radiator, and the second liquid provider may be disposed at another side surface of the heat radiator.

Here, the feedback device may further include a protector configured to protect the feedback device from the outside, and when the dissipation path of the waste heat includes the thermoelectric module and the heat radiator, the protector may be disposed on the heat radiator to make contact between the heat radiator and the user difficult.

Here, the liquid provider may include a super absorbent polymer (SAP).

Here, when the heat transferer is formed of a first material, and the heat dissipator is formed of a second material, heat transfer performance and air permeability may differ between the first material and the second material.

Here, materials of the heat transferer and the heat dissipator may be the same.

Here, at least one of the liquid provider and the heat radiator may be configured to be separated from the feedback device.

In accordance with yet another aspect of the present disclosure, a cooling device includes a thermoelectric module including a substrate having flexibility, a thermoelement disposed on the substrate and configured to perform an endothermic operation for cold feedback, and a contact surface disposed on the substrate, and configured to transfer cold heat generated through the endothermic operation to a user through the substrate and the contact surface to output the cold feedback, a heat radiator configured to dissipate waste heat to the outside when the waste heat is generated as the thermoelement performs the endothermic operation, a liquid provider configured to supply a liquid to the heat radiator so that the waste heat is dissipated in the form of latent heat, and a supporter disposed to come into contact with the user and configured to support the thermoelectric module, the heat radiator, and the liquid provider.

In accordance with yet another aspect of the present disclosure, a feedback device includes a thermoelectric module including a thermoelement configured to perform a thermoelectric operation for thermal feedback (the thermoelectric operation including an exothermic operation and an endothermic operation), and a contact surface thermally connected to the TE, and configured to transfer heat generated through the thermoelectric operation to a user through the contact surface to output the thermal feedback, a heat radiator configured to dissipate waste heat to the outside when the waste heat is generated as the thermoelement performs the thermoelectric operation, and a liquid provider configured to supply a liquid to the heat radiator so that the waste heat is dissipated in the form of latent heat.

In accordance with yet another aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, a heat radiator configured to dissipate waste heat to the outside when the waste heat is generated as the thermoelement performs the thermoelectric operation, and a first liquid provider connected to one region of the heat radiator and configured to supply a liquid to the heat radiator so that the waste heat is dissipated in the form of latent heat, wherein the amount of the liquid supplied to the heat radiator is adjusted according to performance of the first liquid provider.

Here, the performance of the first liquid provider may include liquid absorption performance indicating an extent to which a liquid is absorbed from the outside and liquid holding performance indicating an extent to which a liquid is held instead of being dissipated to the outside when a predetermined pressure is applied from the outside.

Here, the first liquid provider may include an SAP.

Here, the liquid absorption performance and the liquid holding performance of the first liquid provider may be adjusted by a crosslink density of the SAP.

Here, when the first liquid provider is formed of a first SAP having a crosslink of a first density, a larger amount of liquid may be provided to the heat radiator in comparison to a case in which the first liquid provider is formed of a second SAP having a crosslink of a second density (the second density is higher than the first density).

Here, the first liquid provider may include a first region at a lower portion and a second region at an upper portion, the first region may include the first SAP, the second region may include the second SAP, and crosslink densities of the first SAP and the second SAP may be different from each other.

Here, the first liquid provider may include a first region and a second region configured to cover the first region, the first region may include the first SAP, the second region may include the second SAP, and crosslink densities of the first SAP and the second SAP may be different from each other.

Here, the feedback device may further include a second liquid provider having higher liquid absorption performance than that of the first liquid provider, and the second liquid provider may provide a liquid to the first liquid provider so that the first liquid provider is supplemented with the liquid.

Here, at least one of the first liquid provider, the second liquid provider, and the heat radiator may be configured to be separated from the feedback device.

Here, the feedback device may apply a first voltage, which causes the thermoelectric module to perform the endothermic operation, to the thermoelectric module so that the feedback device provides cold sensation to the user.

Here, the feedback device may apply the first voltage, which is in the form of a duty signal.

In accordance with yet another aspect of the present disclosure, a cooling device includes a thermoelectric module including a substrate having flexibility, a thermoelement disposed on the substrate and configured to perform an endothermic operation for cold feedback, and a contact surface disposed on the substrate, and configured to transfer cold heat generated through the thermoelectric operation to a user through the substrate and the contact surface to output the cold feedback, a heat radiator configured to dissipate waste heat to the outside when the waste heat is generated as the thermoelement performs the endothermic operation, and a first liquid provider connected to one region of the heat radiator and configured to supply a liquid to the heat radiator so that the waste heat is dissipated in the form of latent heat, wherein the amount of the liquid supplied to the heat radiator is adjusted according to performance of the first liquid provider.

In accordance with yet another aspect of the present disclosure, a feedback device includes a thermoelectric module including a substrate having flexibility, a thermoelement disposed on the substrate and configured to perform a thermoelectric operation for thermal feedback (the thermoelectric operation including an exothermic operation and an endothermic operation), and a contact surface disposed on the substrate, and configured to transfer heat generated through the thermoelectric operation to a user through the substrate and the contact surface to output the thermal feedback, a heat radiator configured to dissipate waste heat to the outside when the waste heat is generated as the thermoelement performs the thermoelectric operation, a liquid provider configured to provide moisture to the heat radiator so that the waste heat is dissipated in the form of latent heat, and a thermal buffer material formed of a material that absorbs a predetermined amount of heat from the outside and configured to delay a temperature rise of the contact surface due to the waste heat.

Here, the feedback device may apply a first voltage, which causes the thermoelectric module to perform the endothermic operation, to the thermoelectric module so that the feedback device provides cold sensation to the user.

Here, the feedback device may apply the first voltage, which is in the form of a duty signal.

Here, the thermal buffer material may be formed as an independent material and disposed in the heat radiator for the heat radiator to absorb the waste heat.

Here, the thermal buffer material may be disposed in the form of a layer.

Here, the heat radiator may be disposed on the thermoelectric module, the liquid provider may be disposed inside the heat radiator, and the thermal buffer material may be disposed in the form of a layer between the heat radiator and the thermoelectric module so that a time at which the waste heat is transferred to the heat radiator is delayed.

Here, the heat radiator may include a heat transferer configured to transfer the waste heat and a heat dissipator configured to dissipate the waste heat in the form of latent heat, the heat radiator may be disposed on the thermoelectric module, the liquid provider may be disposed inside the heat radiator and between the heat transferer and the heat dissipator, and the thermal buffer material may be disposed in the form of a layer between the heat transferer and the liquid provider so that a time at which the waste heat is transferred to the liquid provider is delayed.

Here, the heat radiator may be disposed on the thermoelectric module, and the liquid provider may be disposed at a side surface of the heat radiator and not come into contact with the thermoelectric module so that a dissipation path of the waste heat consists of the thermoelectric module and the heat radiator, and the thermal buffer material may be disposed in the form of a layer between the heat radiator and the thermoelectric module so that a time at which the waste heat is transferred to the heat radiator is delayed.

Here, the thermal buffer material may include a phase change material (PCM).

Here, a temperature of the thermal buffer material may be maintained without rising while a predetermined amount of heat is being absorbed.

Here, a phase of the thermal buffer material may be changed from a solid to a liquid while the predetermined amount of heat is being absorbed.

Here, the thermal buffer material may include xylitol or erythritol and be implemented as an independent material.

Here, the thermal buffer material may be included in a predetermined capsule and be implemented as an independent material.

Here, the thermal buffer material may be configured to be separated from the feedback device so that, when the thermal buffer material absorbs the waste heat, the waste heat is dissipated to the outside from outside the feedback device.

In accordance with yet another aspect of the present disclosure, a cooling device includes a thermoelectric module including a substrate having flexibility, a thermoelement disposed on the substrate and configured to perform an endothermic operation for cold feedback, and a contact surface disposed on the substrate, and configured to transfer cold heat generated through the endothermic operation to a user through the substrate and the contact surface to output the cold feedback, a heat radiator configured to dissipate waste heat to the outside when the waste heat is generated as the thermoelement performs the thermoelectric operation, a liquid provider configured to supply moisture to the heat radiator so that the waste heat is dissipated in the form of latent heat, a thermal buffer material formed of a material that absorbs a predetermined amount of heat from the outside and configured to delay a temperature rise of the contact surface due to the waste heat, and a supporter disposed to come into contact with the user and configured to support the thermoelectric module, the heat radiator, the liquid provider, and the thermal buffer material.

In accordance with yet another aspect of the present disclosure, a feedback device includes a thermoelectric module including a thermoelement configured to perform a thermoelectric operation for thermal feedback (the thermoelectric operation including an exothermic operation and an endothermic operation), and a contact surface thermally connected to the TE, and configured to transfer heat generated through the thermoelectric operation to a user through the contact surface to output the thermal feedback, a heat radiator configured to dissipate waste heat to the outside when the waste heat is generated as the thermoelement performs the thermoelectric operation, a liquid provider configured to provide moisture to the heat radiator so that the waste heat is dissipated in the form of latent heat, and a thermal buffer material formed of a material that absorbs a predetermined amount of heat from the outside and configured to delay the temperature rise of the contact surface due to the waste heat.

In accordance with yet another aspect of the present disclosure, a method of controlling a temperature inside a feedback device that performs a thermoelectric operation (the thermoelectric operation including an exothermic operation and an endothermic operation) and provides thermal feedback to the user includes, when waste heat is generated inside the feedback device as the thermoelectric operation is performed, dissipating the waste heat to the outside of the feedback device, when the amount of the generated waste heat is larger than that of the dissipated waste heat, increasing the temperature inside the feedback device up to a first temperature range, and maintaining the temperature inside the feedback device within the first temperature range during a predetermined amount of time so that a temperature rise inside the feedback device is delayed.

Here, the dissipating of the waste heat to the outside of the feedback device may include dissipating the waste heat in the form of latent heat by using a liquid included in the feedback device.

Here, the dissipating of the waste heat to the outside of the feedback device may include acquiring the liquid from a liquid provider included in the feedback device.

Here, the maintaining of the temperature inside the feedback device within the first temperature range may include delaying a temperature rise of a contact surface, at which a user comes into contact with the feedback device, due to the waste heat.

Here, the maintaining of the temperature inside the feedback device within the first temperature range may include adjusting the temperature inside the feedback device to be within the first temperature range by using a thermal buffer material.

Here, the thermal buffer material may include a PCM.

Here, the maintaining of the temperature inside the feedback device within the first temperature range may include absorbing the waste heat by the thermal buffer material and controlling a temperature of a surface of the thermal buffer material to be maintained within a second temperature range during a predetermined amount of time.

Here, a phase change may occur inside the thermal buffer material while the temperature of the surface of the thermal buffer material is maintained within the second temperature range.

Here, the thermal buffer material may be changed from a solid to a liquid while the temperature of the surface of the thermal buffer material is maintained within the second temperature range.

Here, a highest temperature within the second temperature range may be lower than a highest temperature within the first temperature range.

Here, the thermal buffer material may be formed in a separate shape with a separate material or be formed in the form of a layer and included in the feedback device.

Here, the method of controlling the temperature inside the feedback device may further include performing the endothermic operation so that cold feedback of the thermal feedback is provided to a user.

In accordance with yet another aspect of the present disclosure, a method of controlling a temperature of a cooling device that performs an endothermic operation and provides cold feedback to a user includes, when waste heat is generated inside the cooling device as the endothermic operation is performed, dissipating the waste heat to outside of the cooling device, when the amount of the generated waste heat is larger than that of the dissipated waste heat, increasing the temperature inside the cooling device up to a first temperature range, and maintaining the temperature inside the cooling device within the first temperature range so that cold sensation provided to the user through the cold feedback is not degraded by a predetermined level or more.

1. Feedback Device

Hereinafter, a feedback device 100 according to an embodiment of the present disclosure will be described.

The feedback device 100 according to the embodiment of the present disclosure is a device configured to provide thermal feedback to a user. Specifically, the feedback device 100 may perform an exothermic operation or an endothermic operation and apply heat to the user or absorb heat from the user to provide thermal feedback to the user.

The feedback device 100 according to another embodiment of the present disclosure is a device configured to generate power and provide the power. Specifically, the feedback device 100 may generate an electromotive force through a temperature difference inside the feedback device 100 and provide power.

1.1. Operation of Feedback Device 1.1.1. Thermal Feedback

Thermal feedback is a type of a thermal stimulator that stimulates thermal sensation organs distributed across a user's body to make the user feel thermal sensation. In the present specification, thermal feedback should be interpreted as encompassing all thermal stimulators that stimulate a user's thermal sensation organs.

Representative examples of the thermal feedback include a hot feedback and a cold feedback. The hot feedback means the thermal feedback making the user feel a hot sensation by applying a "hot heat" or a positive heat to a hot spot on the user's skin. The cold feedback means the thermal feedback making the user feel a cold sensation by applying a "cold heat" or a negative heat to a cold spot on the user's skin. Here, because heat is a physical quantity expressed as a scalar, "cold heat is applied" may not be a precise expression in terms of physics. However, in the present specification, for convenience of description, a phenomenon in which heat is applied will be expressed as applying hot heat, and the opposite phenomenon, that is, a phenomenon in which heat is absorbed, will be expressed as applying cold heat.

In the present specification, thermal feedback may further include thermal grill feedback in addition to hot feedback and cold feedback. When hot heat and cold heat are simultaneously provided, a user perceives a sensation of pain instead of separately perceiving the hot sensation and cold sensation. Such a sensation is a so-called thermal grill illusion (TGI, hereinafter referred to as "heat pain"). That is, thermal grill feedback refers to thermal feedback in which hot heat and cold heat are applied in combination and may be mostly provided by outputting hot feedback and cold feedback simultaneously. Thermal grill feedback may also be referred to as heat pain feedback due to its aspect of providing a sensation close to a sensation of pain. Thermal grill feedback will be described in more detail below.

1.1.2 Power Generation

The feedback device 100 may generate power. The above-described thermal feedback may refer to an operation in which power is applied to a thermoelectric module 1000, which will be described below, and an exothermic operation or an endothermic operation is performed. On the other hand, power generation may refer to an operation in which power is generated by a temperature difference in the thermoelectric module 1000.

1.2. Application Example of Feedback Device

The above-described feedback device 100 may be implemented in various forms. Hereinafter, some of the typical implementations of the feedback device 100 will be mentioned.

1.2.1. Gaming Controller

A gaming controller is one of the typical implementations of the feedback device 100. Here, a gaming controller may refer to an input unit that receives a user's manipulation in a game environment. A gaming controller is mostly linked to various devices for driving a game such as a game console device, a computer, a tablet, and a smartphone and serves to receive a user's manipulation used in the game. In a case of a portable game device, a gaming controller is integrally installed in the device itself.

Recently, a game environment has transformed from a traditional form in which a user's manipulation is reflected on a game screen output through a television (TV) or a monitor to virtual reality (VR) or augmented reality (AR) using a head mounted display (HMD) such as Oculus's Rift™ and Microsoft's HoloLens™. In the new game environment, beyond serving as a simple input unit, a gaming controller's role is being expanded to an output unit that provides various pieces of feedback to a user to increase user engagement in a game. As an example thereof, Dual Shock™ of Sony's PlayStation has a vibrating function for outputting tactile feedback to a user.

In the present specification, the feedback device 100 implemented as a gaming controller may provide thermal feedback to a user, thereby adding thermal sensation, which was conventionally not felt by the user, to a game as an interactive element and inducing higher engagement in the game.

1.2.2. Wearable Device

A wearable device 100*a* may be taken into consideration as another implementation of the feedback device 100.

Here, the wearable device 100*a* may refer to a device worn on a user's body and configured to perform various functions. Following the recent trend to pursue more convenient technologies, an interest in human-machine interface (HMI) has gradually been increased, and various wearable devices 100*a* have been developed. By introducing a thermal feedback function to the wearable device 100*a*, a new user experience may be possible.

FIGS. 1 to 12 relate to the wearable device 100*a* among the implementations of the feedback device 100 according to an embodiment of the present disclosure.

Figure 2:
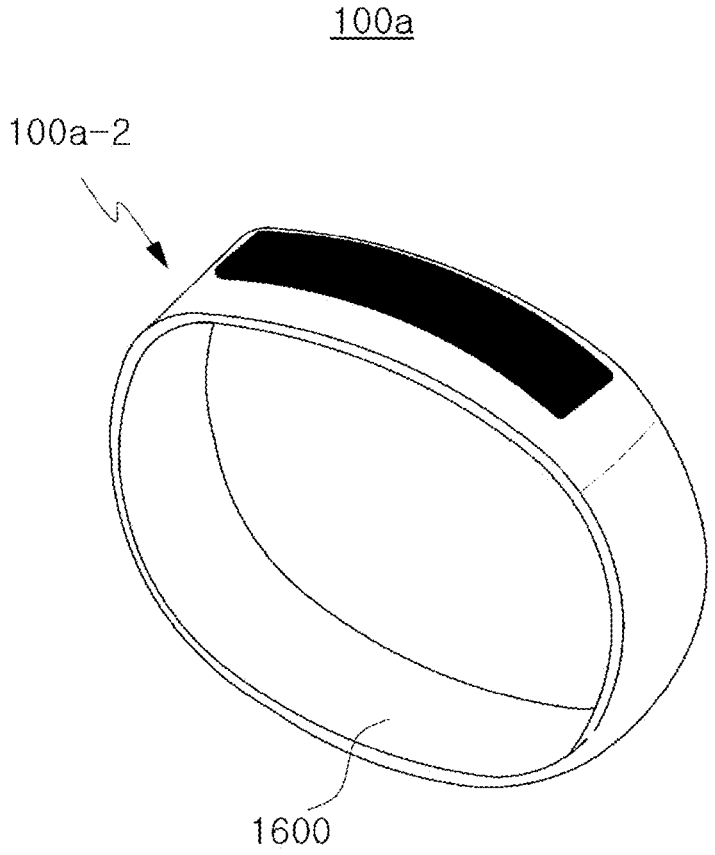
FIG. 2 is a schematic of a second embodiment of a feedback device according to an embodiment of the present disclosure.
Figure 3:
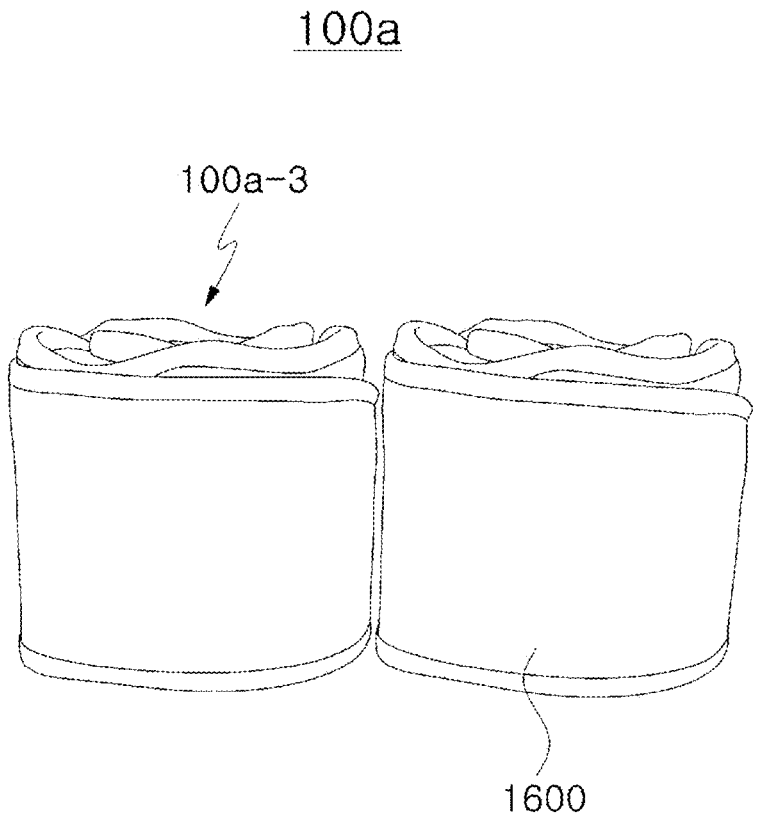
FIG. 3 is a schematic of a third embodiment of a feedback device according to an embodiment of the present disclosure.
Figure 4:
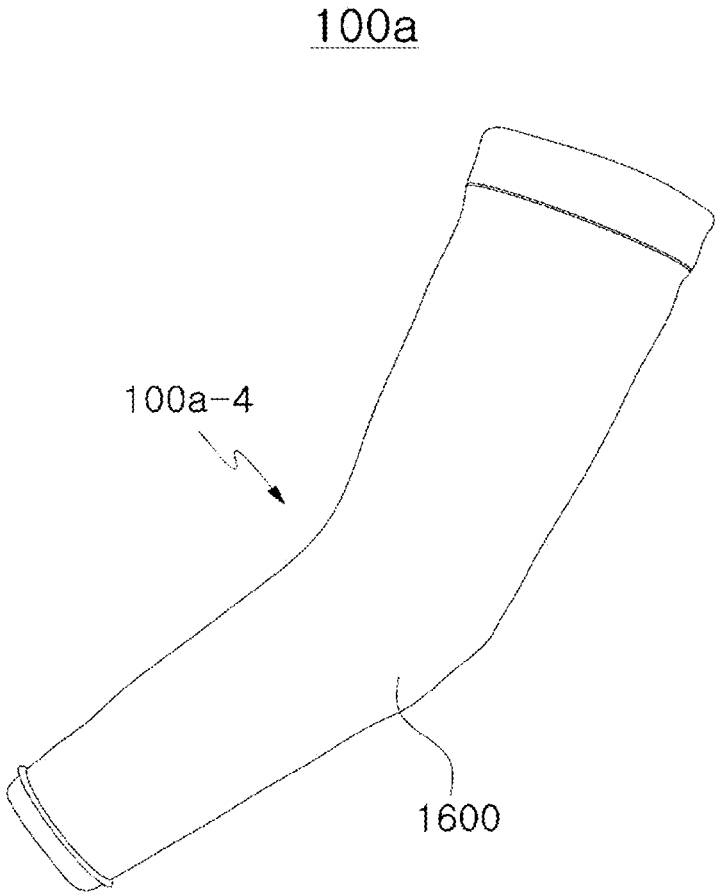
FIG. 4 is a schematic of a fourth embodiment of a feedback device according to an embodiment of the present disclosure.
Figure 5:
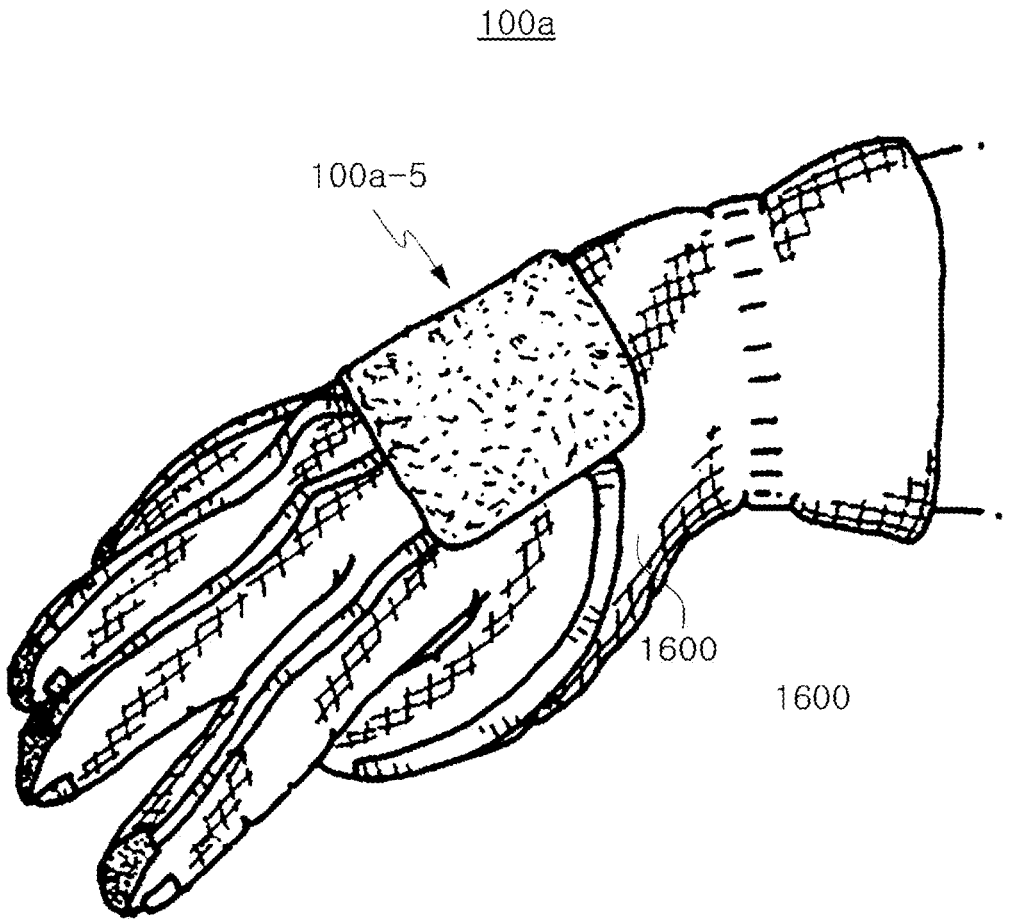
FIG. 5 is a schematic of a fifth embodiment of a feedback device according to an embodiment of the present disclosure.
Figure 6:
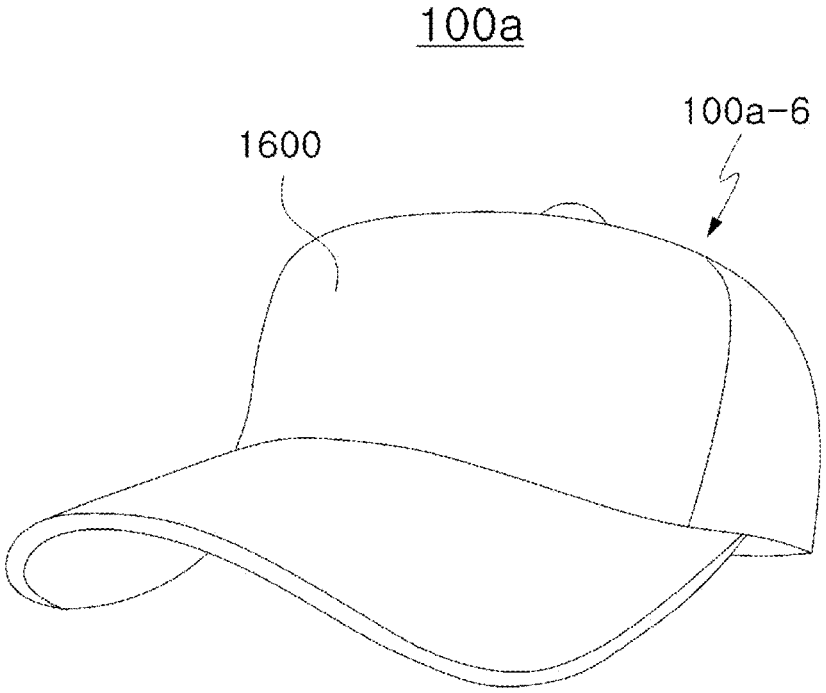
FIG. 6 is a schematic of a sixth embodiment of a feedback device according to an embodiment of the present disclosure.
Figure 7:
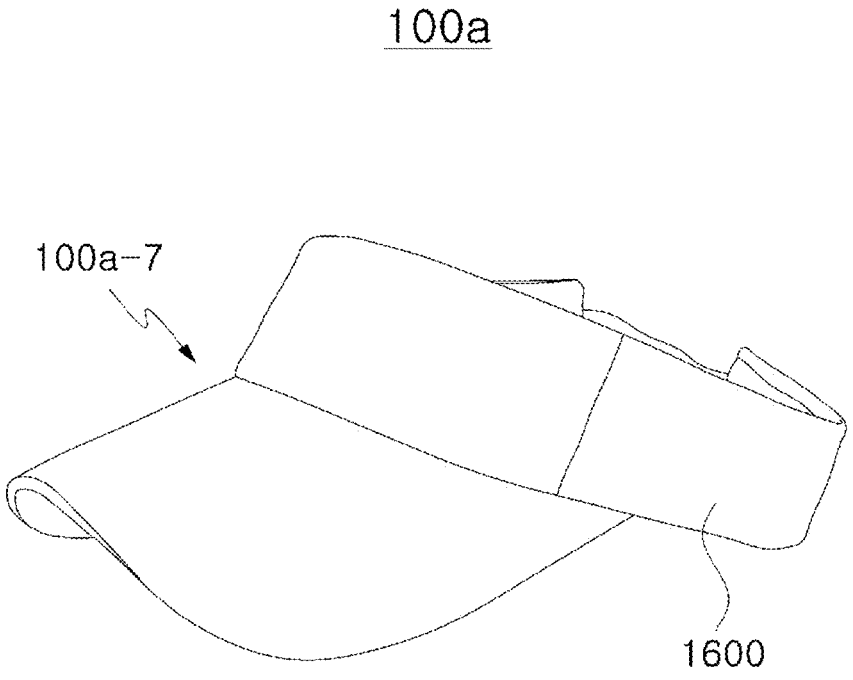
FIG. 7 is a schematic of a seventh embodiment of a feedback device according to an embodiment of the present disclosure.
Figure 8:
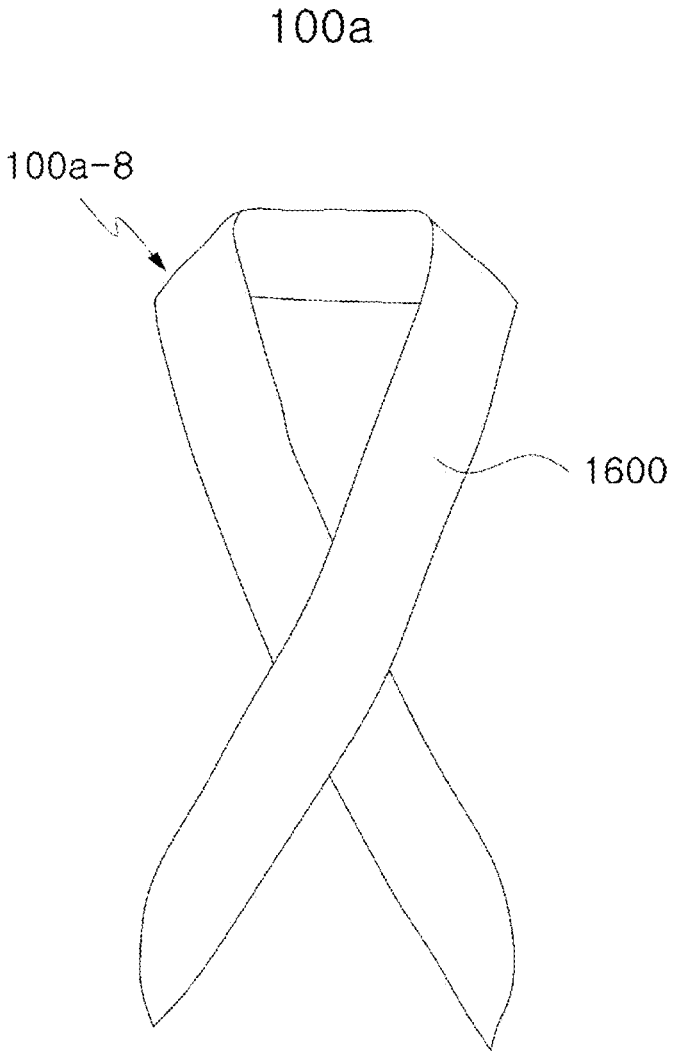
FIG. 8 is a schematic of an eight embodiment of a feedback device according to an embodiment of the present disclosure.
Figure 9:
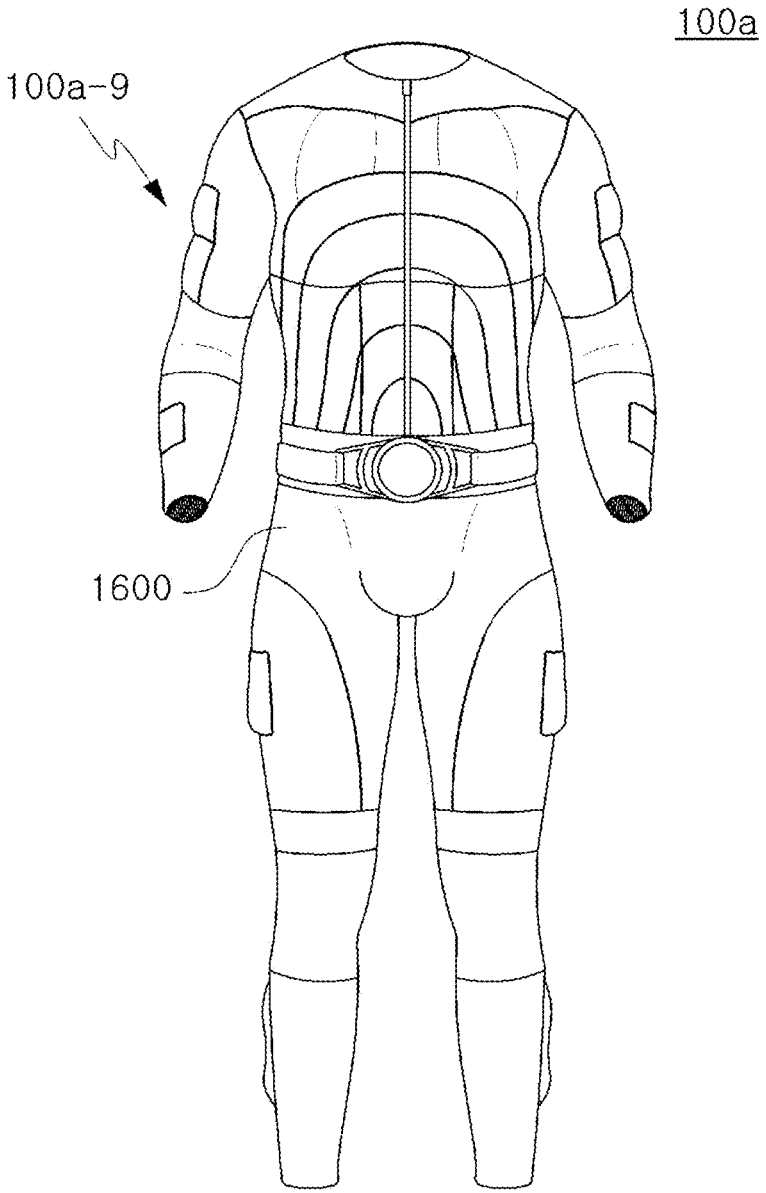
FIG. 9 is a schematic of a ninth embodiment of a feedback device according to an embodiment of the present disclosure.
Figure 10:
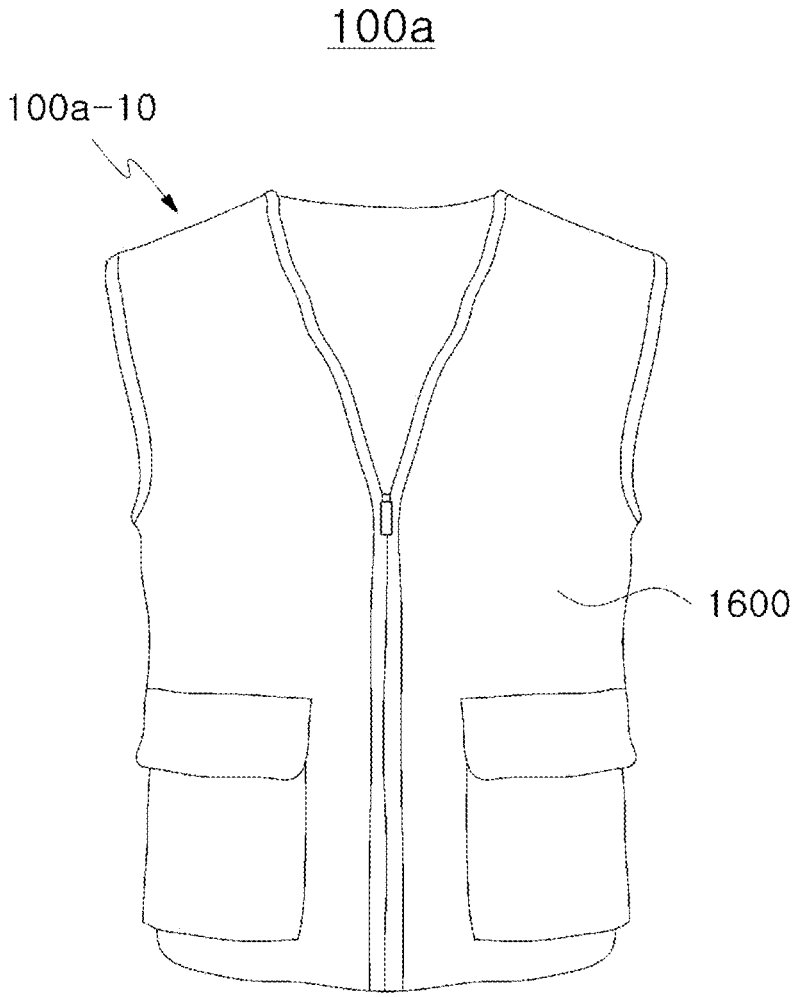
FIG. 10 is a schematic of a tenth embodiment of a feedback device according to an embodiment of the present disclosure.
Figure 11:
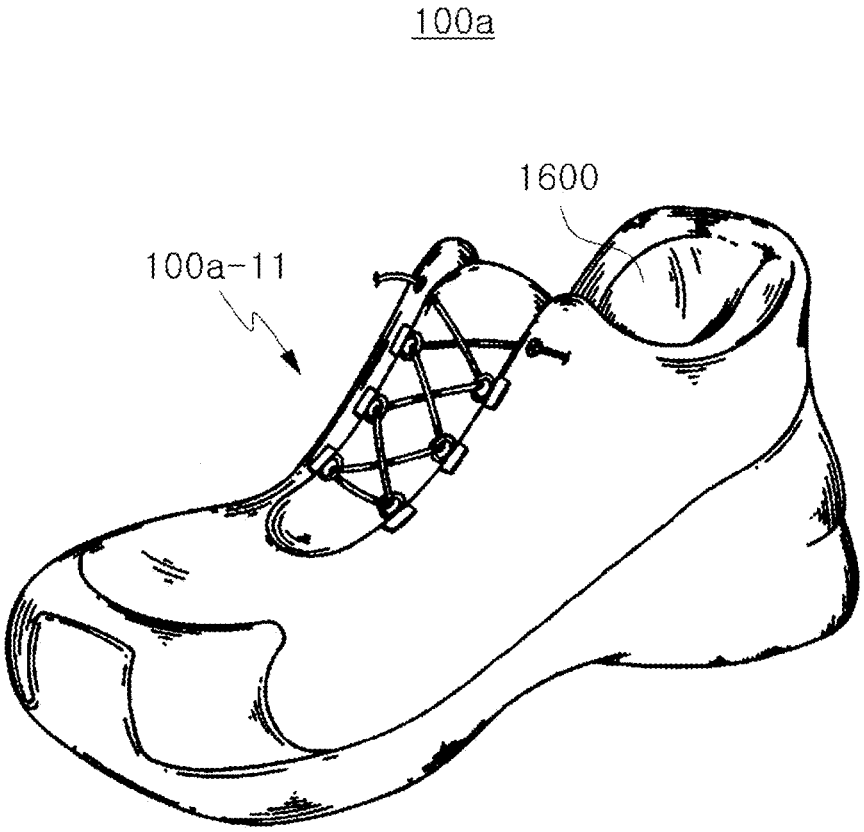
FIG. 11 is a schematic of an eleventh embodiment of a feedback device according to an embodiment of the present disclosure.
Figure 12:
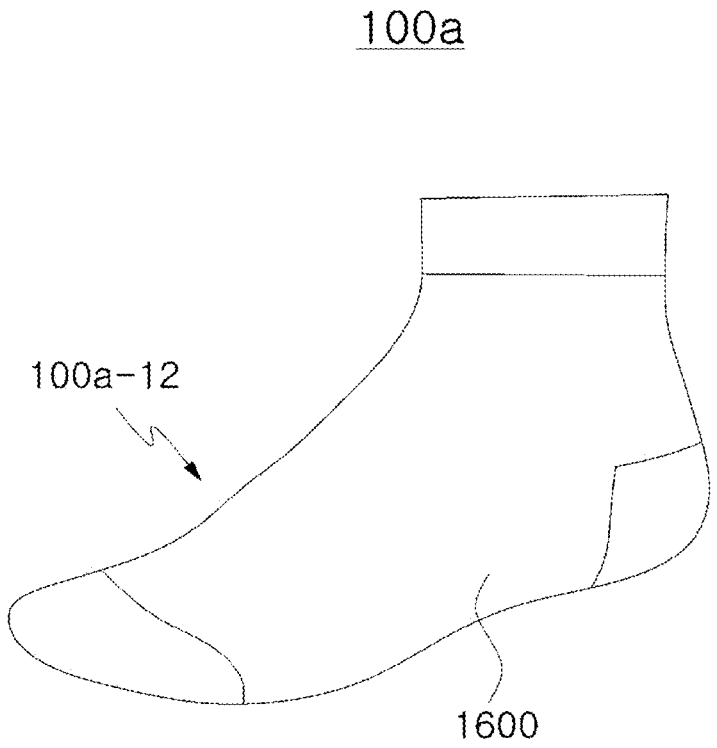
FIG. 12 is a schematic of a twelfth embodiment of a feedback device according to an embodiment of the present disclosure.

The wearable device 100*a*, as its name implies, has been developed in various forms, which are capable of being worn on various parts of a user's body, such as a watch type 100*a*-1 worn on a wrist as illustrated in FIG. 1, a band type 100*a*-2 illustrated in FIG. 2, a wrist band (strap) type 100*a*-3 illustrated in FIG. 3, an arm band (arm sleeve) type 100*a*-4 illustrated in FIG. 4, a glove type 100*a*-5 capable of being worn on a hand as illustrated in FIG. 5, cap types 100*a*-6 and 100*a*-7 capable of being worn on a head as illustrated in FIGS. 6 and 7, a scarf type 100*a*-8 capable of being worn on a user's body as illustrated in FIG. 8, a suit type 100*a*-9 capable of being worn as clothing as illustrated in FIG. 9, a vest type 100*a*-10 capable of being worn by a user as illustrated in FIG. 10, a shoe type 100*a*-11 capable of being worn as a shoe as illustrated in FIG. 11, and a sock type 100*a*-12 capable of being worn as a sock as illustrated in FIG. 12.

Like the above-described gaming controller, the wearable device 100*a* may also be designed to provide thermal feedback to a user through a portion in contact with the user's body. Referring to FIGS. 1 to 12, in each of the forms of the wearable device 100*a,* a portion through which thermal feedback is provided to the user's body, that is, a contact surface 1600, is marked. Positions of the contact surfaces 1600 are not limited by the drawings, and, in the wearable device 100*a,* the contact surfaces 1600 may also be disposed at portions different from those marked in the drawings.

1.2.3. Others

Although the gaming controller and the wearable device 100*a* among the implementations of the feedback device 100 have been described above, the implementations of the feedback device 100 are not limited thereto.

Actually, the feedback device 100 may be implemented as any device in which a thermal feedback function is usefully used. A few examples will be introduced to assist understanding. The feedback device 100 may be applied to a medical device for testing thermal sensation of a patient or may be applied to a steering wheel of a vehicle for a purpose of providing moderate warmth to a driver's hand or providing an alert signal. In addition, the feedback device 100 may be used in educational equipment to provide thermal sensation to a student and enhance and educational effect or may be used by being mounted at a seat of a movie theater to provide thermal sensation in addition to visual sensation to a user and enhance engagement in a movie.

1.3. Configuration of Feedback Device

Hereinafter, a configuration of the feedback device 100 according to an embodiment of the present disclosure will be described.

Figure 13:
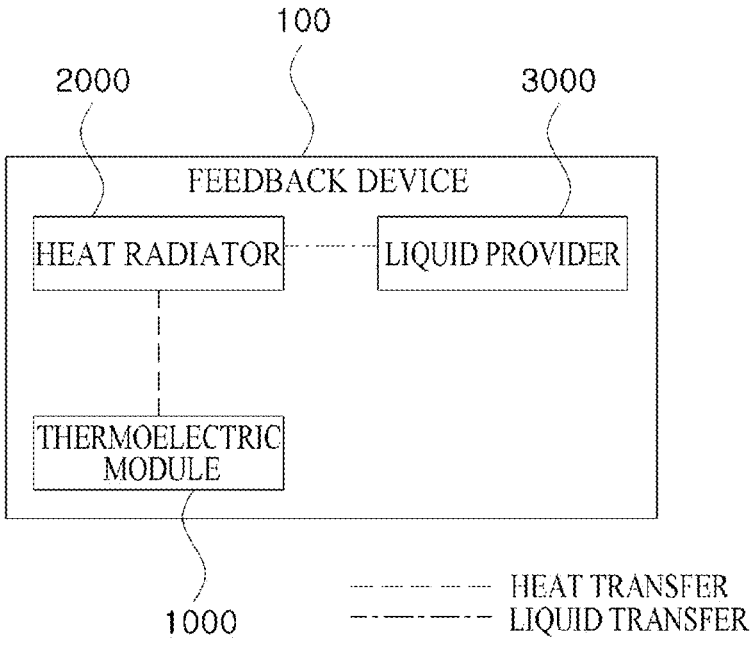
FIG. 13 is a block diagram of a configuration of a feedback device according to an embodiment of the present disclosure.

FIG. 13 is a block diagram of the configuration of the feedback device according to an embodiment of the present disclosure Referring to FIG. 13, the feedback device 100 may include a thermoelectric module 1000, a heat radiator 2000, and a liquid provider 3000.

The thermoelectric module 1000 may output thermal feedback. Thermal feedback may be output by the thermoelectric module 1000 including a thermoelement connected to the contact surface 1600 applying hot heat or cold heat generated in the thermoelement following application of power thereto to the user's body through the contact surface 1600 coming into contact with the user's body. In the embodiment of the present disclosure, the thermoelectric module 1000 may perform an exothermic operation, an endothermic operation, or a thermal grill operation in response to a thermal feedback signal received from an external device, which is not the feedback device 100, through a communication module (not illustrated) that performs communication with the external device and output thermal feedback, and the user may go through a thermal experience by the output thermal feedback. When a temperature difference occurs in the vicinity of the thermoelectric module 1000, an electromotive force may be generated, and the thermoelectric module 1000 may use the electromotive force and provide power.

The heat radiator 2000 may indicate a configuration that dissipates waste heat generated in the thermoelectric module 1000 to the outside of the feedback device 100. Here, the waste heat may refer to residual heat that remains after heat generated in the feedback device 100 is used to provide the thermal experience to the user. For example, residual heat that remains in the feedback device 100 after thermal feedback is output from the thermoelectric module 1000 may be included in the waste heat. The heat radiator 2000 will be described in more detail with reference to FIG. 28.

The liquid provider 3000 may indicate a configuration provided to dissipate waste heat in the form of latent heat from the heat radiator 2000. In the embodiment of the present disclosure, the liquid provider 3000 may provide a liquid to the heat radiator 2000, and the liquid provided to the heat radiator 2000 may be vaporized by the waste heat transferred from the thermoelectric module 1000. Due to the vaporization, a larger amount of waste heat may be dissipated to the outside. Due to the vaporization, the temperature of the feedback device 100 may drop. For example, the evaporated liquid may take heat away from a liquid that is provided to the heat radiator 2000 but not evaporated, and due to this, the temperature of the liquid that is provided to the heat radiator 2000 but not evaporated may be lowered. The liquid provider 3000 will be described in more detail with reference to FIG. 27.

1.3.1 Thermoelectric Module 1.3.1.1. Outline of Thermoelectric Module

The thermoelectric module 1000 may perform an exothermic operation, an endothermic operation, or a thermal grill operation and output thermal feedback that transfers hot heat and cold heat to a user. To perform the above-described exothermic operation, endothermic operation, or thermal grill operation, the thermoelectric module 1000 may use a thermoelement such as a Peltier element.

The Peltier effect is a thermoelectric phenomenon discovered by Jean Peltier in 1834 and refers to a phenomenon in which, when two different metals are joined and then a current is applied, an exothermic reaction occurs at one side and a cooling reaction occurs at the other side depending on a direction of the current. The Peltier element is an element that causes the Peltier effect. Although the Peltier element was initially formed with an alloy of different metals such as bismuth and antimony, the Peltier element has recently been manufactured by a method in which an N type and P type semiconductor is arranged between two metal plates to have higher thermoelectric efficiency.

Because heat generation and heat absorption are immediately induced in metal plates at both sides of the Peltier element when a current is applied thereto, the heat generation and the heat absorption may be switched according to a direction of the current, and an extent of the heat generation or the heat absorption may be relatively precisely adjusted according to the amount of the current, the Peltier element is appropriate to be used in the exothermic operation or the endothermic operation for thermal feedback. Particularly, as a flexible thermoelement has recently been developed, the thermoelectric module 1000 may be manufactured in the form that is easy to come into contact with a user's body, and commercial usability of the feedback device 100 is enhanced.

Accordingly, as electricity is applied to the above-described thermoelement, the thermoelectric module 1000 may perform the exothermic operation or the endothermic operation. In terms of physics, an exothermic reaction and an endothermic reaction simultaneously occur in a thermoelement that received electricity. However, in the present specification, an operation of the thermoelectric module 1000 in which a surface in contact with a user's body generates heat will be defined as the exothermic reaction, and an operation of the thermoelectric module 1000 in which the surface absorbs heat will be defined as the endothermic operation. For example, the thermoelement may be configured by disposing an N type and P type semiconductor on a substrate 1220. Here, when a current is applied, heat generation occurs at one side and heat absorption occurs at the other side. Here, when a side surface toward the user's body is referred to as a front surface, and a surface opposite the front surface is referred to as a rear surface, an operation of the thermoelectric module 1000 in which heat generation occurs at the front surface and heat absorption occurs at the rear surface may be defined as the exothermic operation, and conversely, an operation of the thermoelectric module 1000 in which heat absorption occurs at the front surface and heat generation occurs at the rear surface may be defined as the endothermic operation.

Because the thermoelectric effect is induced by a charge flowing in the thermoelement, electricity that induces the exothermic operation or the endothermic reaction of the thermoelectric module 1000 may be described in terms of a current. However, in the present specification, for convenience of description, the electricity will be collectively described in terms of a voltage. However, this is merely for convenience of description, and inventive thinking is not required for one of ordinary skill in the art to which the present disclosure pertains (hereinafter referred to as "person skill in the art") to change the description in terms of a voltage into description in terms of a current to interpret the description in terms of a voltage. Therefore, the present disclosure should not be limitedly interpreted in terms of a voltage.

The thermoelectric module 1000 may use a temperature difference in the thermoelectric module 1000 and provide power. The Seebeck effect is a thermoelectric phenomenon discovered by Thomas Johann Seebeck in 1821 and refers to a phenomenon in which, when different metal plates are joined and then a temperature difference is applied to the different metal plates, a thermal electromotive force is generated, causes electrons at a high temperature portion to have higher kinetic energy than the Fermi level and be diffused to a low temperature portion, and causes a potential difference, thereby providing power. The Seebeck element is an element that causes the Seebeck effect and, like the Peltier element, is manufactured by a method in which an N type and P type semiconductor is arranged between two metal plates. In the present specification, the thermoelectric module 1000 may be understood as a configuration capable of providing the above-described Peltier effect or Seebeck effect according to energy applied to the thermoelectric module 1000.

1.3.1.2. Configuration of Thermoelectric Module

Figure 14:
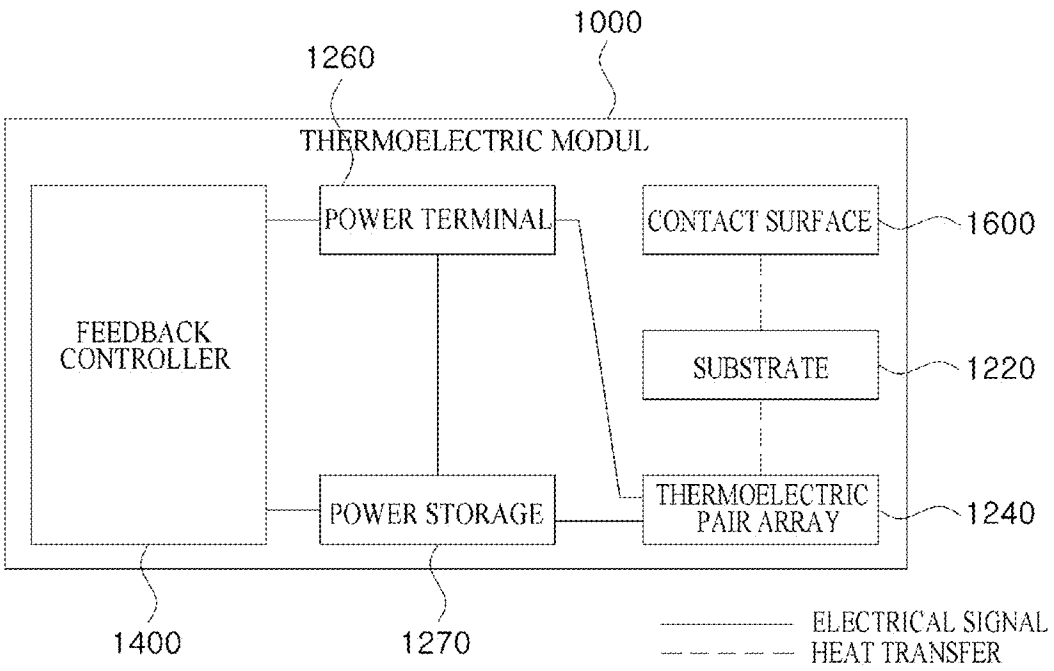
FIG. 14 is a block diagram of a configuration of a thermoelectric module according to an embodiment of the present disclosure.

FIG. 14 is a block diagram of the configuration of the thermoelectric module according to an embodiment of the present disclosure.

Referring to FIG. 14, the thermoelectric module 1000 may include the substrate 1220, a thermoelectric pair array 1240, the contact surface 1600, a power terminal 1260, a power storage 1270, and a feedback controller 1400.

The contact surface 1600 directly comes into contact with a user's body and transfers hot heat or cold heat generated in the thermoelectric module 1000 to the user's skin. In other words, a portion of an outer surface of the feedback device 100 directly or indirectly coming into contact with the user's body may be the contact surface 1600. The contact surface 1600 may also be disposed at an inner surface of the feedback device 100. For example, the contact surface 1600 may be formed at a grasping portion of a casing of the feedback device 100 grasped by the user. When the feedback device 100 is a wrist band type wearable device illustrated in FIG. 3, an entire inner surface of the wrist band or a portion thereof may be the contact surface 1600.

As an example, the contact surface 1600 may be provided in the form of a layer directly or indirectly attached to an outer surface (toward the user's body) of the thermoelectric pair array 1240 that performs the exothermic operation or the endothermic operation in the thermoelectric module 1000. The contact surface 1600 in such a form may be disposed between the thermoelectric pair array 1240 and the user's skin and perform heat transfer. To facilitate the heat transfer from the thermoelectric pair array 1240 to the user's body, the contact surface 1600 may be formed of a material having high thermal conductivity. Also, the layer type contact surface 1600 may prevent the thermoelectric pair array 1240 from being directly exposed to the outside and prevent the thermoelectric pair array 1240 from an external impact.

Although the contact surface 1600 has been described above as a separate configuration disposed at the outer surface of the thermoelectric pair array 1240, unlike this, the outer surface itself of the thermoelectric pair array 1240 may be the contact surface 1600. In other words, an entire front surface of the thermoelectric pair array 1240 or a portion thereof may be the contact surface 1600.

The substrate 1220 serves to support a unit thermoelectric pair 1241 and is formed of an insulating material. For example, ceramic may be selected as a material of the substrate 1220. A flat plate may be used for the substrate 1220, but the substrate 1220 is not necessarily formed of a flat plate.

The substrate 1220 may be formed of a flexible material having flexibility that may be universally used for various types of feedback devices 100 having various shapes of contact surfaces 1600. For example, a portion at which the feedback device 100 comes into contact with a user is mostly curved in a wearable device type feedback device 100, and for the thermoelectric module 1000 to be used at the curved portion, it may be important that the thermoelectric module 1000 has flexibility. Examples of flexible materials used for the substrate 1220 may include glass fiber, flexible plastic, or the like. According to circumstances, the substrate 1220 may not be included in the thermoelectric module 1000. In this case, hot heat or cold heat generated in the thermoelectric pair array 1240 may be directly transferred to the contact surface 1600 without passing through the substrate 1220.

The thermoelectric pair array 1240 includes a plurality of unit thermoelectric pairs 1241. In an embodiment, the thermoelectric pair array 1240 may be disposed on the substrate 1220. Although pairs of different metals (for example, bismuth and antimony) may be used as the unit thermoelectric pairs 1241, pairs of an N-type semiconductor and a P-type semiconductor may be mainly used as the unit thermoelectric pairs 1241.

In the unit thermoelectric pair 1241, the pair of semiconductors are electrically connected to each other at one end and electrically connected to another unit thermoelectric pair 1241 at the other end. An electrical connection between a pair of semiconductors 1241*a* and 1241*b* or with an adjacent semiconductor pair may be performed by a conductor member 1242 disposed on the substrate 1220. The conductor member 1242 may be a lead wire or an electrode formed of copper, silver, or the like.

The electrical connection between the unit thermoelectric pairs 1241 may be mainly performed by serial connection, the serially connected unit thermoelectric pairs 1241 may form a thermoelectric pair group 1250, and the thermoelectric pair group 1250 may form the thermoelectric pair array 1240.

The power terminal 1260 may apply power to the thermoelectric module 1000. The thermoelectric pair array 1240 may generate heat or absorb heat according to a voltage value or a direction of a current of power applied to the power terminal 1260. More specifically, two power terminals 1260 may be connected to a single thermoelectric pair group 1250. Consequently, when a plurality of thermoelectric pair groups 1250 are present, two power terminals 1260 may be disposed for each of the thermoelectric pair groups 1250. According to such a connection method, a voltage value or a direction of a current may be separately controlled for each of the thermoelectric pair groups 1250, and whether to perform heat generation or heat absorption and an extent thereof may be adjusted.

As will be described below, the power terminal 1260 receives an electrical signal output by the feedback controller 1400, and accordingly, as a result, the feedback controller 1400 may adjust a direction or magnitude of the electrical signal and control the exothermic operation and the endothermic operation of the thermoelectric module 1000. When the plurality of thermoelectric pair groups 1250 are present, an electrical signal applied to each of the power terminals 1260 may be separately adjusted for each of the thermoelectric pair groups 1250.

The power terminal 1260 may acquire power from the power storage 1270 or acquire power from an external power source.

The power storage 1270 may store power. Power stored in the power storage 1270 may be provided to the thermoelectric module 1000 through the power terminal 1260. In an embodiment of the present disclosure, when heat is applied to the thermoelectric pair array 1240 and a temperature different occurs in the thermoelectric pair array 1240, the thermoelectric pair array 1240 may generate power, and the power storage 1270 may store the power generated by the thermoelectric pair array 1240.

The feedback controller 1400 may apply an electrical signal to the thermoelectric pair array 1240 through the power terminal 1260. The feedback controller 1400 may apply a voltage to the thermoelement of the thermoelectric module 1000 and control the thermoelectric module 1000 to perform the exothermic operation or the endothermic operation. The feedback controller 1400 may also perform signal processing between an external device and the feedback device 100. For example, the feedback controller 1400 may receive information on thermal feedback from an external device through the communication module (not illustrated), interpret the information on the thermal feedback, determine a type or intensity of the thermal feedback, generate an electrical signal according to a result of determination, and apply the generated electrical signal to the power terminal 1260 to allow the thermoelectric pair array 1240 to output the thermal feedback.

For this, the feedback controller 1400 may compute and process various pieces of information, output an electrical signal to the thermoelectric pair array 1240 according to a result of processing, and control an operation of the thermoelectric pair array 1240. When power is generated by the thermoelectric pair array 1240, the feedback controller 1400 may control the generated power. For example, the feedback controller 1400 may determine whether to store the generated power in the power storage 1270 or immediately supply the generated power from the thermoelectric pair array 1240 to the power terminal 1260.

The feedback controller 1400 may be implemented with a computer or an apparatus similar thereto according to hardware, software, or a combination thereof. The feedback controller 1400 may be provided in the form of an electronic circuit that processes an electrical signal and performs a control function in terms of hardware and may be provided in the form of a program or code for driving a hardware circuit in terms of software.

A plurality of thermoelectric modules 1000 may be provided in the feedback device 100. For example, when the feedback device 100 has a plurality of contact portions, the thermoelectric module 1000 may be mounted for each of the contact portions. When the plurality of thermoelectric modules 1000 is provided in a single feedback device 100 in this way, the feedback controller 1400 may be provided for each of the thermoelectric modules 1000 or a single feedback controller configured to collectively manage all of the thermoelectric modules 1000 may be provided in the feedback device 100. When a plurality of feedback devices 100 are present, a single thermoelectric module 1000 or a plurality of thermoelectric modules 1000 may be disposed in each of the feedback devices 100.

1.3.1.3 Form of Thermoelectric Module

Some typical forms of the thermoelectric module 1000 will be described on the basis of the above-described configuration of the thermoelectric module 1000.

Figure 15:
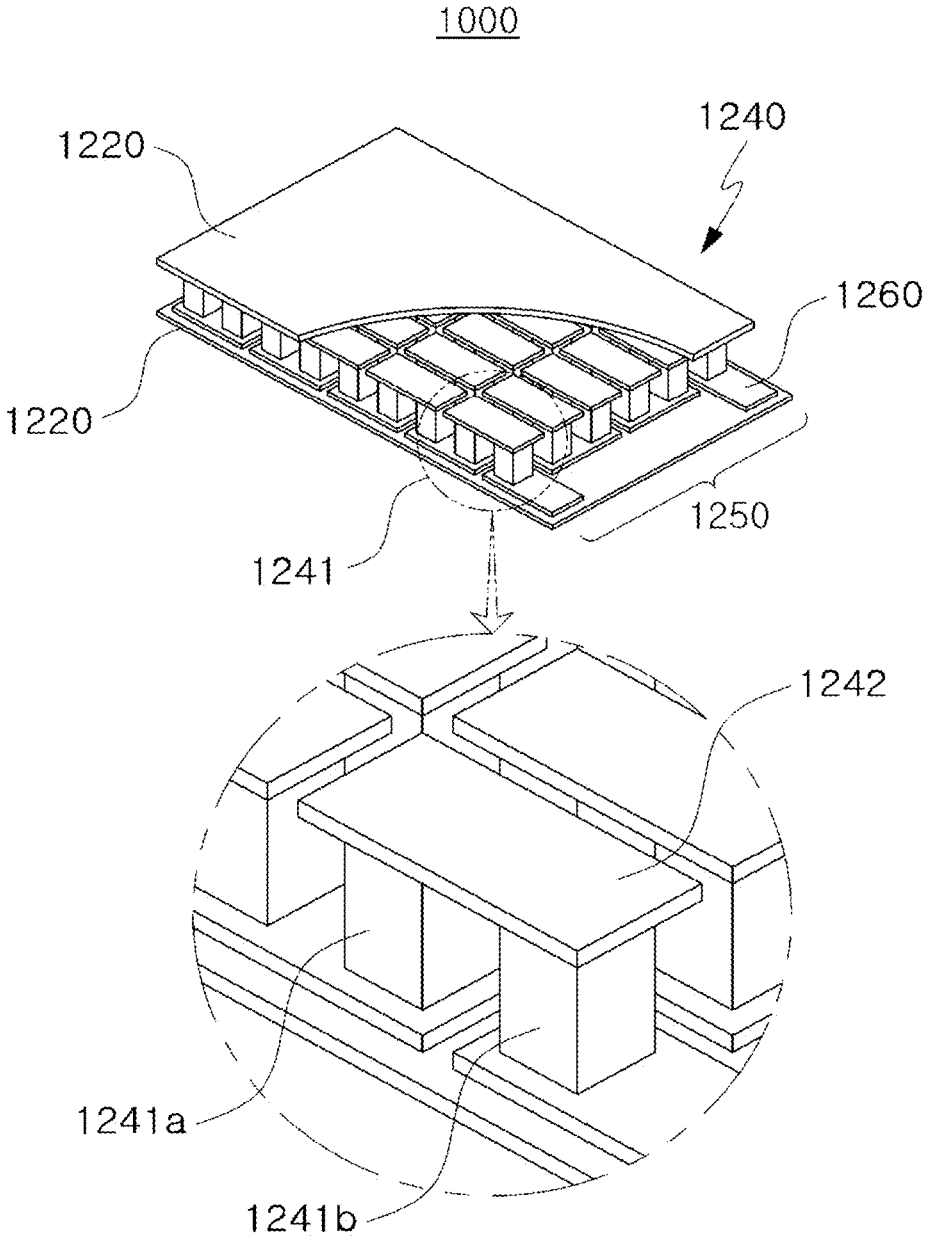
FIG. 15 is a view illustrating one form of a thermoelectric module according to an embodiment of the present disclosure.

FIG. 15 is a view illustrating one form of the thermoelectric module according to an embodiment of the present disclosure.

Referring to FIG. 15, in one form of the thermoelectric module 1000, a pair of substrates 1220 are provided to face each other. The contact surface 1600 may be disposed at an outer side of one of the two substrates 1220 and transfer heat generated by the thermoelectric module 1000 to the user's body. When a flexible substrate 1220 is used as the substrate 1220, flexibility may be imparted to the thermoelectric module 1000.

The plurality of unit thermoelectric pairs 1241 are located between the substrates 1220. Each of the unit thermoelectric pairs 1241 includes a pair of semiconductors that consist of an N-type semiconductor and a P-type semiconductor. In each of the unit thermoelectric pairs 1241, one ends of the N-type semiconductor and the P-type semiconductor are electrically connected to each other by the conductor member 1242. Also, unit elements are electrically connected by a method in which the other ends of an N-type semiconductor and a P-type semiconductor of any unit thermoelectric pair 1241 are connected to the other ends of a P-type semiconductor and an N-type semiconductor of an adjacent unit thermoelectric pair 1241 by the conductor member 1242. Accordingly, the connected unit elements are serially connected and form a single thermoelectric pair group 1250. In the present form, because an entire thermoelectric pair array 1240 is formed of a single thermoelectric pair group 1250, and the entire unit thermoelectric pairs 1241 are serially connected between the power terminals 1260, the thermoelectric module 1000 performs the same operation throughout front surfaces of the entire unit thermoelectric pairs 1241. That is, the thermoelectric module 1000 may perform the exothermic operation when power is applied to the power terminal 1260 in one direction and may perform the endothermic operation when power is applied to the power terminal 1260 in the other direction.

Figure 16:
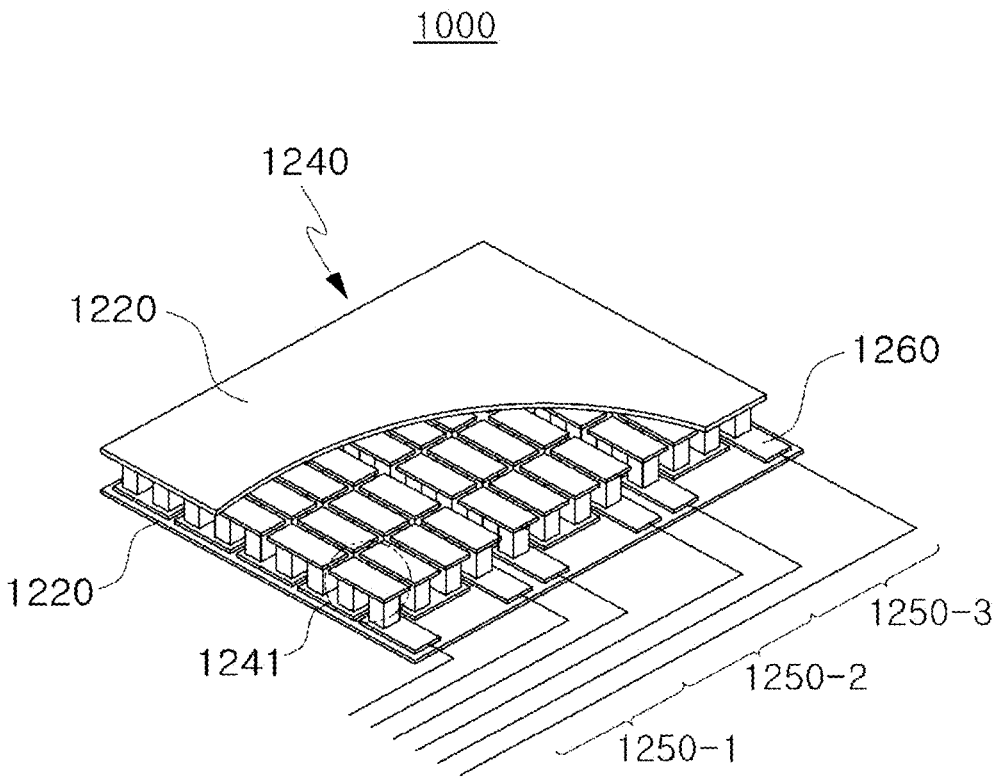
FIG. 16 is a view illustrating another form of the thermoelectric module according to an embodiment of the present disclosure.

FIG. 16 is a view illustrating another form of the thermoelectric module according to an embodiment of the present disclosure.

Referring to FIG. 16, the other form of the thermoelectric module 1000 is similar to the above-described form. However, in the present form, the thermoelectric pair array 1240 has a plurality of thermoelectric pair groups 1250, and each of the thermoelectric pair groups 1250 is connected to one of the power terminals 1260. Accordingly, each of the thermoelectric pair groups 1250 may be separately controlled. For example, in FIG. 16, currents in different directions may be applied to a first thermoelectric pair group 1250-1 and a second thermoelectric pair group 1250-2 so that the first thermoelectric pair group 1250-1 performs the exothermic operation (here, a direction of a current is "forward direction"), and the second thermoelectric pair group 1250-2 performs the endothermic operation (here, a direction of a current is "reverse direction"). As another example, different voltage values may be applied to the power terminal 1260 of the first thermoelectric pair group 1250-1 and the power terminal 1260 of the second thermoelectric pair group 1250-2 so that the first thermoelectric pair group 1250-1 and the second thermoelectric pair group 1250-2 perform the exothermic operation and the endothermic operation at different extents.

Although the thermoelectric pair groups 1250 are illustrated as being arranged in a one-dimensional array in the thermoelectric pair array 1240, unlike this, the thermoelectric pair groups 1250 may also be arranged in a two-dimensional array.

Figure 17:
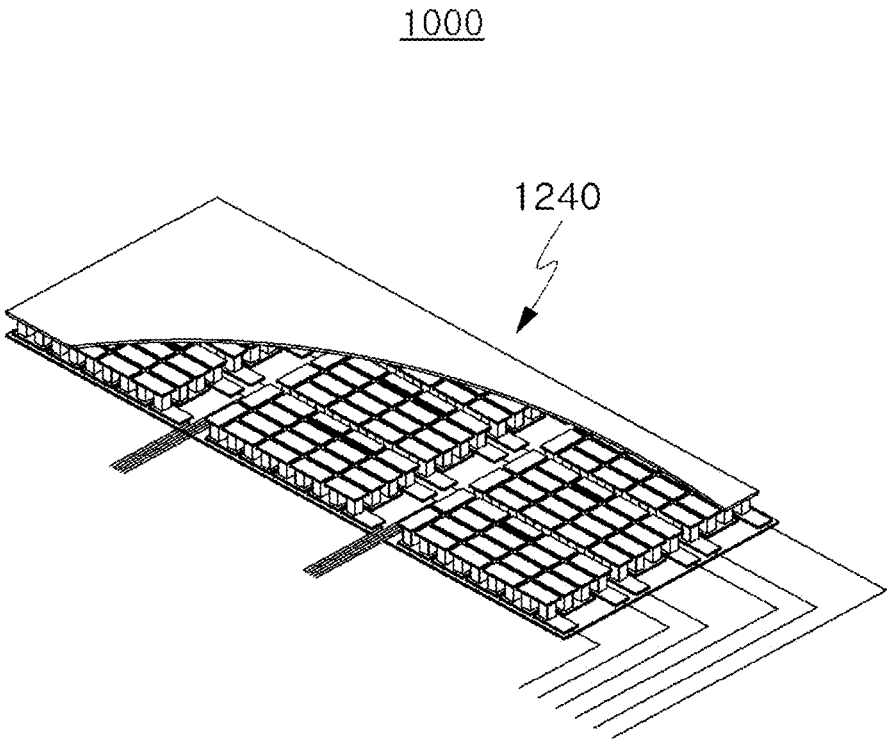
FIG. 17 is a view illustrating still another form of the thermoelectric module according to an embodiment of the present disclosure.

FIG. 17 is a view illustrating still another form of the thermoelectric module according to an embodiment of the present disclosure. Referring to FIG. 17, when the thermoelectric pair groups 1250 disposed in a two-dimensional array are used, operations of further divided regions may be separately controlled.

Although it has been described above that the pair of substrates 1220 facing each other are used in the above-described forms of the thermoelectric module 1000, unlike this, a single substrate 1220 may be used.

Figure 18:
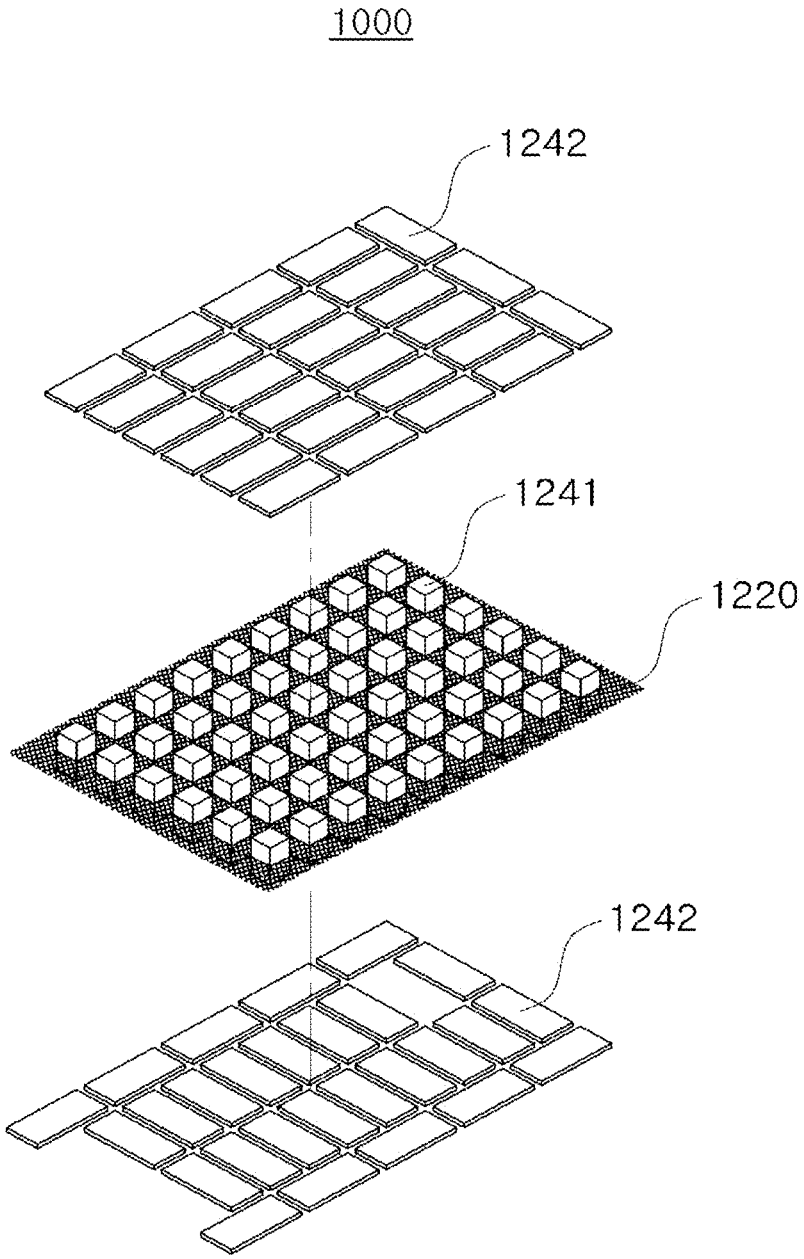
FIG. 18 is a view illustrating yet another form of the thermoelectric module according to an embodiment of the present disclosure.

FIG. 18 is a view illustrating yet another form of the thermoelectric module according to an embodiment of the present disclosure. Referring to FIG. 18, the unit thermoelectric pair 1241 and the conductor member 1242 may be built in a single substrate 1220. For this, glass fiber or the like maybe used for the substrate 1220. When the single substrate 1220 having the above form is used, higher flexibility may be imparted to the thermoelectric module 1000.

The above-described various forms of the thermoelectric module 1000 may be combined or modified within the self-evident scope by a person skilled in the art. For example, although the contact surface 1600 has been described as being formed as a separate layer from the thermoelectric module 1000 at the front surface of the thermoelectric module 1000 in each of the forms of the thermoelectric module 1000, the front surface itself of the thermoelectric module 1000 may be the contact surface 1600. For example, in one form of the above-described thermoelectric module 1000, an outer surface of the substrate 1220 may be the contact surface 1600.

1.3.1.4 Output of Thermal Feedback

Hereinafter, a thermal feedback output operation performed by the feedback device 100 will be described.

The feedback device 100 may output thermal feedback as the thermoelectric module 1000 performs the exothermic operation or the endothermic operation. The thermal feedback may include hot feedback, cold feedback, and thermal grill feedback.

Here, the hot feedback may be output by the thermoelectric module 1000 performing the exothermic operation. The cold feedback may be output by the thermoelectric module 1000 performing the endothermic operation. Also, the thermal grill feedback may be output by a thermal grill operation in which the exothermic operation and the endothermic operation are combined.

The feedback device 100 may output the above thermal feedback at various intensities. An intensity of thermal feedback may be adjusted by, for example, a method in which a level of a voltage applied to the thermoelectric pair array 1240 through the power terminal 1260 is adjusted by the feedback controller 1400 of the thermoelectric module 1000. Here, the method of adjusting a level of a voltage includes a method in which a duty signal is smoothed and then power that is to be finally applied to the thermoelement is applied. That is, adjusting a level of a voltage by adjusting a duty rate of a duty signal should be understood as belonging to the adjusting of the level of a voltage.

Hereinafter, the exothermic operation, the endothermic operation, and the thermal grill operation will be described in more detail.

1.3.1.4.1 Exothermic/Endothermic Operation

The feedback device 100 may perform the exothermic operation with the thermoelectric module 1000 and provide hot feedback to the user. Similarly, the feedback device 100 may perform the endothermic operation with the thermoelectric module 1000 and provide cold feedback to the user.

Figure 19:
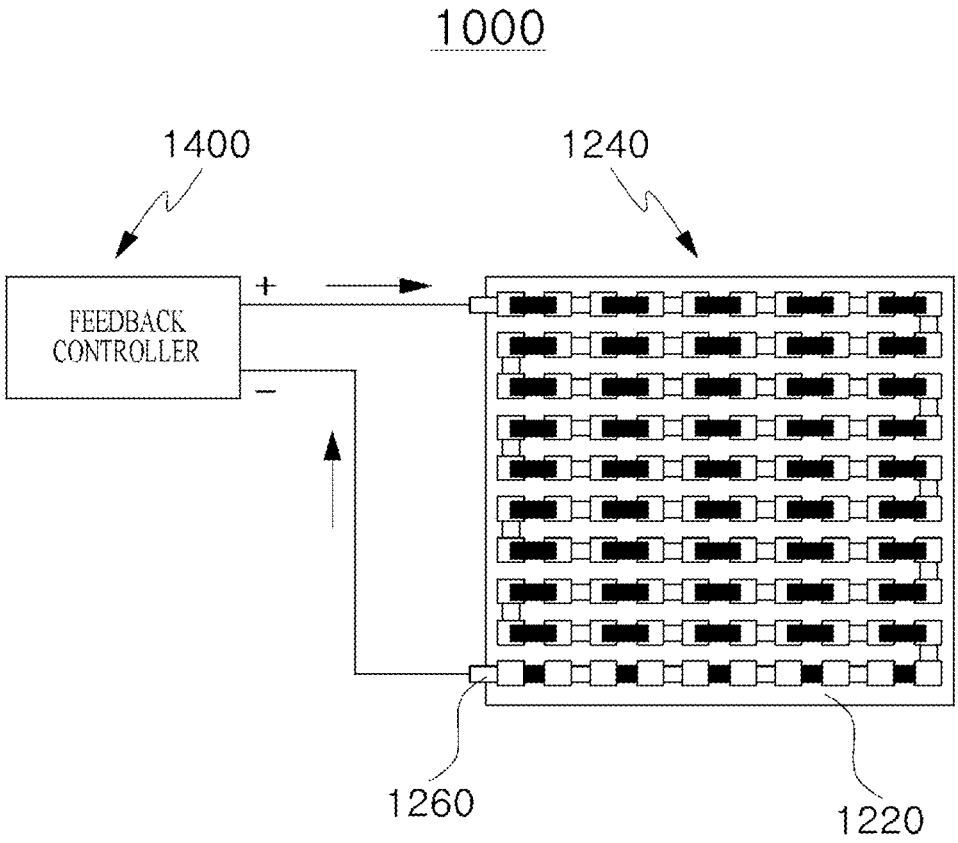
FIG. 19 is a view illustrating an exothermic operation for providing hot feedback according to an embodiment of the present disclosure.
Figure 20:
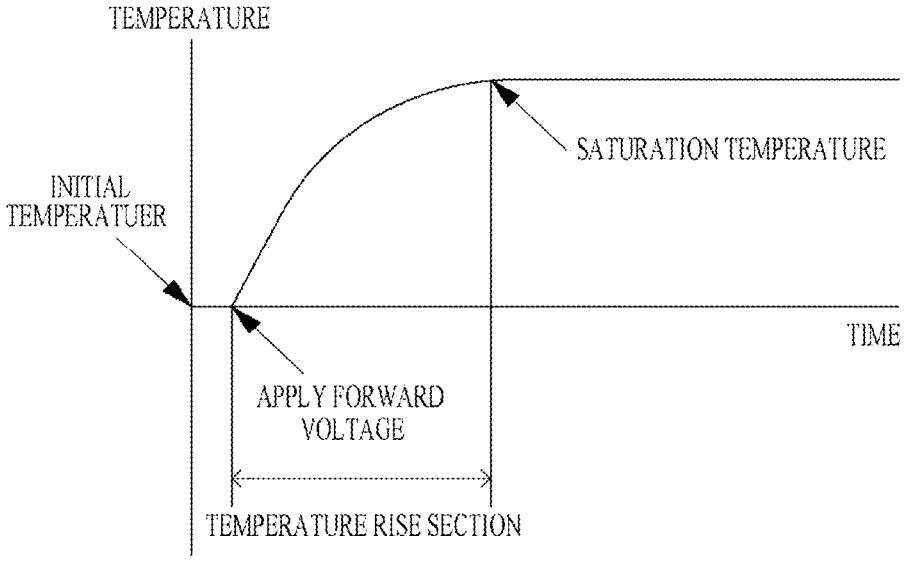
FIG. 20 is a graph related to an intensity of hot feedback according to an embodiment of the present disclosure.

FIG. 19 is a view illustrating an exothermic operation for providing hot feedback according to an embodiment of the present disclosure, and FIG. 20 is a graph related to an intensity of hot feedback according to an embodiment of the present disclosure.

Referring to FIG. 19, the exothermic operation may be performed by inducing an exothermic reaction toward the contact surface 1600 as a current in a forward direction is applied to the thermoelectric pair array 1240 by the feedback controller 1400. Here, when the feedback controller 1400 applies a predetermined voltage (hereinafter, a voltage that causes the exothermic reaction will be referred to as "forward voltage") to the thermoelectric pair array 1240, the thermoelectric pair array 1240 starts the exothermic operation, and as illustrated in FIG. 20, the temperature of the contact surface 1600 rises to a saturation temperature with time. Consequently, the user does not feel or only slightly feels hot sensation at an initial stage of the exothermic operation, feels an increase of the hot sensation until the temperature of the contact surface 1600 reaches the saturation temperature, and then receives hot feedback corresponding to the saturation temperature after a predetermined amount time elapses.

Figure 21:
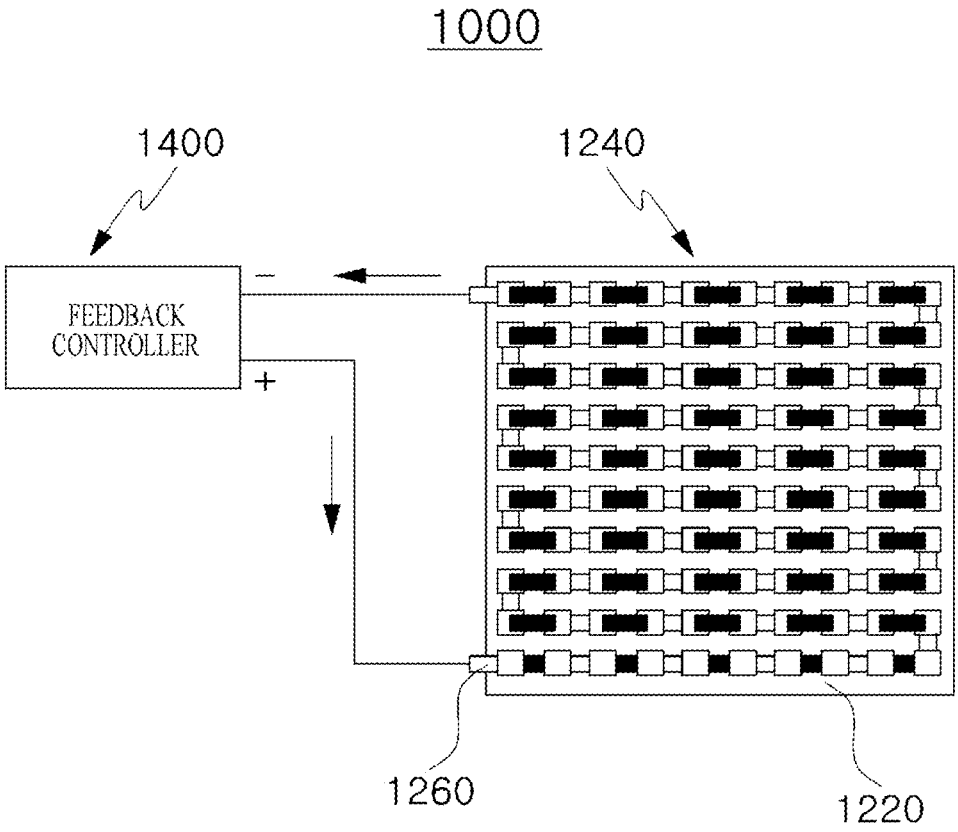
FIG. 21 is a view illustrating an exothermic operation for providing cold feedback according to an embodiment of the present disclosure.
Figure 22:
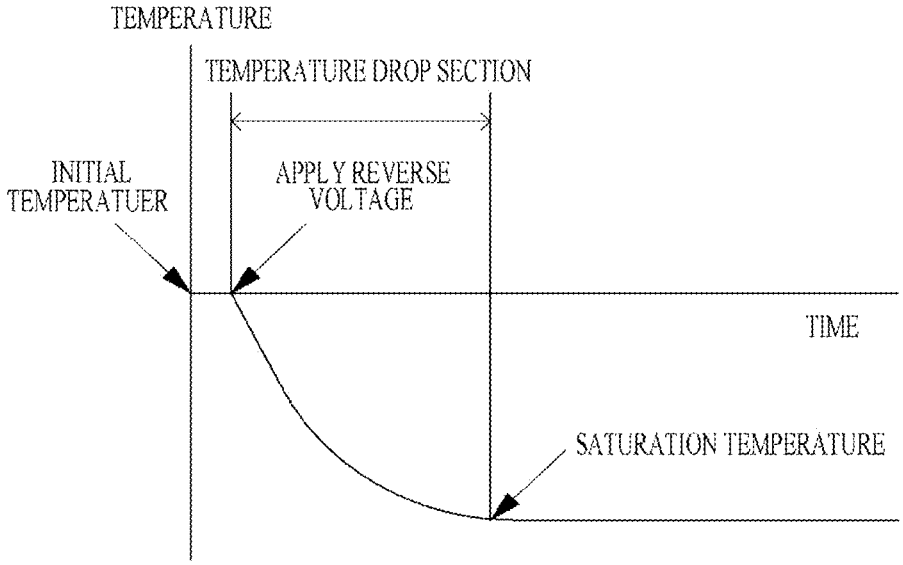
FIG. 22 is a graph related to an intensity of cold feedback according to an embodiment of the present disclosure.

FIG. 21 is a view illustrating an exothermic operation for providing cold feedback according to an embodiment of the present disclosure, and FIG. 22 is a graph related to an intensity of cold feedback according to an embodiment of the present disclosure.

Referring to FIG. 21, the endothermic operation may be performed by inducing an endothermic reaction toward the contact surface 1600 as a current in a reverse direction is applied to the thermoelectric pair array 1240 by the feedback controller 1400. Here, when the feedback controller 1400 applies a predetermined voltage (hereinafter, a voltage that causes the endothermic reaction will be referred to as "reverse voltage") to the thermoelectric pair array 1240, the thermoelectric pair array 1240 starts the endothermic operation, and as illustrated in FIG. 22, the temperature of the contact surface 1600 drops to a saturation temperature with time. Consequently, the user does not feel or only slightly feels cold sensation at an initial stage of the endothermic operation, feels an increase of cold sensation until the temperature of the contact surface 1600 reaches the saturation temperature, and then receives cold feedback corresponding to the saturation temperature after a predetermined amount time elapses.

When power is applied to an thermoelement, in addition to an exothermic reaction and an endothermic reaction that occur at both sides of the thermoelement, electrical energy is converted into thermal energy, and heat is generated. Consequently, when a voltage at the same level is applied to the thermoelectric pair array 1240 with only a direction of a current changed, a temperature variation according to the exothermic operation may be higher than that according to the endothermic operation. Here, the temperature variation refers to a temperature difference between an initial temperature and a saturation temperature in a state in which the thermoelectric module 1000 is not operated.

Hereinafter, the exothermic operation and the endothermic operation performed by the thermoelement using electrical energy will be collectively referred to as "thermoelectric operation." Because the thermal grill operation, which will be described below, is an operation in which the exothermic operation and the endothermic operation are combined, the thermal grill operation may also be interpreted as a type of "thermoelectric operation."

1.3.1.4.2. Intensity Control of Exothermic/Endothermic Operation

When the thermoelectric module 1000 performs the exothermic operation or the endothermic operation as described above, the feedback controller 1400 may adjust a level of an applied voltage and control an extent of heat generation or an extent of heat absorption of the thermoelectric module 1000. Consequently, in addition to the feedback controller 1400 adjusting a direction of a current and selecting a type of thermal feedback to be provided among hot feedback and cold feedback, an intensity of the hot feedback or the cold feedback may be adjusted by adjusting a level of a voltage.

Figure 23:
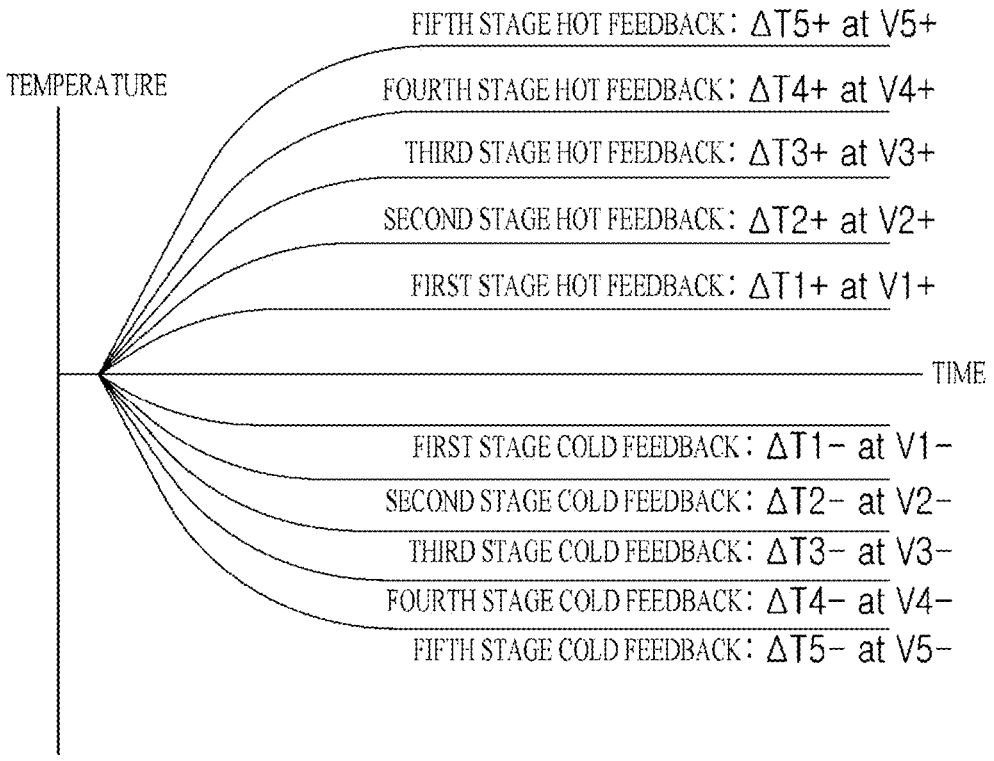
FIG. 23 is a graph related to intensities of hot/cold feedback using voltage adjustment according to an embodiment of the present disclosure.

FIG. 23 is a graph related to intensities of hot/cold feedback using voltage adjustment according to an embodiment of the present disclosure.

For example, referring to FIG. 23, the feedback controller 1400 may apply five stages of voltage values in a forward direction or a reverse direction, and the feedback device 100 may provide a total of ten types of thermal feedback including five stages of hot feedback and five stages of cold feedback.

Here, although the hot feedback and the cold feedback are illustrated in FIG. 23 as having the same number of intensity grades, the numbers of intensity grades of the hot feedback and the cold feedback are not necessarily the same and may also be different from each other.

Here, although the hot feedback and the cold feedback are illustrated as being implemented by changing a direction of a current using a voltage value at the same level, a level of a voltage value applied for the hot feedback and a level of a voltage value applied for the cold feedback are not necessarily the same.

Figure 24:
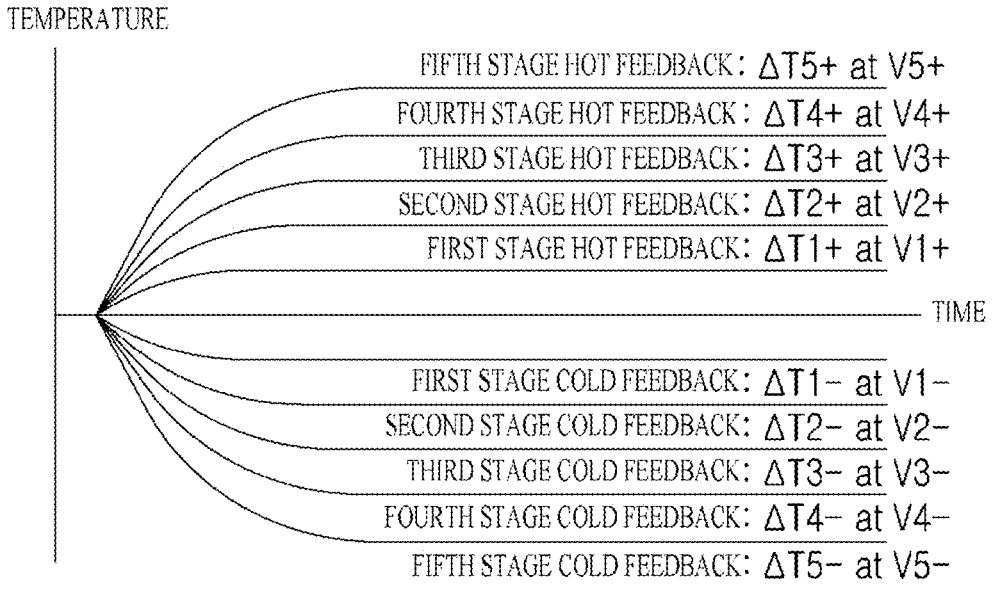
FIG. 24 is a graph related to hot/cold feedback having the same temperature variation according to an embodiment of the present disclosure.

Particularly, when the same voltage is applied in performing the exothermic operation and the endothermic operation, because a temperature variation of the hot feedback according to the exothermic operation is generally higher than a temperature variation according to the endothermic operation, similar to that illustrated in FIG. 24, a voltage higher than that applied for the same grade of hot feedback may be applied during cold feedback so that the same temperature variation is exhibited at intensity grades corresponding to each other. FIG. 24 is a graph related to hot/cold feedback having the same temperature variation according to an embodiment of the present disclosure.

When an intensity of thermal feedback is adjusted as described above, beyond simply providing hot sensation and cold sensation to a user, segmented thermal feedback such as strong hot sensation, weak hot sensation, strong cold sensation, and weak cold sensation may be provided. Such various segmented pieces of thermal feedback may allow a user to be more engaged in a game environment, a virtual/augmented reality environment, or the like, and when applied to a medical device, has an advantage of allowing a patient's sensation to be more precisely inspected.

1.3.1.4.3. Thermal Grill Operation

In addition to hot feedback and cold feedback, the feedback device 100 may provide thermal grill feedback. When a hot spot and a cold spot in a person's body are simultaneously stimulated, the person perceives a sensation of pain instead of perceiving hot sensation and cold sensation. The sensation of pain refers to heat pain. Consequently, the feedback device 100 may provide the thermal grill feedback to the user through the thermal grill operation in which the exothermic operation and the endothermic operation are performed in combination.

The feedback device 100 may perform the thermal grill operation using various methods for providing the thermal grill feedback. This will be described below after describing types of thermal grill feedback.

Thermal grill feedback may include neutral thermal grill feedback, hot heat grill feedback, and cold heat grill feedback.

Here, the include neutral thermal grill feedback, the hot heat grill feedback, and the cold heat grill feedback respectively causes a user to feel neutral heat pain, hot heat pain, and cold heat pain. The neutral heat pain refers to pain without warmth or coldness, the hot heat pain refers to pain in addition to warmth, and the cold heat pain refers to pain in addition to coldness.

The neutral heat pain is caused when intensities of warmth and coldness felt by the user correspond to a predetermined proportion range. A proportion in which a user feels the neutral heat pain (hereinafter referred to as "neutral proportion") may be different for each body part receiving thermal feedback and may be somewhat different even for the same body part depending on individuals. However, in most cases, the neutral heat pain tends to be felt in a situation in which an intensity of coldness is higher than an intensity of warmth.

Here, an intensity of thermal feedback may be a heat amount applied to a body part in contact with the contact surface 1600 or a heat amount absorbed from the corresponding body part by the feedback device 100. Consequently, when thermal feedback is applied to a predetermined area for a predetermined amount of time, an intensity of thermal feedback may be expressed as a temperature difference value of hot sensation or cold sensation with respect to a temperature of a target portion to which the thermal feedback is applied.

The human body temperature is generally between 36.5° C. and 36.9° C., and the average human skin temperature is known to be about 30° C. to 32° C. although different for each individual or part. The skin temperature of the palm is about 33° C., which is slightly higher than the average human skin temperature. However, the above-mentioned temperature values may be somewhat different depending on individuals and may somewhat vary even for the same person.

According to an experiment example, it was confirmed that the neutral heat pain was felt when warmth of about 40° C. and coldness of about 20° C. were applied to a palm at 33° C. This is a case in which, with respect to the temperature of the palm, warmth that is 7° C. higher and coldness that is 13° C. lower are applied. Consequently, the neutral proportion in terms of temperature may correspond to 1.86.

As it can be confirmed from the above, in the case of most people, the neutral proportion expressed as a proportion of a temperature difference caused by coldness to a temperature difference caused by warmth with respect to skin, which is a subject of contact, when hot sensation and cold sensation are continuously applied to the same size of a region of one's body is in the range of about 1.5 to 5. The hot heat pain may be felt when a level of warmth is higher than the neutral proportion, and the cold heat pain may be felt when a level of coldness is higher than the neutral proportion.

In an embodiment of the present disclosure, the feedback device 100 may perform the thermal grill operation using a voltage adjustment method. The thermal grill operation using the voltage adjustment method may be applied to the feedback device 100 in which the thermoelectric pair array 1240 consists of the plurality of thermoelectric pair groups 1250.

Specifically, the thermal grill operation using the voltage adjustment method may be performed by the feedback controller 1400 applying a forward voltage to some of the thermoelectric pair groups 1250 so that the exothermic operation is performed therein and applying a reverse voltage to the remaining thermoelectric pair groups 1250 so that the endothermic operation is performed therein and the thermoelectric module 1000 providing hot feedback and cold feedback simultaneously.

Figure 25:
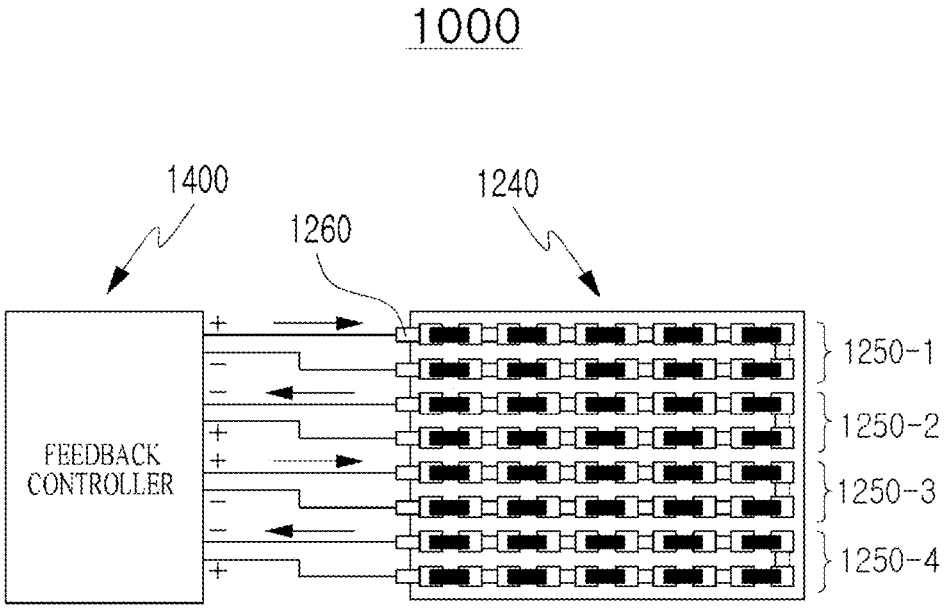
FIG. 25 is a view illustrating a thermal grill operation using a voltage adjustment method according to an embodiment of the present disclosure.

FIG. 25 is a view illustrating a thermal grill operation using a voltage adjustment method according to an embodiment of the present disclosure.

Referring to FIG. 25, the thermoelectric pair array 1240 includes the plurality of thermoelectric pair groups 1250 disposed to form a plurality of lines. Here, the feedback controller 1400 may apply power so that first thermoelectric pair groups 1250-1 (for example, thermoelectric pair groups in odd-numbered lines) perform the exothermic operation and second thermoelectric pair groups 1250-2 (for example, thermoelectric pair groups in even-numbered lines) perform the endothermic operation. When the thermoelectric pair groups 1250 alternately perform the exothermic operation and the endothermic operation according to the arrangement of the lines as above, the user may simultaneously receive hot sensation and cold sensation, and as a result, may receive thermal grill feedback. Here, because differentiation between odd-numbered lines and even-numbered lines is arbitrary, the lines may be changed in an opposite manner.

Here, the feedback device 100 may control a saturation temperature according to the exothermic operations of the first thermoelectric pair groups 1250-1 and a saturation temperature according to the endothermic operations of the second thermoelectric pair groups 1250-2 to conform to a neutral proportion and provide neutral thermal grill feedback.

FIG. 26 is a table related to voltages for providing neutral thermal grill feedback in the voltage adjustment method according to an embodiment of the present disclosure.

For example, referring to FIG. 26, when the feedback device 100, in which the feedback controller 1400 may apply five forward voltages and five reverse voltages to the thermoelectric module 1000, the thermoelectric module 1000 accordingly performs exothermic operations of five grades and endothermic operations of five grades, levels of temperature variations according to the exothermic operation and the endothermic operation of the same grade are the same, and levels of temperature variations between different grades of exothermic operations and endothermic operations are constant, is assumed, in a case in which a neutral proportion is set as 3, the feedback controller 1400 may apply a forward voltage of a first grade, which is a grade at which the level is the lowest, to the first thermoelectric pair group 1250-1 and apply a reverse voltage of a third grade to the second thermoelectric pair group 1250-2 so that the thermoelectric module 1000 may provide neutral heat pain feedback. Similarly, when the neutral proportion is set as 2.5, the feedback controller 1400 may apply a forward voltage of a second grade to the first thermoelectric pair group 1250-1 and apply a reverse voltage of a fifth grade to the second thermoelectric pair group 1250-2 to provide the neutral thermal grill feedback. Alternatively, when the neutral proportion is set as 4, the feedback controller 1400 may apply a forward voltage of a first grade to the first thermoelectric pair group 1250-1 and apply a reverse voltage of a fourth grade to the second thermoelectric pair group 1250-2 to generate the neutral thermal grill feedback. Alternatively, when the neutral proportion is set as 2, the feedback controller 1400 may apply a forward voltage of a first grade and a reverse voltage of a second grade or a forward voltage of a second grade and a reverse voltage of a fourth grade to provide neutral heat pain. Here, an intensity of the former neutral heat pain (the case in which the forward voltage of the first grade and the reverse voltage of the second grade are used) may be higher than an intensity of the latter neutral heat pain (the case in which the forward voltage of the second grade and the reverse voltage of the fourth grade are used). That is, the intensity adjustment is possible even in the case of thermal grill feedback. The above description on the method of providing neutral heat pain is merely illustrative, and the present disclosure is not limited thereto. For example, the number of grades of thermal feedback is not necessarily five, and the numbers of grades of cold heat and hot heat may also be different. Differences between temperature variations of different grades may not be constant. For example, differences between voltages of the grades may be constant.

The feedback controller 1400 may provide hot heat grill feedback by adjusting a forward voltage and a reverse voltage to reach a neutral proportion or lower or provide cold heat grill feedback by adjusting the forward voltage and the reverse voltage to reach a proportion higher than the neutral proportion.

For example, referring again to FIG. 26, in the case in which the neutral proportion is set as 3, when the forward voltage of the first grade is applied to the first thermoelectric pair group 1250-1 and the reverse voltage of the first grade or the second grade is applied to the second thermoelectric pair group 1250-2, because warmth and pain are generated in a lower proportion than the neutral proportion in the thermoelectric module 1000, the feedback controller 1400 may provide the hot heat grill feedback in which warmth and pain are simultaneously felt to the user. Here, the forward voltage is not necessarily a forward voltage used in the neutral thermal grill feedback. In other words, the feedback controller 1400 may also use the forward voltage of the fourth grade and the reverse voltage of the fourth grade to allow the thermoelectric module 1000 to provide the hot heat grill feedback.

In the case of the cold heat grill feedback, in the case in which the neutral proportion is set as 3, the feedback controller 1400 may apply the forward voltage of the first grade and the reverse voltage of the fourth grade or the forward voltage of the first grade and the reverse voltage of the fifth grade to the thermoelectric module 1000.

However, in a case in which the hot heat grill feedback or the cold heat grill feedback is attempted to be provided, because a problem in that the user does not feel pain occurs when the forward voltage and the reverse voltage are applied with a proportion significantly deviating from the neutral proportion, it may be preferable that a grade of the forward voltage/reverse voltage is adjusted to reach a proportion close to the neutral proportion.

1.3.2. Liquid Provider

Figure 27:
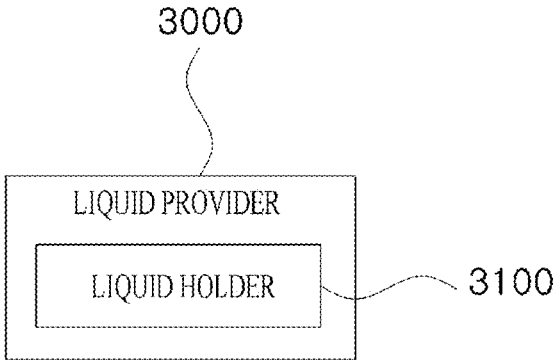
FIG. 27 is a view for describing a liquid provider according to an embodiment of the present disclosure.

FIG. 27 is a view for describing a liquid provider according to an embodiment of the present disclosure.

Referring to FIG. 27, the liquid provider 3000 may refer to a configuration that provides a liquid to the heat radiator 2000, which will be described below, so that waste heat is dissipated in the form of latent heat from the heat radiator 2000. Here, the liquid may include any liquid such as water, alcohol, and methanol capable of absorbing the waste heat and being evaporated by the waste heat. The liquid may be evaporated when the amount of absorbed waste heat reaches unique vaporization heat of the liquid. That is, when the liquid is being evaporated, waste heat corresponding to the unique vaporization heat may be dissipated from the heat radiator 2000 to the outside of the feedback device 100.

The liquid provider 3000 may include a liquid holder 3100, and the liquid holder 3100 may hold a predetermined amount of liquid to provide a liquid to the heat radiator 2000. A maximum amount of liquid that the liquid holder 3100 may hold may be determined according to performance of the liquid holder 3100.

In an embodiment of the present disclosure, the liquid holder 3100 may include a liquid holding material, which is a material capable of holding a predetermined amount of liquid for a predetermined amount time. For example, the liquid holder 3100 may include SAP, which is a type of hydrogel. The SAP may indicate a polymer that absorbs a liquid following an introduction of a hydrophilic group to a three-dimensional network structure or a single structure through crosslinking between polymer chains. That is, the SAP may be a polymer having a large amount of hydrophilic groups and having a three-dimensional network structure or a single structure. The polymer may simultaneously have water insolubility and hydrophilicity.

Examples of the performance of the liquid provider 3000 include liquid absorption performance and liquid holding performance. The liquid absorption performance indicates a liquid absorption amount per unit mass of the liquid provider 3000. For example, the SAP may absorb a liquid having a mass that is several tens to several hundreds times the mass of the SAP. The liquid holding performance indicates an extent to which the liquid provider 3000 holds a liquid instead of dissipating the liquid to the outside when a predetermined pressure is applied from the outside. When the liquid provider 3000 is the SAP, the liquid absorption performance and the liquid holding performance may be determined according to a crosslink density of the SAP. This is because the extent of crosslinking between polymer chains of the SAP is determined according to the crosslink density. That is, properties of the SAP are determined according to the crosslink density, and this will be described in more detail with reference to FIGS. 36 to 39. In addition, the liquid holder 3100 may include another material having a liquid holding ability and a liquid releasing ability.

In an embodiment, the liquid provider 3000 may be physically separated from the feedback device 100. As an example, the liquid provider 3000 may absorb a liquid in a state in which the liquid provider 3000 is separated from the feedback device 100. The liquid provider 3000 may also be replaced with another liquid provider.

1.3.3. Heat Radiator

Figure 28:
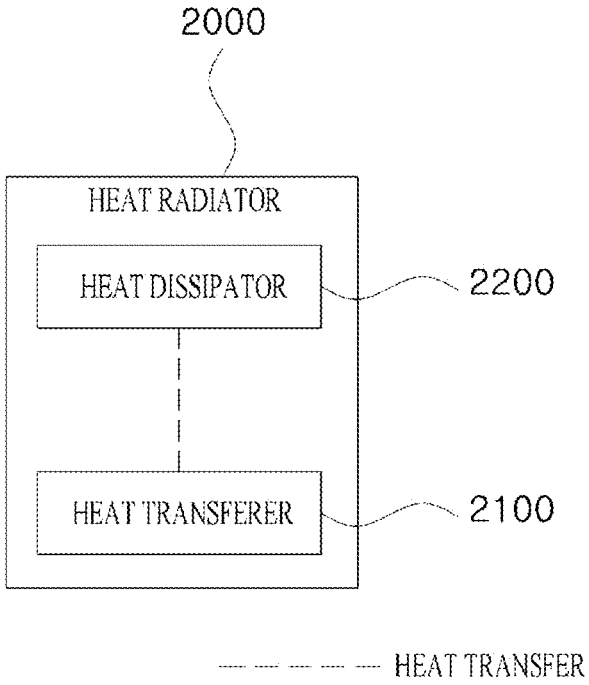
FIG. 28 is a view for describing a heat radiator according to an embodiment of the present disclosure.

FIG. 28 is a view for describing a heat radiator according to an embodiment of the present disclosure.

Referring to FIG. 28, the heat radiator 2000 may dissipate waste heat generated in the thermoelectric module 1000 to the outside of the feedback device 100. As described above, the waste heat may refer to residual heat that remains after heat generated in the feedback device 100 is used to provide a thermal experience to the user. For example, residual heat that remains in the feedback device 100 after thermal feedback is output from the thermoelectric module 1000 may be included in the waste heat. When the amount of the waste heat is small, the waste heat does not affect the user. However, when the amount of the waste heat is a predetermined level or higher, components of the feedback device 100 may be degraded, and unnecessary hot sensation may be transferred to the user due to the waste heat and cause degradation of the thermal experience of the user. To solve the problems due to the waste heat, the heat radiator 2000 may dissipate the waste heat to the outside of the feedback device 100.

In an embodiment of the present disclosure, the heat radiator 2000 may include a heat transferer 2100 and a heat dissipator 2200. The heat transferer 2100 may be configured to receive waste heat from the thermoelectric module 1000 and transfer the waste heat to the 2200, and the heat dissipator 2200 may dissipate the waste heat to the outside of the feedback device 100.

In an embodiment of the present disclosure, the heat transferer 2100 and the heat dissipator 2200 may be implemented in various forms. In an embodiment, the heat transferer 2100 and the heat dissipator 2200 may be physically connected. For example, the heat transferer 2100 and the heat dissipator 2200 may directly come into contact, and the waste heat may be directly transferred from the heat transferer 2100 to the heat dissipator. As another example, the heat transferer 2100 and the heat dissipator 2200 may be connected through a physical medium. In this case, the waste heat may be transferred from the heat transferer 2100 to the heat dissipator 2200 via the medium. For example, the physical medium may be the liquid provider 3000. In this case, even when the heat transferer 2100 and the heat dissipator 2200 are not connected, the waste heat may be transferred from the heat transferer 2100 to the heat dissipator 2200 through the liquid provider 3000.

In another embodiment, the heat transferer 2100 and the heat dissipator 2200 may not be physically connected. In this case, the waste heat may be indirectly transferred from the heat transferer 2100 to the heat dissipator. For example, the waste heat may be transferred from the heat transferer 2100 through air.

In still another embodiment, the heat transferer 2100 and the heat dissipator 2200 may be integrally implemented. That is, the integrated type heat radiator 2000 may transfer the waste heat and dissipate the waste head.

In yet another embodiment, the heat radiator 2000 may include only the heat dissipator 2200. In this case, the heat dissipator 2200 may acquire waste heat from the outside and then immediately dissipate the waste heat to the outside.

In this way, the heat transferer 2100 and the heat dissipator 2200 may be implemented in various embodiments, and although not mentioned, a configuration that transfers waste heat and/or dissipates the waste heat may be implemented as the heat radiator 2000.

In an embodiment, the heat radiator 2000 may be physically separated from the feedback device 100. For example, the heat radiator 2000 may be separated from the feedback device 100 and be replaced with another heat radiator.

2. Waste Heat Dissipation in Feedback Device

Hereinafter, waste heat dissipation of the feedback device 100 according to an embodiment of the present disclosure will be described.

2.1. Outline

Figure 53:
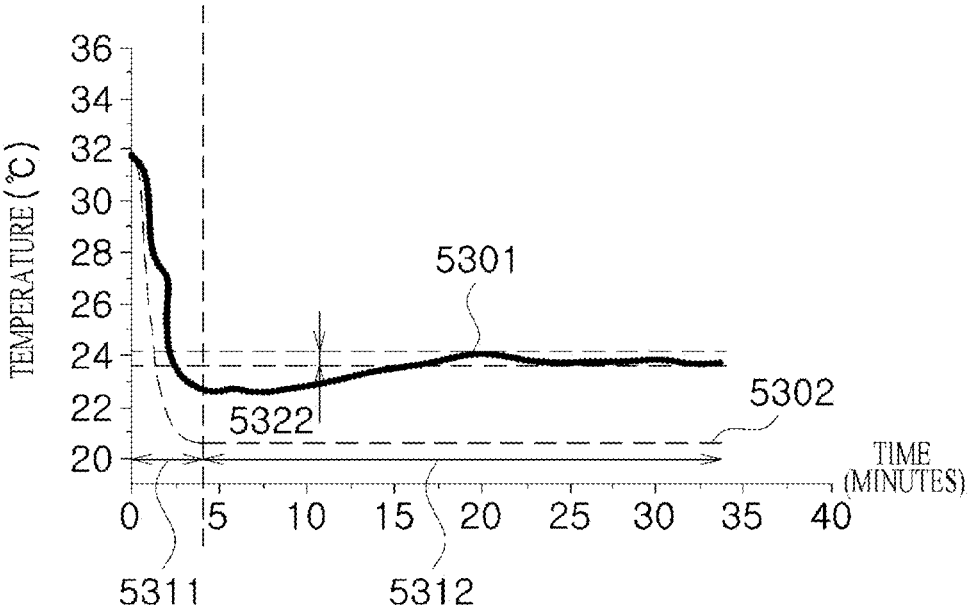
FIG. 53 is a view illustrating a graph related to a temperature of heat provided to a user from the feedback device according to an embodiment of the present disclosure.

As described above, when the thermoelectric module 1000 of the feedback device 100 performs a thermoelectric operation, waste heat may be generated. The waste heat may directly or indirectly affect a thermal experience of the user. As a specific example, FIG. 53 illustrates a graph related to a temperature of heat provided to a user from the feedback device 100 according to an embodiment of the present disclosure. For example, in the graph of FIG. 53, the x-axis indicates time, the y-axis indicates temperature, and a line 5301 indicates temperature of the contact surface 1600 of the thermoelectric module 1000 with time.

In an embodiment of the present invention, the feedback device 100 may be operated as a cooling device that transfers cold sensation to the user. In this case, the thermoelectric pair array 1240 of the thermoelectric module 1000 may perform the endothermic operation and transfer cold heat to the contact surface 1600. As the cold heat is transferred to the contact surface 1600, the temperature of the contact surface 1600 may drop. Here, when waste heat is not generated, the temperature of the contact surface 1600 may be formed along a line 5302, reach a minimum temperature in a section 5311, and then maintain the minimum temperature in a section 5312. However, as the thermoelectric pair array 1240 performs the endothermic operation, waste heat may be accumulated in the thermoelectric module 1000, and due to an influence of the waste heat, the temperature of the contact surface may reach a minimum temperature and then rise, and be maintained within a predetermined temperature section 5322. Accordingly, the minimum temperature of the contact surface 1260 in the case in which the waste heat is taken into consideration may be higher than that in the case in which the waste heat is not taken into consideration. When the waste heat is taken in to consideration, due to the waste heat, the temperature of the contact surface 1600 in the section 5312 may be higher than the minimum temperature in the section 5311.

A difference between the temperature of the contact surface 1600 in the case in which the waste heat is taken into consideration and the temperature of the contact surface 1600 in the case in which the waste heat is not taken into consideration may vary according to how well the waste heat is dissipated from the feedback device 100. For example, the temperature difference may be decreased when the waste heat is dissipated well from the feedback device 100, and conversely, the temperature difference may be increased when the waste heat is not dissipated well from the feedback device 100. Consequently, the ability of dissipating waste heat is an important factor in performance of the feedback device 100. Hereinafter, a configuration of the feedback device 100 for improving the waste heat dissipation performance will be described in detail.

2.2. Waste Heat Dissipation Performance According to Waste Heat Transfer Path 2.2.1. Outline A waste heat transfer path may be defined as a path from a spot at which waste heat is generated to a spot at which the waste heat is dissipated. In the feedback device 100 according to an embodiment of the present disclosure, the waste heat transfer path may refer to a path from the thermoelectric module 1000 in which waste heat is generated to the heat radiator 2000 through which the waste heat is dissipated. In this case, other elements such as the liquid provider 3000 may also be included in the waste heat transfer path according to a structure of the feedback device 100.

In an embodiment of the present disclosure, the waste heat dissipation performance may be improved as the waste heat transfer path is shorter. This is because, under the assumption that all other conditions such as structures and materials of elements of a first feedback device and a second feedback device are the same, a longer waste heat transfer path may signify that the amount of time at which waste heat stays in the feedback device 100 is increased, and a shorter waste heat transfer path may signify that the amount of time at which waste heat stays in the feedback device 100 is decreased. Consequently, waste heat dissipation performance may vary according to a waste heat dissipation structure, and hereinafter, waste heat dissipation performance according to a waste heat transfer path will be described in detail.

2.2.2. Waste Heat Dissipation Path According to Various Embodiments 2.2.2.1. First Embodiment FIG. 29 is a view illustrating a structure of the feedback device according to an embodiment of the present disclosure.

Figure 29:
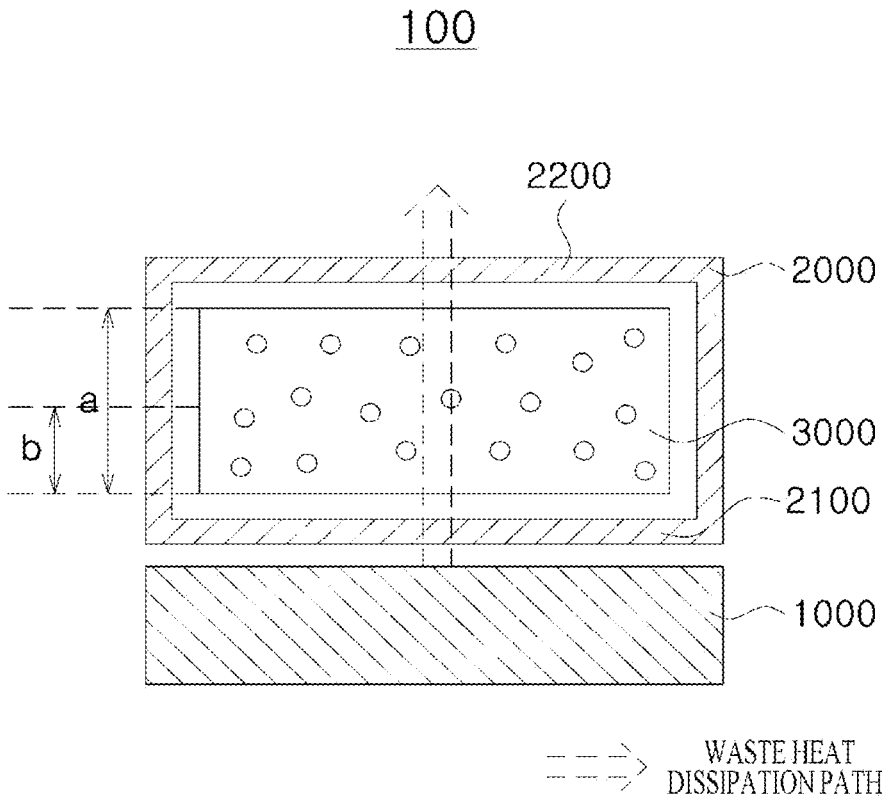
FIG. 29 is a view illustrating a structure of the feedback device according to an embodiment of the present disclosure.

Referring to FIG. 29, FIG. 29 illustrates a cross-sectional view of the feedback device 100 according to a first embodiment. In the feedback device 100, the thermoelectric module 1000 and the heat radiator 2000 may be stacked in that order, and the liquid provider 3000 may be disposed inside the heat radiator 2000. Here, a lower surface of the thermoelectric module 1000 may directly or indirectly come into contact with a user to provide thermal feedback to the user. For example, in a case in which the feedback device is a wrist band type wearable device as illustrated in FIG. 3, when the wearable device is worn by the user, the thermoelectric module 1000 may be located at a portion coming into contact with the user, and the heat radiator 2000 may be located at a portion not coming into contact with the user. A portion of the heat radiator 2000 to which the waste heat is transferred may be the heat transferer 2100 (for example, a lower surface and a side surface of the heat radiator 2000), and a portion at which the waste heat is evaporated in the form of latent heat may be the heat dissipator 2200 (for example, an upper surface of the heat radiator 2000).

In an exemplary embodiment of the present disclosure, to prevent transfer of a liquid from the liquid provider 3000 to the thermoelectric module 1000, a liquid blocking material (for example, a waterproof membrane, a waterproof film) may be disposed between the liquid provider 3000 and the thermoelectric module 1000.

In the first embodiment, when the thermoelectric module 1000 performs the endothermic operation, cold heat may be transferred to the lower surface of the thermoelectric module 1000, hot heat may be may be transferred to an upper surface of the thermoelectric module 1000, and the hot heat may be waste heat that degrades a thermal experience of the user. In this case, the waste heat may be transferred from the thermoelectric module 1000 to the heat dissipator 2200 through the heat transferer 2100 and the liquid provider 3000, and the waste heat may be dissipated from the heat dissipator 2200. That is, the waste heat transfer path may be formed with the thermoelectric module 1000, the heat transferer 2100, the liquid provider 3000, and the heat dissipator 2200. Here, the liquid provider 3000 may provide a liquid contained in the liquid provider 3000 to the heat dissipator 2200, and in the heat dissipator 2200, the liquid received from the liquid provider 3000 may be evaporated due to the waste heat. Due to the evaporation of the liquid, the waste heat may be dissipated to the outside of the feedback device 100.

In an embodiment of the present disclosure, depending on its material, the heat dissipator 2200 may have liquid transfer directionality in a specific direction. For example the heat dissipator 2200 may have liquid transfer directionality in a vertical direction or may have liquid transfer directionality in a horizontal direction. In the first embodiment, a liquid may be transferred from a lower end of the heat dissipator 2200 to the heat dissipator 2200. Accordingly, in the first embodiment, the heat dissipator 2200 having the liquid transfer directionality in the vertical direction may be beneficial in terms of improving the waste heat dissipation performance.

In an embodiment of the present disclosure, depending on its material, the heat dissipator 2200 may have evaporation directionality in a specific direction. For example, the heat dissipator 2200 may have evaporation directionality in an upper direction or may have evaporation directionality in a side direction. In the first embodiment, evaporation of a liquid may occur from an upper end of the heat dissipator 2200 toward the air. Accordingly, in the first embodiment, the heat dissipator 2200 having the evaporation directionality in the upper direction may be beneficial in terms of improving the waste heat dissipation performance.

In the structure according to the first embodiment, the length of the waste heat transfer path may vary depending on the thickness of the liquid provider 3000. For example, in an example shown in FIG. 29, a waste heat transfer path in a case in which the thickness of the liquid provider 3000 is a may be shorter than that in a case in which the thickness of the liquid provider 3000 is b. As the waste heat transfer path is shortened, the amount of time during which the waste heat stays in the liquid provider 3000 may be shortened, and due to this, the waste heat dissipation performance of the feedback device 100 may be improved.

In an embodiment, when the thickness of the liquid provider 3000 becomes smaller, the amount of a liquid contained in the liquid provider 3000 may be reduced. When the liquid provider 3000 runs out of liquid, the liquid provider 3000 has to be supplemented with a liquid. As the thickness of the liquid provider 3000 becomes smaller, a time taken for the liquid provider 3000 to run out of liquid may also be shortened. That is, the waste heat dissipation performance of the feedback device 100 and the liquid holding performance of the liquid provider 3000 may be traded off for each other according to the thickness of the liquid provider 3000.

2.2.2.2. Second Embodiment

Figure 30:
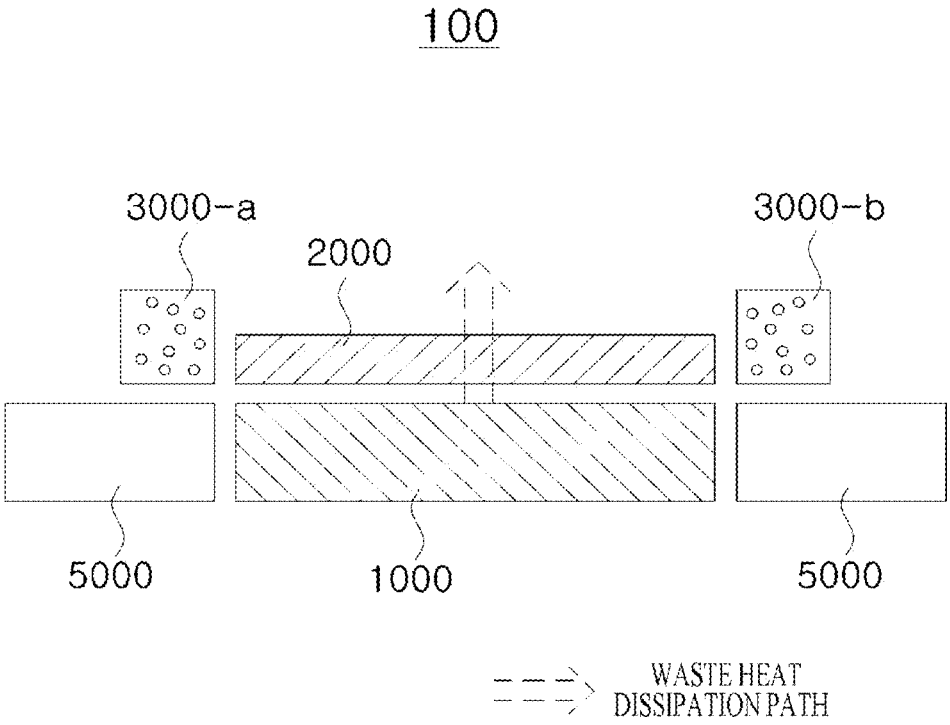
FIG. 30 is a view illustrating a structure of the feedback device according to another embodiment of the present disclosure.

FIG. 30 is a view illustrating a structure of the feedback device according to another embodiment of the present disclosure.

Referring to FIG. 30, FIG. 30 illustrates a cross-sectional view of the feedback device 100 according to a second embodiment. In the second embodiment, the thermoelectric module 1000 and the heat radiator 2000 may be stacked in that order in the feedback device 100, and unlike the first embodiment, liquid providers 3000-*a* and 3000-*b* may be disposed at both side surfaces of the heat radiator 2000. A supporter 5000 may be disposed at a side surface of the thermoelectric module 1000, and the liquid providers 3000-*a* and 3000-*b* may be disposed at an upper end of the supporter 5000. Here, the supporter 5000 may be configured to support at least one of the thermoelectric module 1000, the heat radiator 2000, and the liquid providers 3000-*a* and 3000-*b*. In an exemplary embodiment of the present disclosure, the supporter 5000 may block heat generated from the thermoelectric module 1000 instead of transferring the heat to the user. The supporter 5000 may block a liquid released from the liquid providers 3000-*a* and 3000-*b* instead of transferring the liquid to the user. The supporter 5000 may be disposed to come into contact with the user.

Although the case in which the heat transferer 2100 and the heat dissipator 2200 are integrally formed with the heat radiator 2000 is illustrated in FIG. 30, the embodiment is not limited thereto, and the heat transferer 2100 and the heat dissipator 2200 may also be separately formed in the heat radiator 2000. Although the case in which heights of the liquid providers 3000-*a* and 3000-*b* are higher than a height of the heat radiator 2000 is illustrated in FIG. 30, the embodiment is not limited thereto, and the heights of the liquid providers 3000-*a* and 3000-*b* may be lower than or equal to the height of the heat radiator 2000.

In the second embodiment, because the liquid providers 3000-*a* and 3000-*b* do not come into contact with an upper portion of the thermoelectric module 1000, the liquid providers 3000-*a* and 3000-*b* may not receive waste heat from the thermoelectric module 1000. Accordingly, waste heat may be directly transferred from the thermoelectric module 1000 to the heat radiator 2000, and the waste heat transfer path may be formed with the thermoelectric module 1000 and the heat radiator 2000. Accordingly, the waste heat transfer path may be shortened in comparison to when the liquid providers 3000-*a* and 3000-*b* are included in the waste heat transfer path, and due to this, the waste heat dissipation performance may be improved.

In the second embodiment, because the liquid providers 3000-*a* and 3000-*b* are disposed at the side surfaces of the heat radiator 2000, the heat radiator 2000 may receive a liquid from the liquid providers 3000-*a* and 3000-*b* through the side surfaces. Here, because the heat radiator 2000 receives waste heat from the thermoelectric module 1000 through an entire region of the heat radiator 2000, waste heat needs to be dissipated through the entire region of the heat radiator 2000. Consequently, because a liquid may be transferred to a central portion of the heat radiator when the heat radiator 2000 has the liquid transfer directionality in the horizontal direction, in the second embodiment, the heat radiator 2000 having the liquid transfer directionality in the horizontal direction may be beneficial in terms of improving the waste heat dissipation performance.

However, according to the embodiment, because the liquid providers 3000-*a* and 3000-*b* are disposed at the side surfaces of the heat radiator 2000, a larger amount of liquid may be transferred to an outer region of the heat radiator 2000 than to the central region thereof. In this case, during the same amount of time, the amount of waste heat dissipated from the outer region that contains a larger amount of liquid may be larger than the amount of waste heat dissipated from the central region. When the heat radiator 2000 has high liquid transfer directionality in the horizontal direction or a liquid is transferred from the liquid providers 3000-*a* and 3000-*b* to the heat radiator 2000 for a long time such that the liquid content in the central region of the heat radiator 2000 and the liquid content in the outer region of the heat radiator 2000 are similar, the amount of waste heat dissipated from the outer region and the amount of waste heat dissipated from the central region may also be similar.

2.2.2.3. Third Embodiment

Figure 31:
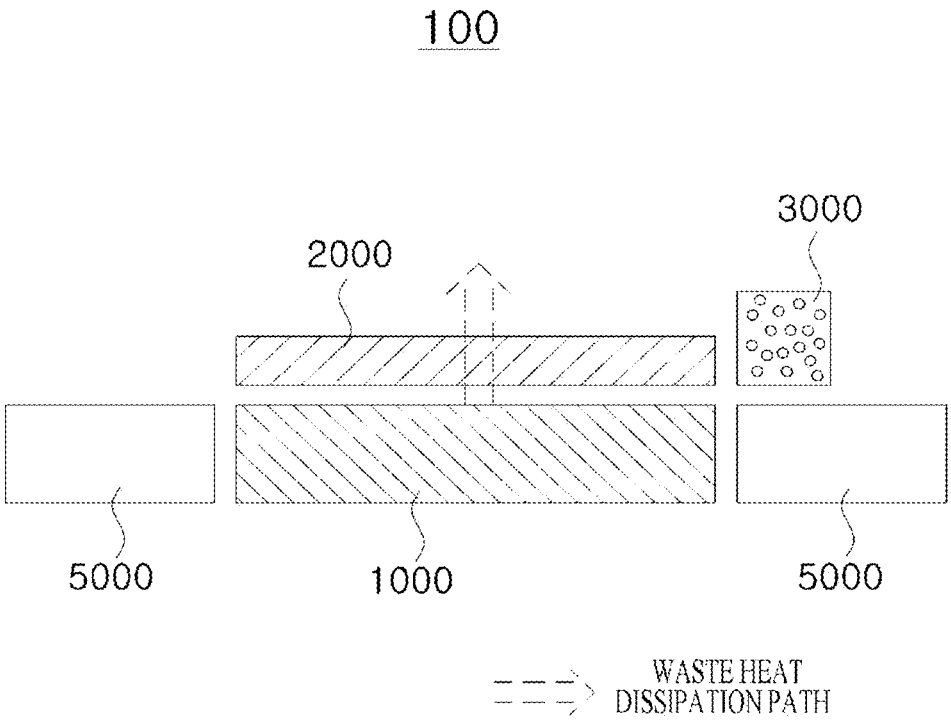
FIG. 31 is a view illustrating a structure of the feedback device according to still another embodiment of the present disclosure.

FIG. 31 is a view illustrating a structure of the feedback device according to still another embodiment of the present disclosure.

Referring to FIG. 31, FIG. 31 illustrates a cross-sectional view of the feedback device 100 according to a third embodiment. In the third embodiment, the thermoelectric module 1000 and the heat radiator 2000 may be stacked in that order in the feedback device 100, the supporter 5000 may be disposed at the side surface of the thermoelectric module 1000, and the liquid provider 3000 may be disposed at an upper end of the supporter 5000 and a side surface of the heat radiator 2000. However, unlike the second embodiment, the liquid provider 3000 may be disposed only at one side surface of the heat radiator 2000.

In the third embodiment, like the second embodiment, the liquid provider 3000 does not come into contact with the upper portion of the thermoelectric module 1000 and thus may not receive waste heat from the thermoelectric module 1000. Accordingly, the waste heat transfer path may be formed with the thermoelectric module 1000 and the heat radiator 2000, the waste heat transfer path may be shortened in comparison to when the liquid provider 3000 is included in the waste heat transfer path, and due to this, the waste heat dissipation performance may be improved.

In the third embodiment, because the liquid provider 3000 is disposed at only one side surface of the heat radiator 2000, a liquid may be transferred from the one side surface to the other side surface of the heat radiator 2000. However, because the heat radiator 2000 receives waste heat from the thermoelectric module 1000 through an entire region thereof, waste heat needs to be dissipated through the entire region thereof. Consequently, for the waste heat to be effectively dissipated through the other side surface instead of the one side surface coming into contact with the liquid provider 3000, the heat radiator 2000 may have to have the liquid transfer directionality in the horizontal direction.

According to the embodiment, because the liquid provider 3000 is disposed at only one side surface of the heat radiator 2000, a larger amount of liquid may be transferred to the one side surface of the heat radiator 2000 in comparison to the other side surface thereof. In this case, during the same amount of time, the amount of waste heat dissipated from the one side surface may be larger than the amount of waste heat dissipated from the other side surface. When the heat radiator 2000 has high liquid transfer directionality in the horizontal direction or a liquid is transferred from the liquid provider 3000 to the heat radiator 2000 for a long time such that the liquid content in the one side surface of the heat radiator 2000 and the liquid content in the other side surface of the heat radiator 2000 are similar, the amount of waste heat dissipated from the one side surface and the amount of waste heat dissipated from the other side surface may also be similar.

2.2.2.4. Fourth Embodiment

Figure 32:
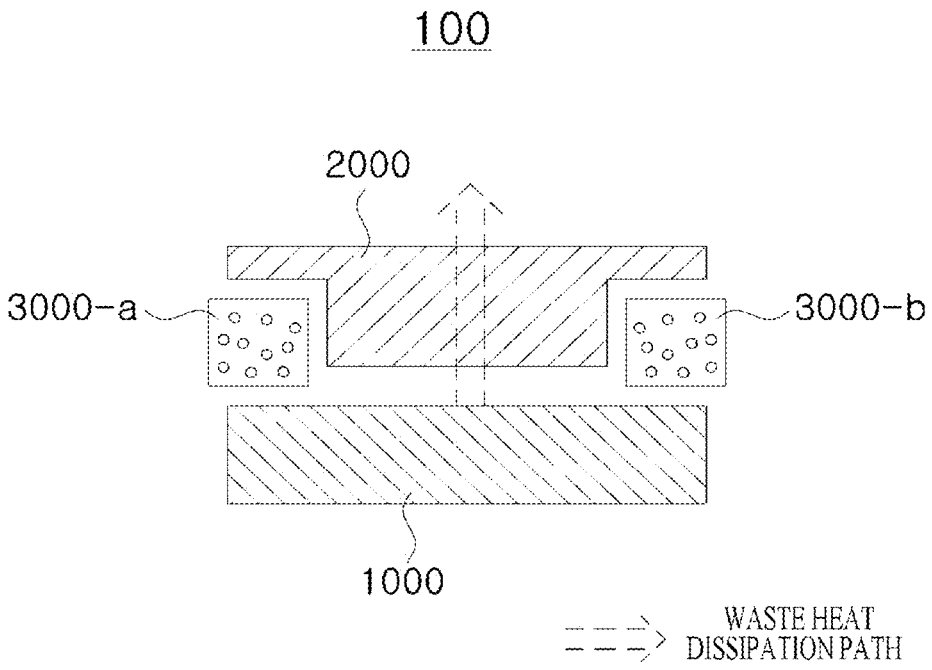
FIG. 32 is a view illustrating a structure of the feedback device according to yet another embodiment of the present disclosure.

FIG. 32 is a view illustrating a structure of the feedback device according to yet another embodiment of the present disclosure;

Referring to FIG. 32, FIG. 32 illustrates a cross-sectional view of the feedback device 100 according to a fourth embodiment. In the fourth embodiment, the thermoelectric module 1000, the liquid providers 3000-*a* and 3000-*b*/the heat radiator 2000 may be disposed in that order in the feedback device 100, and particularly, the liquid providers 3000-*a* and 3000-*b* may be disposed at portions of side surfaces and portions of a lower surface of the heat radiator 2000.

Unlike the previous embodiments, in the fourth embodiment, the waste heat transfer path may include two paths. For example, a first waste heat transfer path may be formed with the thermoelectric module 1000, the liquid providers 3000-*a* and 3000-*b*, and the heat radiator 2000, and a second waste heat transfer path may be formed with the thermoelectric module 1000 and the heat radiator 2000. In the second waste heat transfer path, some of the waste heat may be transferred to the heat radiator 2000 through the liquid providers 3000-*a* and 3000-*b*. Accordingly, unlike the second and third embodiments, the length of the second waste heat transfer path may vary depending on thicknesses of the liquid providers 3000-*a* and 3000-*b*. However, because the liquid providers 3000-*a* and 3000-*b* are disposed inside the heat radiator 2000, the amount of liquid transferred to the heat radiator 2000 may be increased in comparison to when the liquid providers 3000-*a* and 3000-*b* are disposed at the side surfaces, and accordingly, the waste heat dissipation performance may be improved. The heat radiator 2000 may receive a liquid from the liquid providers 3000-*a* and 3000-*b* through the lower end thereof as well as the side surfaces thereof. Consequently, when the heat radiator 2000 simultaneously has the liquid transfer directionality in the horizontal direction and the liquid transfer directionality in the vertical direction, the waste heat dissipation performance may be further improved.

2.2.2.5 Fifth Embodiment

Figure 33:
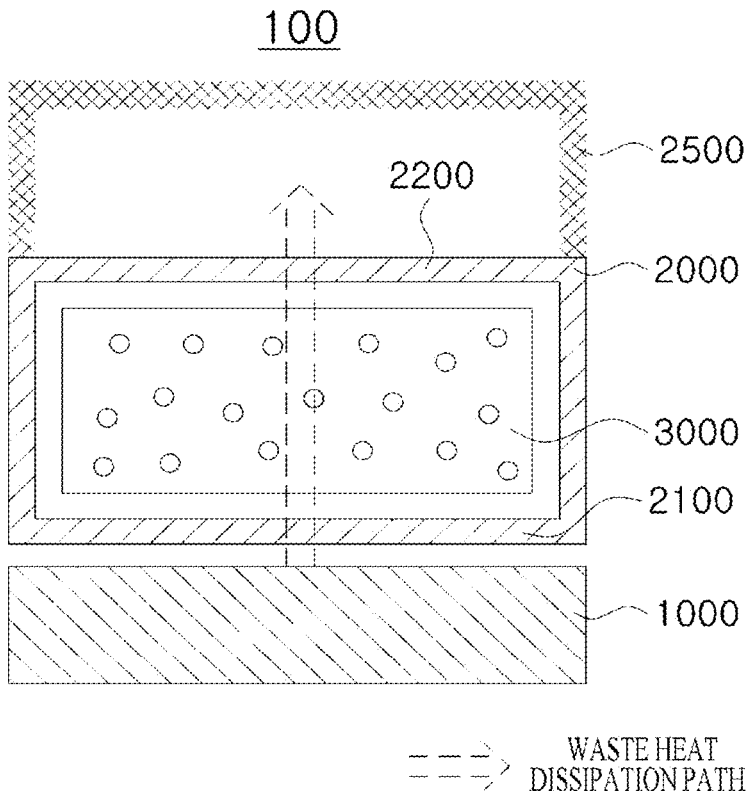
FIG. 33 is a view illustrating a structure of the feedback device according to yet another embodiment of the present disclosure.

FIG. 33 is a view illustrating a structure of the feedback device according to yet another embodiment of the present disclosure.

Referring to FIG. 33, FIG. 33 illustrates a cross-sectional view of the feedback device 100 according to a fifth embodiment. In the fifth embodiment, as the first embodiment illustrated in FIG. 29, the thermoelectric module 1000 and the heat radiator 2000 may be stacked in that order in the feedback device 100, and the liquid provider 3000 may be disposed inside the heat radiator 2000.

Here, in the fifth embodiment, a protector 2500 may be disposed on the heat radiator 2000. Here, the protector 2500 may be configured to protect the feedback device 100 from the outside.

In an embodiment of the present disclosure, the protector 2500 may be disposed in the form of surrounding the heat radiator 2000, and a predetermined space may be disposed between the protector 2500 and the heat radiator 2000. The protector 2500 may be formed of various materials. For example, the protector 2500 may be formed of a material that does not absorb a liquid, such as plastic net and silicone.

Specifically, the heat radiator 2000 may become wet due to a liquid provided from the liquid provider 3000, and when, in this situation, a user's hand touches the heat radiator 2000, the user's hand may become wet due to the liquid. However, when the protector 2500 is disposed in the feedback device 100, the user's hand may not touch the heat radiator 2000 due to the protector 2500. Thus, convenience of the user may be improved.

Because the predetermined space is disposed inside the protector 2500, the waste heat dissipation path in the fifth embodiment may be formed with the thermoelectric module 1000, the heat transferer 2100, the liquid provider 3000, and the heat dissipator 2200 as in the first embodiment, and the waste heat dissipation performance in the first embodiment may also be maintained in the fifth embodiment.

Although the structure which is the same as the first embodiment, except that the protector 2500 is applied, is illustrated in FIG. 33, the embodiment is not limited thereto, and the protector 2500 of the fifth embodiment may also be applied to any of the above-described second embodiment to fourth embodiment.

2.2.2.6 Sixth Embodiment

Figure 34:
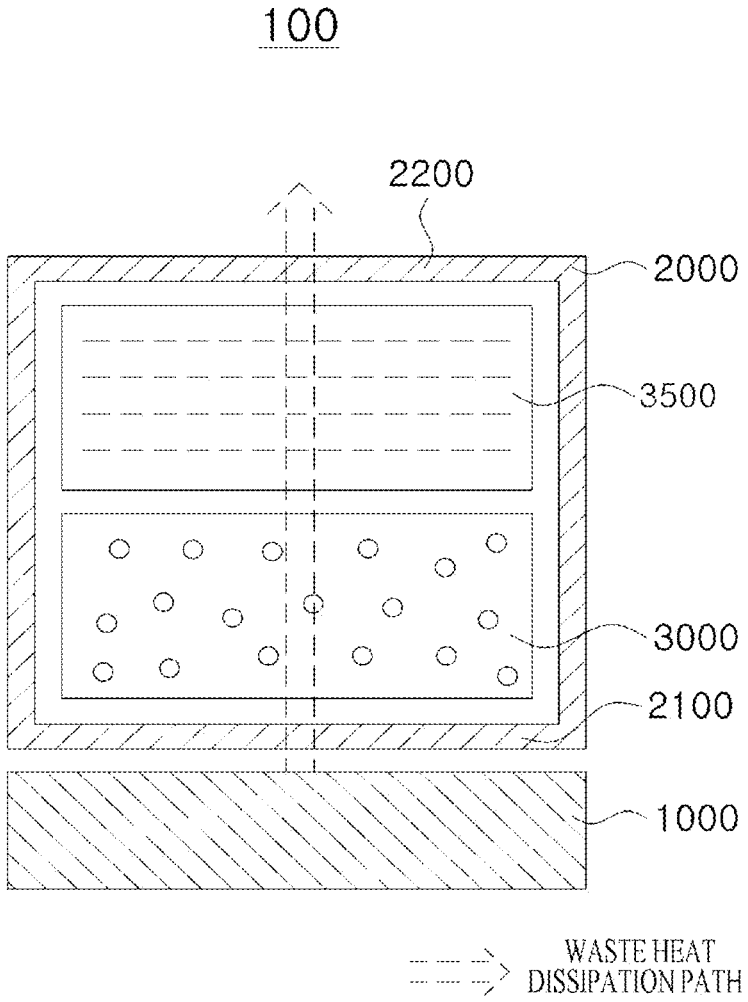
FIG. 34 is a view illustrating a structure of the feedback device according to yet another embodiment of the present disclosure.

FIG. 34 is a view illustrating a structure of the feedback device according to yet another embodiment of the present disclosure.

Referring to FIG. 34, FIG. 34 illustrates a cross-sectional view of the feedback device 100 according to a sixth embodiment. In the sixth embodiment, as the first embodiment illustrated in FIG. 29, the thermoelectric module 1000 and the heat radiator 2000 may be stacked in that order in the feedback device 100, and the liquid provider 3000 may be disposed inside the heat radiator 2000.

Here, unlike the first embodiment, a second liquid provider 3500 may be included inside the heat radiator 200. The second liquid provider 3500 may be configured to provide a liquid to the liquid provider 3000 in addition to the heat radiator 2000. For this, the second liquid provider 3500 may be formed of a material having an improved liquid absorbing ability than the liquid provider 3000. For example, the second liquid provider 3500 may be formed of a material having high liquid absorption performance such as sponge or may be formed of a SAP. Here, when both the second liquid provider 3500 and the liquid provider 3000 are formed of the SAPs, a liquid absorbing ability of the SAP constituting the second liquid provider 3500 may be higher than a liquid absorbing ability of the SAP constituting the liquid provider 3000.

In an embodiment, the liquid provider 3000 may receive a liquid from the outside and absorb the received liquid. Depending on liquid absorption performance of the liquid provider 3000, a somewhat long time may be taken for the liquid provider 3000 to absorb the received liquid. In this case, the liquid provider 3000 may have to continuously receive a liquid from the outside until a predetermined amount of liquid is held herein, and in some embodiments, the feedback device 100 may not be usable while the liquid provider 3000 receives a liquid from the outside. Here, when the second liquid provider 3500 is included in the feedback device 100, because the liquid absorbing ability of the second liquid provider 3500 is higher than that of the liquid provider 3000, the second liquid provider 3500 may hold the predetermined amount of liquid within a shorter amount of time than the amount of time taken for the liquid provider 3000 to hold the predetermined amount of liquid. Accordingly, the second liquid provider 3500 may provide the predetermined amount of liquid to the liquid provider 3000. That is, even when a liquid is not provided from the outside, the liquid provider 3000 may absorb a liquid from the second liquid provider 3500. In other words, when the second liquid provider 3500 is included in the feedback device 100, the amount of time taken for the liquid provider 3000 to receive a liquid from the outside may be reduced due to the liquid absorbing ability of the second liquid provider 3500, and because of this, the amount of time during which the feedback device 100 is usable may be increased.

Because the second liquid provider 3500 is included in the feedback device 100, the overall amount of liquid held in the feedback device 100 may be increased. Accordingly, the feedback device 100 may dissipate waste heat to the outside for a longer time in comparison to when the second liquid provider 3500 is not included in the feedback device 100.

Although the structure which is the same as the first embodiment, except that the second liquid provider 3500 is applied, is illustrated in FIG. 34, the embodiment is not limited thereto, and the second liquid provider 3500 of the sixth embodiment may also be applied to any of the above-described second embodiment to fifth embodiment.

Although examples of the waste heat dissipation path and the waste heat dissipation performance according to the waste heat transfer path are described herein using the first embodiment to the sixth embodiment, the spirit of the present disclosure is not limited thereto, and various other embodiments in which waste heat is transferred may also be applied to the spirit of the present disclosure.

2.3. Waste Heat Dissipation Performance According to Characteristics of Each Element of Feedback Device 2.3.1. Waste Heat Dissipation Performance According to Characteristics of Liquid Provider In an embodiment of the present disclosure, the liquid provider 3000 may provide a liquid to the heat radiator 2000, and the amount of liquid provided to the heat radiator 200 and the speed at which the liquid is provided may directly affect the waste heat dissipation performance of the feedback device 100. The amount of liquid provided to the heat radiator 200 by the liquid provider 3000 and the speed at which the liquid is provided may be determined according to characteristics of the liquid provider. Hereinafter, the waste heat dissipation performance of the feedback device 100 according to the characteristics of the liquid provider 3000 will be described in detail.

2.3.1.1. Waste Heat Dissipation Performance According to Liquid Content

Figure 35:
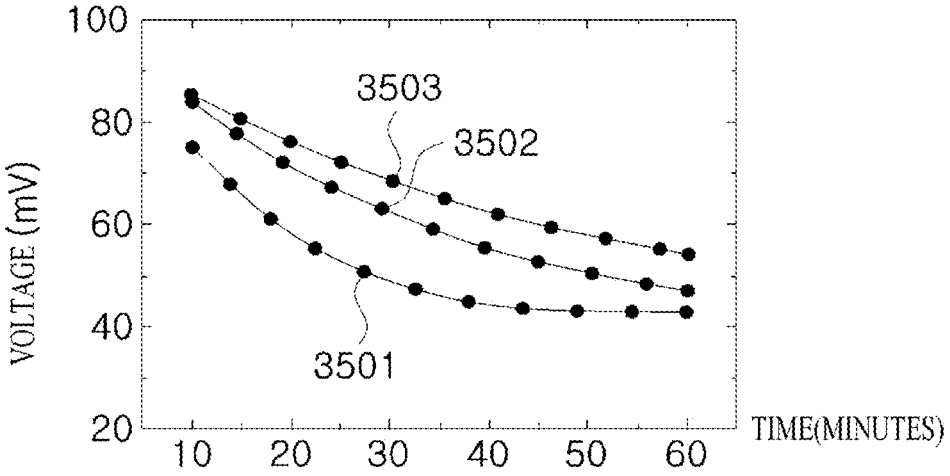
FIG. 35 is a view for describing waste heat dissipation performance according to liquid content in a liquid provider according to an embodiment of the present disclosure.

FIG. 35 is a view for describing waste heat dissipation performance according to liquid content in the liquid provider according to an embodiment of the present disclosure.

Referring to FIG. 35, a graph of FIG. 35 represents power generation efficiency depending on mass of a SAP. The liquid holder 3100 of the liquid provider 3000 may include a liquid holding material, and the amount of liquid that the liquid provider 3000 may hold may vary depending on mass of the liquid holding material. For example, when the liquid holder 3100 is a SAP, an overall amount of liquid contained in the liquid provider 3000 may vary depending on the mass of the SAP. The waste heat dissipation performance may also vary depending on the amount of liquid contained in the liquid provider 3000.

Specifically, in the graph of FIG. 35, the x-axis indicates time (minutes), and the y-axis indicates a voltage (mV) generated in the feedback device 100. In the graph of FIG. 35, a trend 3501 may indicate power generation efficiency of the feedback device 100 when the mass of the polymer resin is 0.1 g, a trend 3502 may indicate power generation efficiency of the feedback device 100 when the mass of the polymer resin is 0.5 g, and a trend 3503 may indicate power generation efficiency of the feedback device 100 when the mass of the polymer resin is 1.0 g. In the graph of FIG. 35, it may be confirmed that the power generation amount is higher in the trend 3503 than in the trend 3501. This may signify that the temperature difference in the thermoelectric module 1000 increases as the mass of the polymer resin is higher. The increase in the temperature difference in the thermoelectric module 1000 may indicate an improvement in the waste heat dissipation performance in the feedback device 100. Consequently, the graph of FIG. 35 may indicate that the waste heat dissipation performance is improved as the mass of the polymer resin is higher. Also, it is confirmed that the waste heat dissipation performance of the feedback device 100 may be enhanced as the liquid content in the liquid provider 3000 is higher.

2.3.1.2. Waste Heat Dissipation Performance According to Liquid Absorption Performance and Liquid Holding Performance FIG. 36 is a view for describing liquid absorption performance and liquid holding performance according to a crosslink density of the liquid provider according to an embodiment of the present disclosure.

Figure 36:
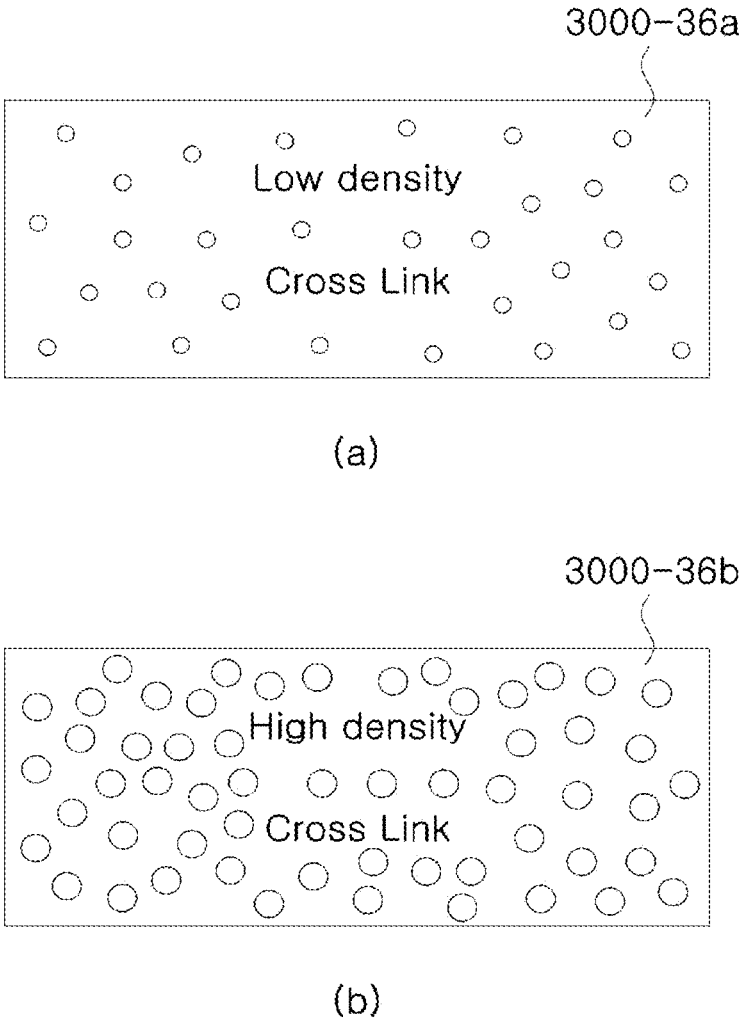
FIG. 36 is a view for describing liquid absorption performance and liquid holding performance according to a cross-link density of the liquid provider according to an embodiment of the present disclosure.

Referring to FIG. 36, (a) represents a liquid provider **3000-36*a* including a SAP having a low crosslink density, and (b) represents a liquid provider 3000-36*b* including a SAP having a high crosslink density. As described above, liquid absorption performance and liquid holding performance may be determined according to a crosslink density. Specifically, in the case of the liquid provider 3000-36***a*, due to having a low crosslink density, a crosslinking extent between polymer chains of the SAP may be low. Accordingly, because the amount of liquid that may be contained in the polymer chain increases, the liquid absorption performance of the liquid provider 3000-36*a* may be improved. Conversely, when a pressure is applied to the polymer chain, because a crosslinking extent of the polymer chains is low, the liquid contained in the polymer chain may be easily released, and because of this, the liquid holding performance of the liquid provider 3000-36*a* may be degraded.

Conversely, in the case of the liquid provider 3000-36*b*, due to having a high crosslink density, a crosslinking extent between polymer chains of the SAP may be high. Accordingly, because it is difficult for the polymer chain to hold a large amount of liquid, the liquid absorption performance of the liquid provider 3000-36*b* is degraded. Because the polymer chain becomes sturdier, a liquid contained in the polymer chain may not be easily released even when a pressure is applied to the polymer chain. Accordingly, the liquid holding performance of the liquid provider 3000-36*b* may be improved. To sum up, the liquid absorption performance and the liquid holding performance of the liquid provider 3000 may be traded off for each other according to a crosslink density.

Figure 37:
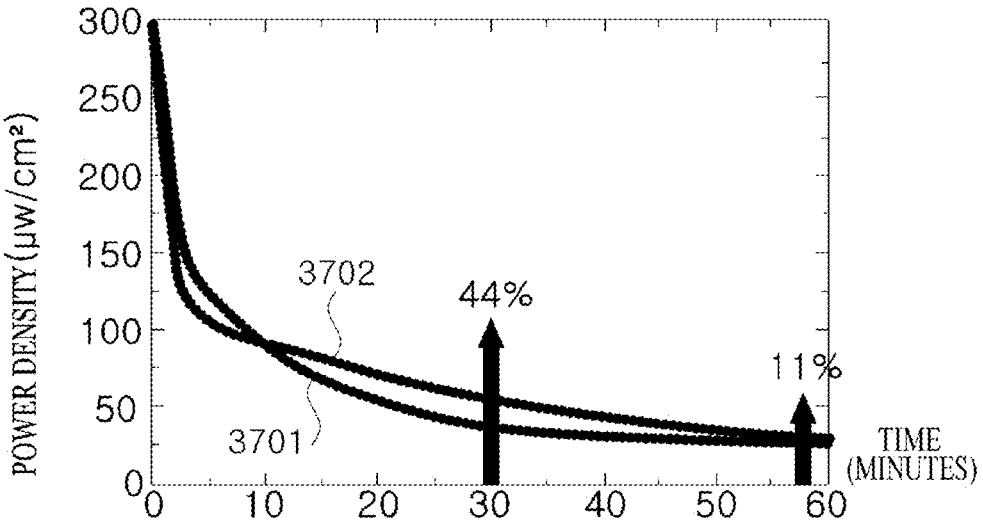
FIG. 37 is as view for describing waste heat dissipation performance according to the liquid absorption performance and the liquid holding performance according to an embodiment of the present disclosure.

FIG. 37 is a view for describing waste heat dissipation performance according to the liquid absorption performance and the liquid holding performance according to an embodiment of the present disclosure.

Referring to FIG. 37, (a) is a graph illustrating power generation efficiency according to a crosslink density, and (b) is a table showing values in the graph.

In the graph of (a), the x-axis indicates time (minutes), and the y-axis indicates a power density ($\mu W/cm^2$) indicating a power generation amount per unit area generated in the feedback device 100. In the graph of (a), a line 3701 indicates a power density of power output from the feedback device 100 when the liquid provider 3000 includes the SAP having a high crosslink density, and a line 3702 indicates a power density of power output from the feedback device 100 when the liquid provider 3000 includes the SAP having a low crosslink density. As shown in the graph of (a) and the table of (b), power generation efficiency of the feedback device 100 when the SAP has a low crosslink density may be higher than power generation efficiency of the feedback device 100 when the SAP has a high crosslink density. This may signify that the temperature difference in the thermoelectric module 1000 increases as the crosslink density is lower. The increase in the temperature difference in the thermoelectric module 1000 may indicate an improvement in the waste heat dissipation performance in the feedback device 100. That is, it may be confirmed that the waste heat dissipation performance of the feedback device 100 is improved as the crosslink density is lower. This is because, due to the liquid absorption performance being improved and the liquid holding performance being degraded as the crosslink density is lower, the amount of liquid transferred to the heat radiator 2000 is increased.

Figure 38:
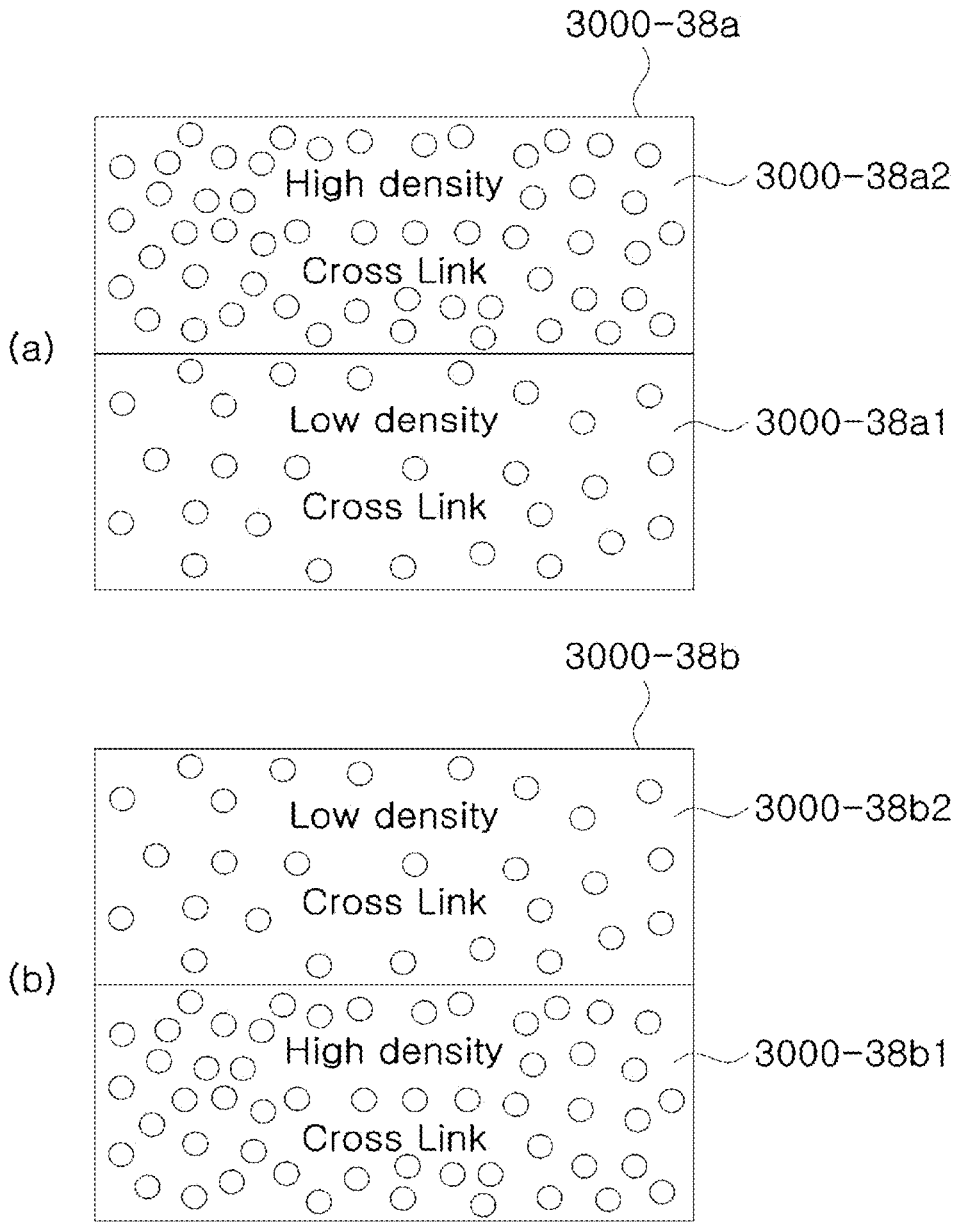
FIG. 38 is a view for describing liquid absorption performance and liquid holding performance according to a cross-link density of the liquid provider according to another embodiment of the present disclosure.

FIG. 38 is a view for describing liquid absorption performance and liquid holding performance according to a crosslink density of the liquid provider according to another embodiment of the present disclosure.

Referring to FIG. 38, in (a) and (b), a crosslink density of the liquid provider 3000 may be divided into two regions. In (a), a first region 3000-38*a*1 of a liquid provider 3000-38*a* may be formed of a polymer resin having a low crosslink density, and a second region 3000-38*a*2 thereof may be formed of a polymer resin having a high crosslink density. Accordingly, a lower region of the liquid provider 3000-38*a* may have high liquid absorption performance and low liquid holding performance, and an upper region thereof may have low liquid absorption performance and high liquid holding performance.

Conversely, in (b), a first region 3000-38*b*1 of a liquid provider 3000-38*b* may be formed of a polymer resin having a low crosslink density, and a second region 3000-38*b*2 thereof may be formed of a polymer resin having a high crosslink density. Accordingly, a lower region of the liquid provider 3000-38*b* may have low liquid absorption performance and high liquid holding performance, and an upper region thereof may have high liquid absorption performance and low liquid holding performance.

In (b), the second region 3000-38*b*2 of the liquid provider 3000-38*b* may serve as the second liquid provider 3500 described with reference to FIG. 34. This may be due to the second region 3000-38*b*2 having higher liquid absorption performance than that of the first region 3000-38*b*1. Accordingly, the first region 3800-38*b*1 may receive a liquid from the second region 3000-38*b*2 even when a liquid is not provided from the outside. Accordingly, because an amount of time taken for the liquid provider 3800-38*b* to receive a liquid from the outside is reduced, an amount of time during which the feedback device 100 is available may be increased.

In an embodiment of the present disclosure, when liquid absorption performance is high and liquid holding performance is low as in the regions 3000-38*a*1 and 3000-38*b*2, disposing the heat radiator 2000 to come into contact with the regions 3000-38*a*1 and 3000-38*b*2 may be beneficial in terms of liquid transfer.

When liquid absorption performance is low and liquid holding performance is high as in the regions 3000-38*a*2 and 3000-38*b*1, a liquid may not be easily released to the outside of the liquid providers 3000-38*a* and 3000-38*b*. Accordingly, when the regions 3000-38*a*2 and 3000-38*b*1 are disposed at regions that are easy to come into contact with a user, because a liquid is not transferred to the user, the user may not feel discomfort even when the user's body comes into contact with the regions 3000-38*a*2 and 3000-38*b*1.

Although the region of the liquid provider is divided into upper and lower regions according to crosslink densities in FIG. 38, embodiments are not limited thereto, and the region of the liquid provider may also be divided into left and right regions or may be divided into three or more regions.

Figure 39:
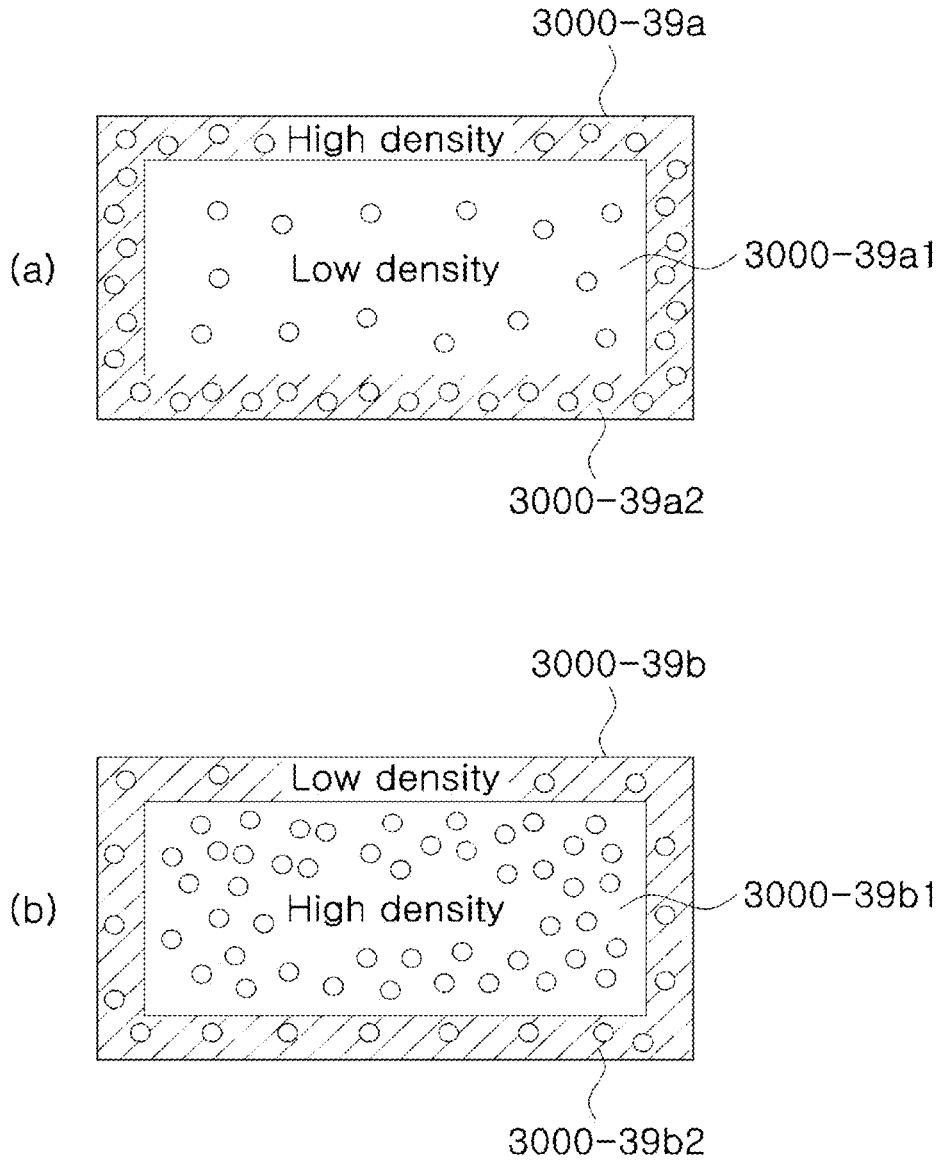
FIG. 39 is a view for describing liquid absorption performance and liquid holding performance according to a cross-link density of the liquid provider according to still another embodiment of the present disclosure.

FIG. 39 is a view for describing liquid absorption performance and liquid holding performance according to a crosslink density of the liquid provider according to still another embodiment of the present disclosure.

Referring to FIG. 39, in (a) and (b), each of liquid providers 3000-39*a* and 3000-39*b* may be divided into two regions according to crosslink densities. In (a), a second region 3000-39*a*2 of the liquid provider 3000-39*a* may surround a first region 3000-39*a*1 thereof. Here, the first region 3000-39*a*1 may be formed of polymer resin having a low crosslink density, and the second region 3000-39*a*2 may be formed of polymer resin having a high crosslink density. Accordingly, an inner region of the liquid provider 3000-39*a* may have high liquid absorption performance and low liquid holding performance, and an outer region thereof may have low liquid absorption performance and high liquid holding performance.

In this case, because the inner region holds a large amount of liquid, and the outer region does not easily release a liquid, the liquid provider 3000-39*a* may continuously hold a liquid. When the amount of waste heat generated in the feedback device 100 is small, the liquid provider 3000-39*a* may provide a liquid sufficient for dissipating the waste heat to the heat radiator 2000. Consequently, in this case, the waste heat dissipation effect of the feedback device 100 may be improved, and use time of the feedback device 100 may also be increased.

Conversely, in (b), a second region 3000-39*b*2 may surround a first region 3000-39*b*1 as in (a). Here, the first region 3000-39*b*1 of a liquid provider 3000-39*b* may be formed of polymer resin having a high crosslink density, and the second region 3000-39*b*2 may be formed of polymer resin having a low crosslink density. Accordingly, an inner region of the liquid provider 3000-39*b* may have low liquid absorption performance and high liquid holding performance, and an outer region thereof may have high liquid absorption performance and low liquid holding performance.

In this case, because the inner region does not easily release a liquid, and the outer region holds a large amount of liquid, a large amount of liquid may be provided to the heat radiator 2000 at an initial stage, and the amount of liquid being transferred to the heat radiator 2000 may be gradually decreased. This may be beneficial for heat dissipation of the feedback device 100 in a case in which cold feedback is intensively performed at an initial stage and a large amount of waste heat is accumulated at the initial stage.

2.3.1.3. Waste Heat Dissipation Performance According to Liquid Permeability

Figure 40:
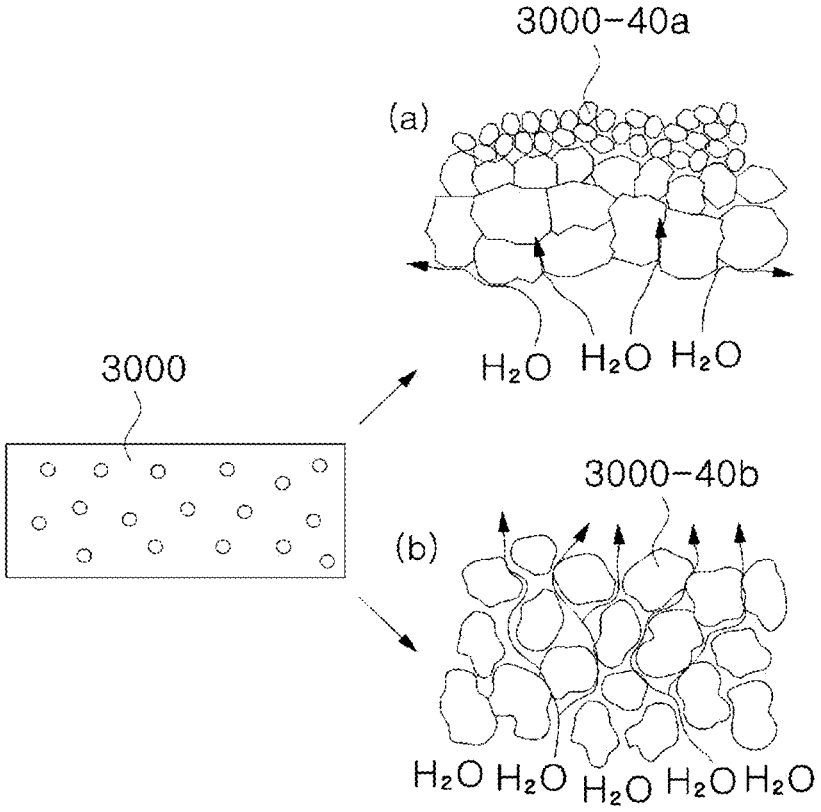
FIG. 40 is a view for describing liquid transfer according to liquid permeability of the liquid provider according to an embodiment of the present disclosure.

FIG. 40 is a view for describing liquid transfer according to liquid permeability of the liquid provider according to an embodiment of the present disclosure.

Referring to FIG. 40, liquid permeability may vary according to a configuration of the liquid provider 3000. Here, liquid permeability may be defined as a physical property that indicates an extent to which a liquid is transferred between polymer resins when the polymer resins have a liquid absorbed thereinto and are swelled.

In a case shown in (a), polymer resins of the liquid provider 3000 may have relatively uniform volumes. Because the volumes of the polymer resins are uniform, an empty space between the polymer resins may be reduced. Because of this, it may be difficult for a liquid to pass through portions between the polymer resins, and liquid permeability may be decreased.

In a case shown in (b), polymer resins of the liquid provider 3000 may not have uniform volumes. For example, a polymer resin having a small volume may be disposed between polymer resins having a large volume. In this case, an empty space may be formed between the polymer resins even when the polymer resins are swelled, and due to the empty space, a liquid may easily pass through portions between the polymer resins, and liquid permeability may be increased.

To sum up, liquid permeability of the liquid provider 3000 may be determined according to the arrangement of polymer resins, and a liquid may be more easily transferred in the case shown in (b) in which liquid permeability is high in comparison to the case shown in (a) in which liquid permeability is low. A larger amount of liquid may be easily transferred to the heat radiator 2000 in the case shown in (b) in which liquid permeability is high, and accordingly, the waste heat dissipation performance may also be improved in the case shown in (b).

2.3.2. Waste Heat Dissipation Performance According to Characteristics of Heat Radiator 2.3.2.1 Waste Heat Dissipation Performance According to Properties of Heat Transferer FIG. 41 is a view for describing waste heat dissipation performance according to a function of a heat transferer according to an embodiment of the present disclosure.

Figure 41:
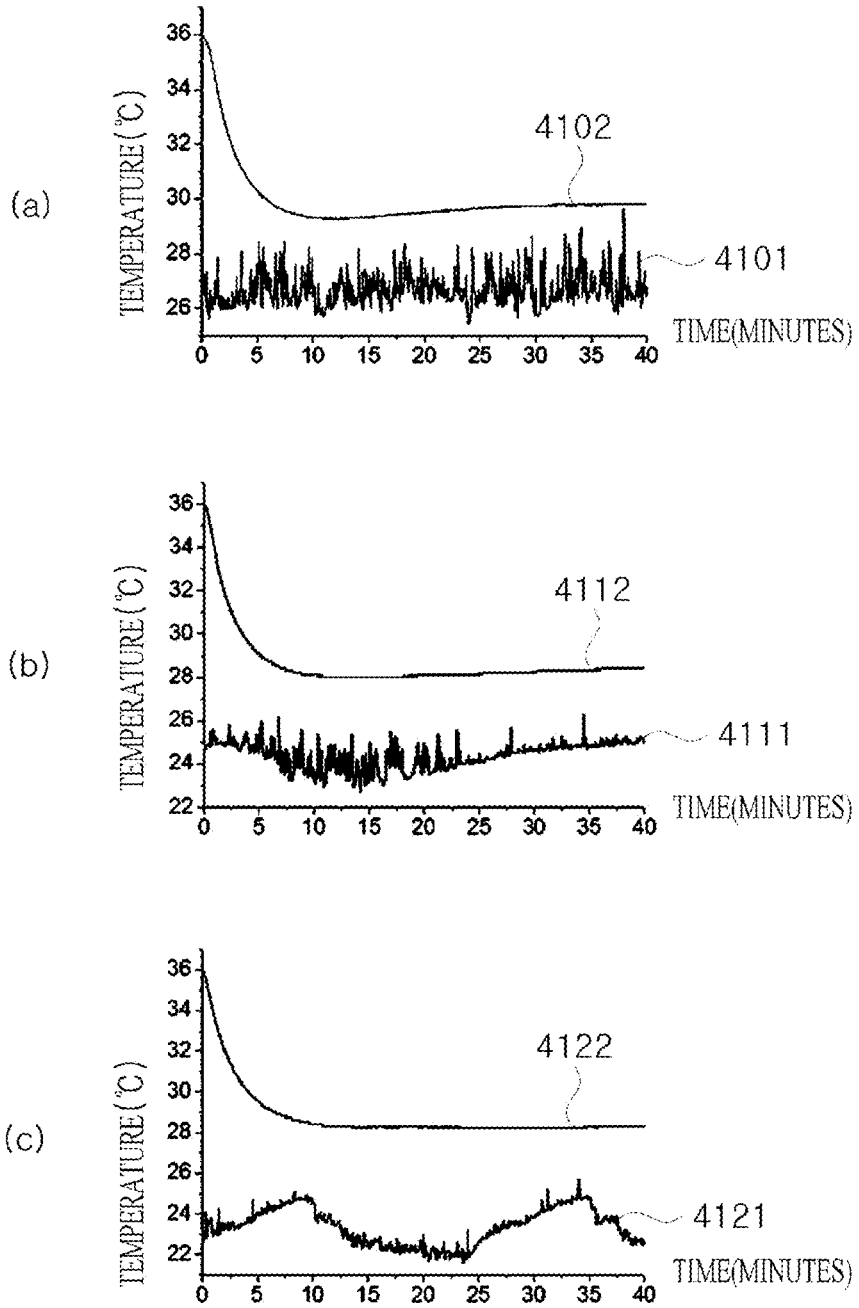
FIG. 41 is a view for describing waste heat dissipation performance according to a function of a heat transferer according to an embodiment of the present disclosure.

Referring to FIG. 41, the heat radiator 2000 may include the heat transferer 2100, and the heat transferer 2100 may be formed of various materials. Graphs shown in (a) to (c) show temperature changes at the contact surface 1600 in cases in which the feedback device 100 performs the endothermic operation when the heat transferer 2100 is formed of different materials. Specifically, the graphs shown in (a) to (c) show temperature changes at the contact surface 1600 when, as illustrated in FIG. 29, the heat transferer 2100 is disposed at the lower end of the heat radiator 2000 and comes into contact with the thermoelectric module 1000. In each of the graphs, the x-axis indicates time, and the y-axis indicates temperature. In the graphs shown in (a) to (c), lines 4101, 4111, and 4121 indicate surrounding temperature, and lines 4102, 4112, and 4122 indicate the temperature of the contact surface 1600.

In some embodiments of the present disclosure, in the case of (a), the heat transferer 2100 may be formed of a material having a heat collecting function; in the case of (b), the heat transferer 2100 may be formed of a material having a superior moisture absorbing function that indicates a function of absorbing a liquid; and in the case of (c), the heat transferer 2100 may be formed of a material having a superior waterproof function.

As shown in the graphs of (a) to (c), in the graphs of (a) to (c), respective temperature differences between the lines 4101, 4111, 4121 and the lines 4102, 4112, and 4122 are not large, and trends of the lines 4102, 4112, and 4122 may be similar. From this aspect, it may be confirmed that the function and/or material of the heat transferer 2100 in the case in which the heat transferer 2100 is disposed at the lower end of the heat radiator 2000 has relatively low relevance to the waste heat dissipation performance of the feedback device 100. This may be due to the fact that a difference in thermal conductivities between general fiber materials such as the materials in the graphs of (a) to (c) is not large.

However, when the heat transferer 2100 is formed of a material having higher heat conduction performance in comparison to general materials, because waste heat from the thermoelectric module 1000 is transferred more easily to the heat dissipator 2200, the waste heat dissipation performance of the feedback device 100 may be improved.

2.3.2.2. Waste Heat Dissipation Performance According to Properties of Heat Dissipator FIGS. 42 and 43 are views for describing waste heat dissipation performance according to a function of a heat dissipator according to an embodiment of the present disclosure.

In an embodiment of the present disclosure, the heat radiator 2000 may include the heat dissipator 2200, and the heat dissipator 2200 may be formed of various materials. Graphs shown in (a) and (b) of FIG. 42 and graphs shown in (a) to (d) of FIG. 43 show temperature changes at the contact surface 1600 in cases in which the feedback device 100 performs the endothermic operation when the heat dissipator 2200 is formed of different materials. Specifically, the graphs shown in FIGS. 42 and 43 show temperature changes at the contact surface 1600 when, as illustrated in FIG. 29, the heat dissipator 2200 is disposed at the upper end of the heat radiator 2000 and comes into contact with the thermoelectric module 1000. In each of the graphs, the x-axis indicates time, and the y-axis indicates temperature. In the graphs shown in FIGS. 42 and 43, lines 4201, 4211, 4301, and 4311 indicate surrounding temperature, and lines 4202, 4212, 4302, 4312, 4322, and 4332 indicate the temperature of the contact surface 1600.

Figure 42:
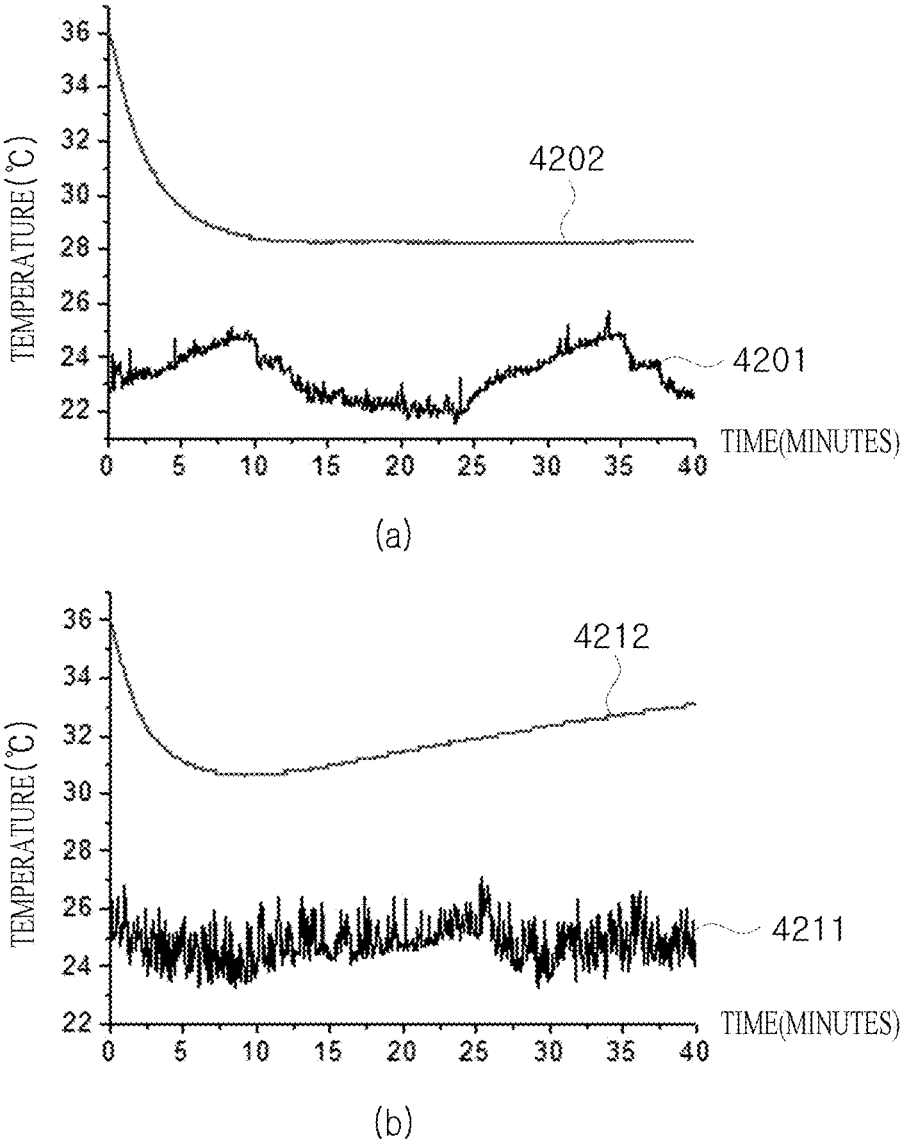
FIG. 42 is a view describing waste heat dissipation performance according to a function of a heat dissipator according to a first embodiment of the present disclosure.
Figure 43:
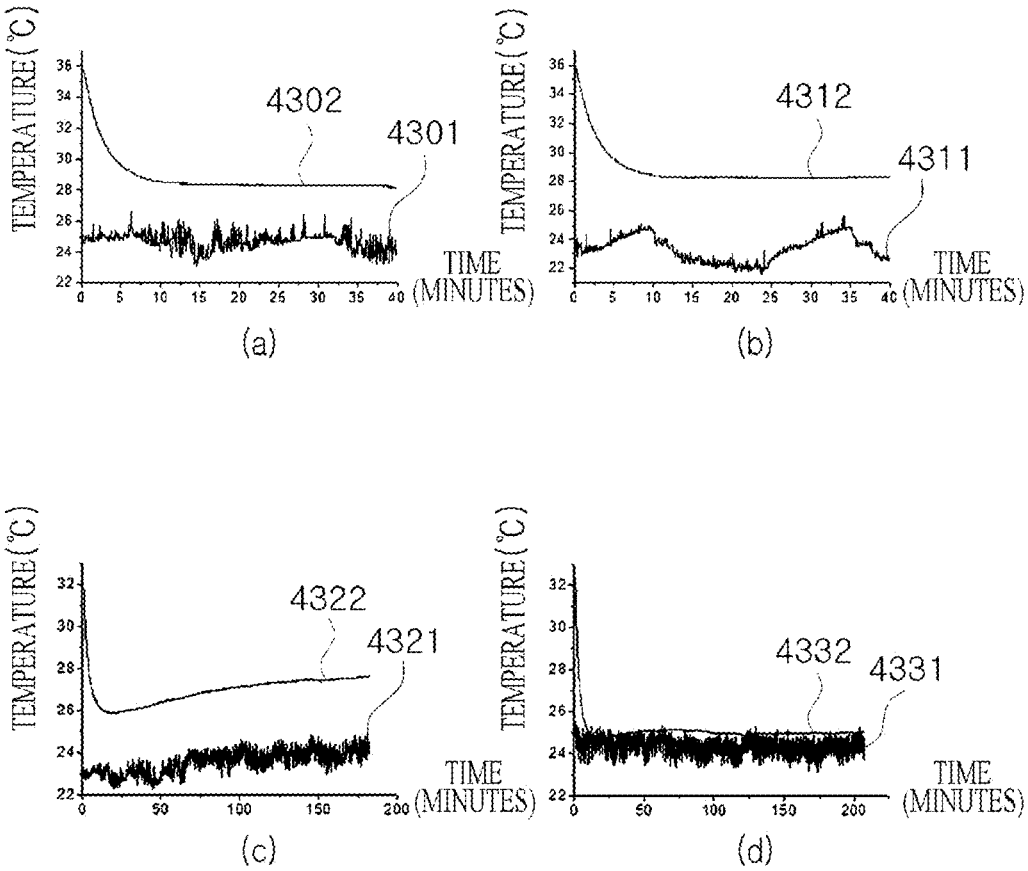
FIG. 43 is a view describing waste heat dissipation performance according to a function of a heat dissipator according to a second embodiment of the present disclosure.

Referring to FIG. 42, in the case of (a), the heat dissipator 2200 may be formed of a material having air permeability, and in the case of (b), the heat dissipator 2200 may be formed of a material having a waterproof function.

While the line 4202 in the graph shown in (a) indicates that, after the temperature initially drops, the temperature is maintained within a predetermined range, the line 4212 in the graph shown in (b) indicates that, after the temperature initially drops, the temperature continuously rises. That is, it may be confirmed that the waste heat dissipation performance is superior in the graph shown in (a) in comparison to the graph shown in (b). The difference in the waste heat dissipation performance in the graphs shown in (a) and (b) may be due to the heat dissipator 2200 having different functions. Specifically, waste heat may be dissipated in the form of latent heat from the heat dissipator 2200 through a liquid received from the liquid provider 3000. Here, in the case of (a), due to the air permeability of the heat dissipator 2200, it is easy for the liquid to be evaporated, and waste heat is actively dissipated. On the other hand, in the case of (b), due to the waterproof function of the heat dissipator 2200, it is difficult for the liquid to be evaporated, and accordingly, dissipation of waste heat may be difficult.

Referring to FIG. 43, (a) and (b) are views for describing waste heat dissipation performance according to the endothermic operation of the thermoelectric module 1000 during a relatively small amount of time, and (c) and (d) are views for describing waste heat dissipation performance according to the endothermic operation of the thermoelectric module 1000 during a relatively large amount of time. The heat dissipator 2200 may be formed of a material having a moisture absorbing function and air permeability in all of the cases shown in (a) to (d), but the moisture absorbing function and air permeability of the material of the heat dissipator 2200 in the cases of (b) and (d) may be higher than those of the material of the heat dissipator 2200 in the cases of (a) and (c). For example, the heat dissipator 2200 in the cases of (a) to (d) may be formed of any material of an ethylene vinyl alcohol fiber, a polyethylene vinyl alcohol (EVOH) fiber, a modified cross-section yarn, and a high ventilation material.

In the graphs shown in (a) and (b), the lines 4302 and 4312 indicate that, after the temperature initially drops, the temperature is maintained within a predetermined range. Accordingly, it may be confirmed that differences in the moisture absorbing function and air permeability of the heat dissipator 2200 do not affect the waste heat dissipation performance during a relatively small amount of time.

On the other hand, while the line 4322 in the graph shown in (c) indicates that, after the temperature initially drops, the temperature continuously rises, the line 4332 in the graph shown in (d) indicate that, even after the temperature initially drops, the temperature is maintained within a predetermined range. That is, when the endothermic operation is performed for a long period in the thermoelectric module 1000, the waste heat dissipation performance may be improved as the moisture absorbing function and air permeability of the heat dissipator 2200 are higher. Accordingly, the longer the period in which the endothermic operation is performed in the thermoelectric module 1000, the larger the influence of the moisture absorbing function and air permeability of the heat dissipator 2200 on the waste heat dissipation performance of the feedback device 100.

3. Cold Sensation Providing Performance in Feedback Device

Hereinafter, cold sensation providing performance of the feedback device 100 according to an embodiment of the present disclosure will be described.

3.1. Outline

As described above, when the feedback device 100 operates as a cooling device and the thermoelectric module 1000 performs the endothermic operation, cold sensation is provided to a user while waste heat is generated inside the feedback device 100. The waste heat may be dissipated to the outside through the heat radiator 2000 of the feedback device 100.

However, even when the same amount of waste heat is generated and dissipated, cold sensation provided to the user may vary depending on the configuration of the feedback device 100. For example, when a material that does not dissipate waste heat to the outside for a predetermined period and absorbs waste heat is disposed in the feedback device 100, due to the material, a surface temperature of the feedback device 100 may not rise even when a larger amount of waste heat is accumulated in the feedback device 100 for a predetermined amount of time, and because of this, cold sensation may be more easily provided to the user.

Hereinafter, a configuration of the feedback device 100 for improving cold sensation providing performance will be described in detail.

3.2. Thermal Buffer Material 3.2.1. Outline

Figure 44:
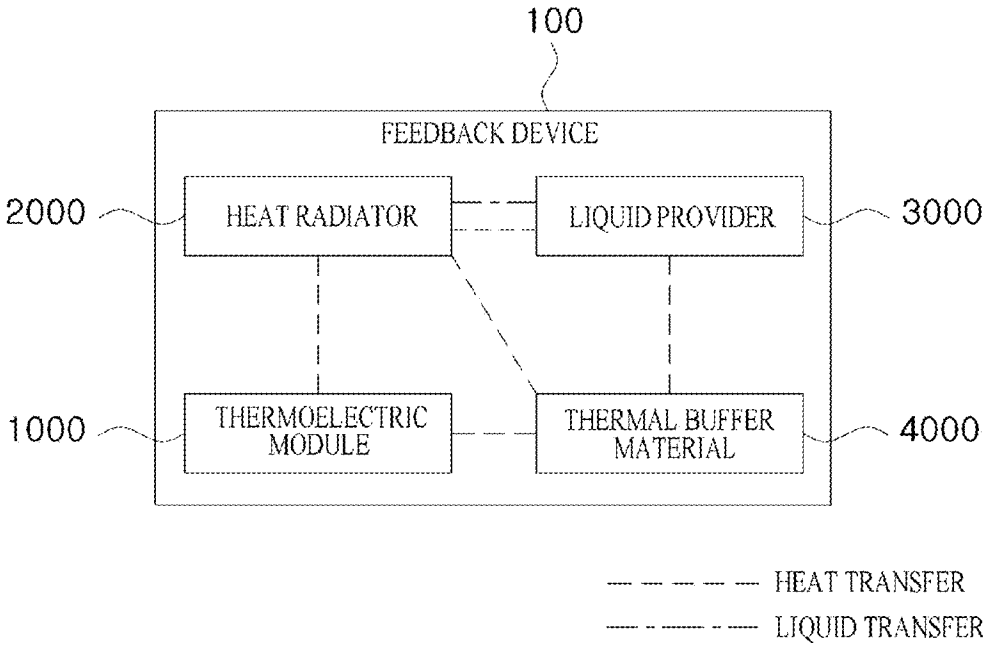
FIG. 44 is a block diagram of a configuration of the feedback device according to another embodiment of the present disclosure.

FIG. 44 is a block diagram of a configuration of the feedback device 100 according to another embodiment of the present disclosure.

Referring to FIG. 44, as described above, the feedback device 100 may include the thermoelectric module 1000, the heat radiator 2000, and the liquid provider 3000. The feedback device 100 may further include a thermal buffer material 4000. Here, the thermal buffer material 4000 may indicate a material that absorbs a predetermined amount of heat from the outside of the thermal buffer material 4000 and holds the heat.

Because the thermal buffer material 4000 absorbs a predetermined amount of heat and holds the heat, during time in which waste heat to be absorbed into the thermal buffer material 4000 is additionally generated, an extent to which a thermal experience of a user is degraded by the waste heat may be lowered, and the amount of cold heat transferred to the user may be increased.

In an embodiment of the present disclosure, the thermal buffer material 4000 may be provided in various shapes. For example, the thermal buffer material 4000 may be provided as an independent material. As an example, the thermal buffer material 4000 may be disposed as a plurality of independent materials in a partial region of the heat radiator 2000. As another example, the thermal buffer material 4000 may be provided in the form of a layer. As an example, the thermal buffer material 4000 may be disposed in the form of a layer at one surface of at least one of the thermoelectric module 1000, the heat radiator 2000, and the liquid provider 3000.

The thermal buffer material 4000 may be provided in any shape that may be included in the feedback device 100 in addition to being provided as an independent material or being disposed in the form of a layer. In an embodiment, the thermal buffer material 4000 may be separated from the feedback device 100. As an example, the thermal buffer material 4000 may be separated from the feedback device 100 and be replaced with another thermal buffer material. As another example, when the thermal buffer material 4000 absorbs heat, the thermal buffer material 4000 may be separated from the feedback device 100 for the heat to be dissipated to the outside of the feedback device 100.

3.2.2. Properties of Thermal Buffer Material

Figure 45:
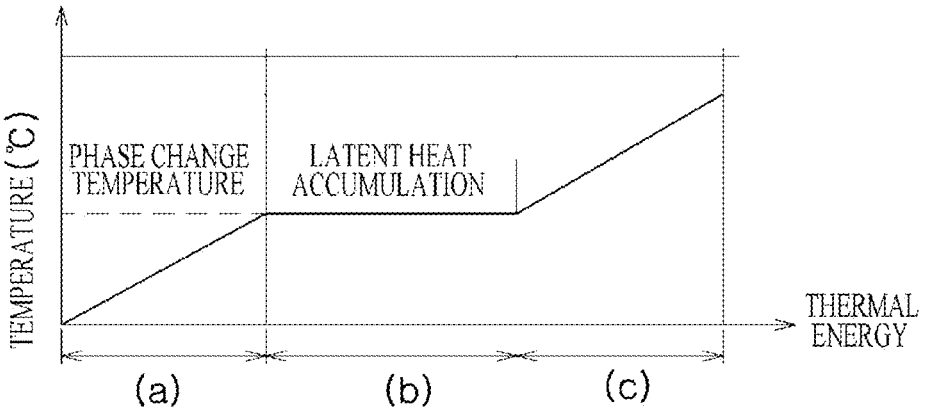
FIG. 45 is a view for describing a property of a thermal buffer material according to an embodiment of the present disclosure.

FIG. 45 is a view for describing a property of a thermal buffer material according to an embodiment of the present disclosure.

Referring to FIG. 45, the graph shows a temperature change of the thermal buffer material 4000 due to accumulation of thermal energy. The amount of heat applied to the thermal buffer material 4000 may increase from section (a) to section (c).

In an embodiment of the present disclosure, the thermal buffer material 4000 may accumulate a predetermined amount of heat. Here, the thermal buffer material 4000 may not dissipate heat to the outside during a predetermined amount of time in which the predetermined amount of heat is being accumulated.

Specifically, in section (a), heat may be applied to the thermal buffer material 4000, and the temperature of the thermal buffer material 4000 may rise within section (a). Then, within section (b), the thermal buffer material 4000 may absorb heat, and the temperature of the thermal buffer material may not rise. This is because the thermal buffer material 4000 stores heat being applied within section (b). In an embodiment of the present disclosure, as heat is applied, a phase change may occur in the thermal buffer material 4000. For example, in section (b), the thermal buffer material 4000 may use the absorbed heat for a phase change. Accordingly, solid and liquid, liquid and gas, or solid and gas may coexist in section (b), and from section (b) to section (c), a phase of the thermal buffer material 4000 may be changed from solid to liquid, liquid to gas, or solid to gas. When the phase of the thermal buffer material 4000 is changed in section (b) in this way, the thermal buffer material 4000 may become a PCM. In section (c), the amount of heat applied to the thermal buffer material 4000 may exceed the amount of heat that the thermal buffer material 4000 is able to hold. In this case, due to heat applied to the thermal buffer material 4000, the temperature of the thermal buffer material 4000 may rise.

In an embodiment of the present disclosure, the feedback device 100 may use the thermal buffer material 4000 to control a temperature inside the feedback device. Specifically, when a thermoelectric operation is performed and waste heat is generated inside the feedback device, the feedback device 100 may dissipate the waste heat to the outside of the feedback device, and when the amount of waste heat being generated is larger than the amount of waste heat being dissipated, the temperature inside the feedback device may be increased to a first temperature range. Here, the feedback device 100 may use the thermal buffer material 4000 to maintain the temperature inside the feedback device within the first temperature range for a predetermined amount of time so that a temperature rise inside the feedback device is delayed. That is, the feedback device 100 may delay a temperature rise due to waste heat at a contact surface through which the user comes into contact with the feedback device. Specifically, the thermal buffer material 4000 may absorb waste heat and control a surface temperature of the thermal buffer material 4000 to be maintained within a second temperature range. Here, a maximum temperature within the second temperature range may be lower than a maximum temperature within the first temperature range. That is, the surface temperature of the thermal buffer material 4000 may be lower than the temperature inside the feedback device 100. However, embodiments are not limited thereto, and, depending on an internal structure of the feedback device 10, the maximum temperature within the second temperature range may be higher than or equal to the maximum temperature within the first temperature range. This indicates that the surface temperature of the thermal buffer material 4000 may be higher than or equal to the temperature inside the feedback device 100. In an embodiment, the thermal buffer material 4000 may include a PCM, and accordingly, a phase change may occur inside the thermal buffer material 4000 while the surface temperature of the thermal buffer material 4000 is being maintained within the second temperature range.

As described above, when the thermal buffer material 4000 includes a PCM, the thermal buffer material 4000 may hold a larger amount of heat due to a phase change. Hereinafter, the PCM will be described in detail.

The PCM is a material having high heat of fusion and may be melted or hardened at specific temperature, thereby storing or releasing a large amount of thermal energy. In an embodiment, the PCM may store or dissipate heat through a chemical bond. As an example, in a case in which the PCM is a material whose phase is changed from solid to liquid, when heat is applied to the PCM in a solid state, the temperature of the PCM is increased, and when the temperature of the PCM reaches a melting point or a phase change temperature of the PCM, the PCM continues to absorb heat, but the temperature of the PCM is not increased. Here, the phase of the PCM is changed from solid to liquid. Then, when heat is not applied to the PCM, the PCM dissipates the heat accumulated therein to the outside, and accordingly, the phase of the PCM may be restored to solid from liquid. In this way, although the temperature of the PCM increases from an initial temperature to a phase change temperature, after the phase change temperature is reached, the temperature of the PCM is not increased until a phase change is completed. Each PCM may have a unique phase change temperature, and when the thermal buffer material 4000 is formed of the PCM, the phase change temperature of the PCM may be included within a range of a temperature change inside the feedback device 100. When the phase change temperature of the PCM is not included within the range of a temperature change inside the feedback device 100, a phase change does not occur in the PCM even when waste heat is accumulated inside the feedback device 100. Accordingly, the temperature of the PCM is continuously increased, and the PCM is unable to serve as the thermal buffer material 4000. For example, the phase change temperature of the PCM may be within 5° C. to 60° C. or within 20° C. to 40° C.

In an embodiment of the present disclosure, the PCM used in the thermal buffer material 4000 may be formed of various materials. For example, the PCM may include a hydrated inorganic salt such as hydrated calcium chloride, lithium nitrogen oxide, and Glauber's salt, a polyhydric alcohol such as dimethyl propanediol (DMP), hexamethyl propanediol (HMP), xylitol, and erhthritol, and linear chain hydrocarbon such as polyethylene terephthalate (PET)-polyethylene glycol (PEG) copolymer, PEG, polytetramethyl glycol (PTMG), and paraffin.

In an embodiment of the present disclosure, the PCM used in the thermal buffer material 4000 may be implemented in various forms. For example, the PCM may be included in a microcapsule, filled in fabric, or coated.

3.2.3. Applications of Thermal Buffer Material According to Various Embodiments 3.2.3.1. First Embodiment FIG. 46 is a view illustrating a structure of the feedback device to which the thermal buffer material is applied according to an embodiment of the present disclosure.

Figure 46:
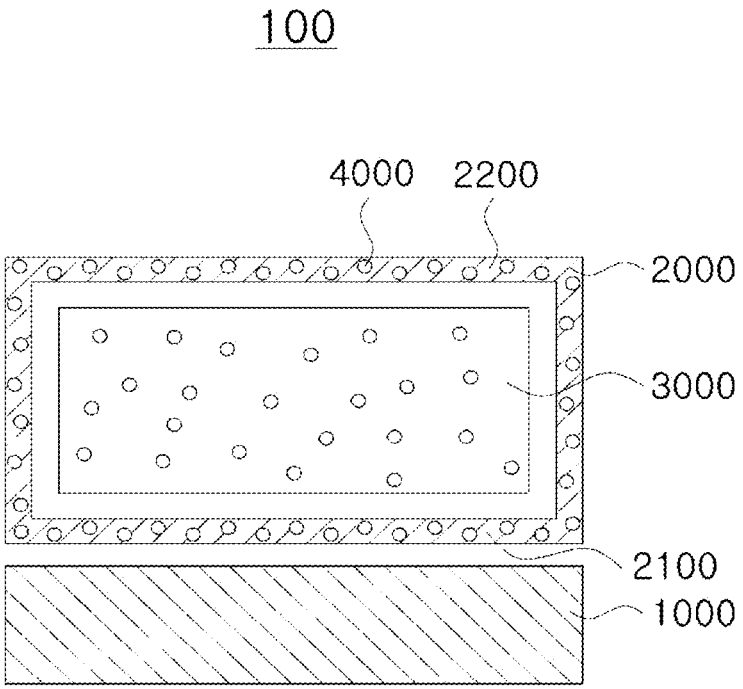
FIG. 46 is a view illustrating a structure of the feedback device to which the thermal buffer material is applied according to an embodiment of the present disclosure.

Referring to FIG. 46, as in the first embodiment illustrated in FIG. 29, the thermoelectric module 1000 and the heat radiator 2000 may be stacked in that order in the feedback device 100, and the liquid provider 3000 may be disposed inside the heat radiator 2000. The heat radiator 2000 may include the heat transferer 2100 and the heat dissipator 2200. The waste heat transfer path may be formed with the thermoelectric module 1000, the heat transferer 2100, the liquid provider 3000, and the heat dissipator 2200.

In an embodiment of the present disclosure, the thermal buffer material 4000 may be formed as an independent material and disposed in the heat dissipator 2200. For example, the thermal buffer material 4000 may be formed of xylitol and/or erithritol among PCMs. Here, xylitol and erithritol may be components that reacts with moisture as sugar alcohol, causes an endothermic reaction, and takes heat away from the surroundings, thereby causing a user to feel coldness.

As a more specific example, when the thermal buffer material 4000 formed of xylitol and/or erithritol is disposed in the heat dissipator 2200, the thermal buffer material 4000 may react with a liquid transferred from the liquid provider 3000, cause an endothermic reaction, and absorb waste heat around the thermal buffer material 4000. In this case, because the amount of waste heat in the feedback device 100 is reduced due to the thermal buffer material 4000 for a predetermined amount of time, cold sensation providing performance of the feedback device 100 may be improved.

When a user comes into contact with the heat dissipator 2200, the thermal buffer material 4000 may absorb heat from the user. Accordingly, the user may more strongly feel coldness due to the thermal buffer material 4000.

3.2.3.2. Second Embodiment

Figure 47:
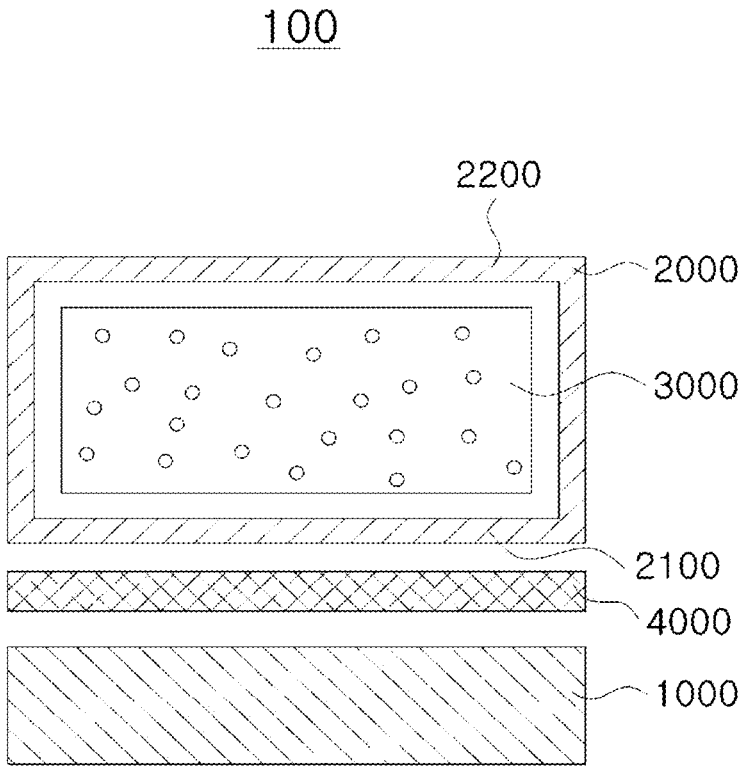
FIG. 47 is a view illustrating a structure of the feedback device to which the thermal buffer material is applied according to another embodiment of the present disclosure.

FIG. 47 is a view illustrating a structure of the feedback device to which the thermal buffer material is applied according to another embodiment of the present disclosure.

Referring to FIG. 47, the thermoelectric module 1000 and the heat radiator 2000 may be stacked in that order in the feedback device 100, and the liquid provider 3000 may be disposed inside the heat radiator 2000. Here, the thermal buffer material 4000 may be disposed between the heat radiator 2000 and the thermoelectric module 1000. Here, the thermal buffer material 4000 may be implemented in the form of a layer. The heat radiator 2000 may include the heat transferer 2100 and the heat dissipator 2200. The waste heat transfer path may be formed with the thermoelectric module 1000, the thermal buffer material 4000, the heat transferer 2100, the liquid provider 3000, and the heat dissipator 2200.

In an embodiment of the present disclosure, because the thermal buffer material 4000 is disposed between the thermoelectric module 1000 and the heat transferer 2100, the amount of waste heat accumulated inside the feedback device 100 is reduced for a predetermined amount of time, and transfer of waste heat from the thermoelectric module 1000 to the heat transferer 2100 may be delayed. As a specific example, when the thermoelectric module 1000 performs the endothermic reaction, waste heat may be generated in the thermoelectric module 1000. When the generated waste heat is transferred to the thermal buffer material 4000, although the temperature of the thermal buffer material 4000 rises to a phase change temperature due to the waste heat, the temperature of the thermal buffer material 4000 is maintained at the phase change temperature until a phase change of the thermal buffer material 4000 is completed.

Here, because the thermal buffer material 4000 absorbs waste heat while the temperature of the thermal buffer material 4000 is maintained at the phase change temperature, waste heat may not be accumulated inside the feedback device 100, and waste heat having a higher temperature than the phase change temperature may not be transferred from the thermal buffer material 4000 to the heat transferer 2100. Then, when the phase change of the thermal buffer material 4000 is completed, waste heat having a higher temperature than the phase change temperature may be further accumulated inside the feedback device 100, and the waste heat may be transferred to the heat transferer 2100. In this way, while the temperature of the thermal buffer material 4000 is maintained at the phase change temperature, the amount of waste heat inside the feedback device 100 may be decreased in comparison to a case in which the thermal buffer material 4000 is not included. Because an influence of the waste heat on the user's thermal experience decreases while the temperature of the thermal buffer material 4000 is maintained at the phase change temperature, the cold sensation providing performance of the feedback device 100 may be improved.

3.2.3.3. Third Embodiment

Figure 48:
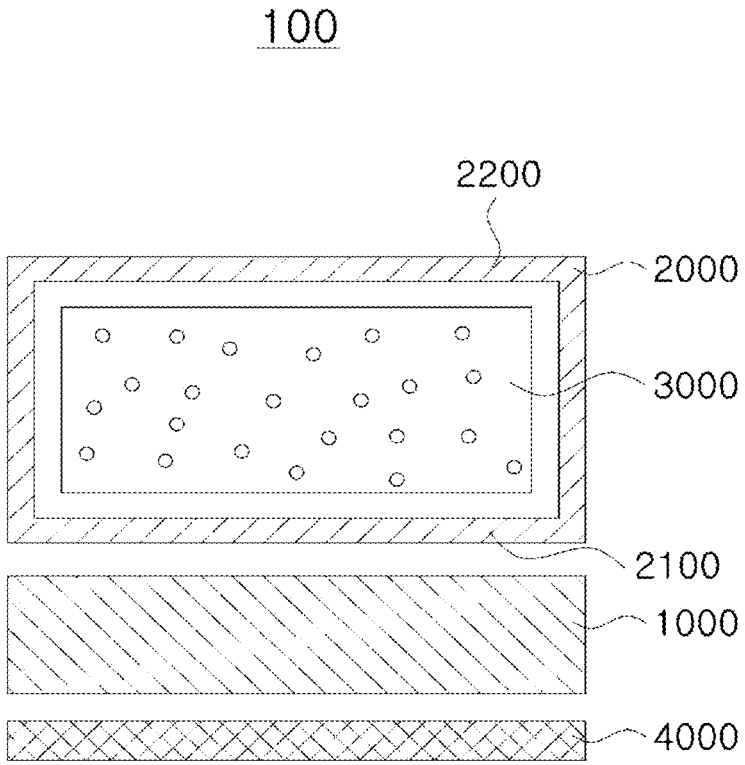
FIG. 48 is a view illustrating a structure of the feedback device to which the thermal buffer material is applied according to still another embodiment of the present disclosure.

FIG. 48 is a view illustrating a structure of the feedback device to which the thermal buffer material is applied according to still another embodiment of the present disclosure.

Referring to FIG. 48, the thermoelectric module 1000 and the heat radiator 2000 may be stacked in that order in the feedback device 100, and the liquid provider 3000 may be disposed inside the heat radiator 2000. Here, the thermal buffer material 4000 may be disposed below the thermoelectric module 1000. Here, the thermal buffer material 4000 may be implemented in the form of a layer. The heat radiator 2000 may include the heat transferer 2100 and the heat dissipator 2200. The waste heat transfer path may be formed with the thermoelectric module 1000, the heat transferer 2100, the liquid provider 3000, and the heat dissipator 2200.

In an embodiment of the present disclosure, the phase change temperature of the thermal buffer material 4000 may be higher than a temperature of cold heat generated from the thermoelectric module 1000. Accordingly, the phase change of the thermal buffer material 4000 may not occur due to the cold heat, and the thermal buffer material 4000 may not affect providing cold sensation to a user.

As the thermoelectric module 1000 continuously performs the endothermic operation, cold heat may be transferred to the user while waste heat is accumulated inside the feedback device 100. When the amount of waste heat being generated is larger than the amount of waste heat being dissipated, waste heat may also be accumulated in locations other than the waste heat transfer path. Because of this, waste heat may also be transferred to the user in addition to the cold heat. However, because the thermal buffer material 4000 is disposed at the lower end of the thermoelectric module 1000, the thermal buffer material 4000 may absorb and store the accumulated waste heat. After the temperature of the thermal buffer material 4000 reaches the phase change temperature, the temperature of the thermal buffer material 4000 may be maintained at a predetermined temperature. Accordingly, the thermal buffer material 4000 blocks waste heat from being transferred to the user, and thus the cold sensation providing performance of the feedback device 100 may be improved.

3.2.3.4. Fourth Embodiment

Figure 49:
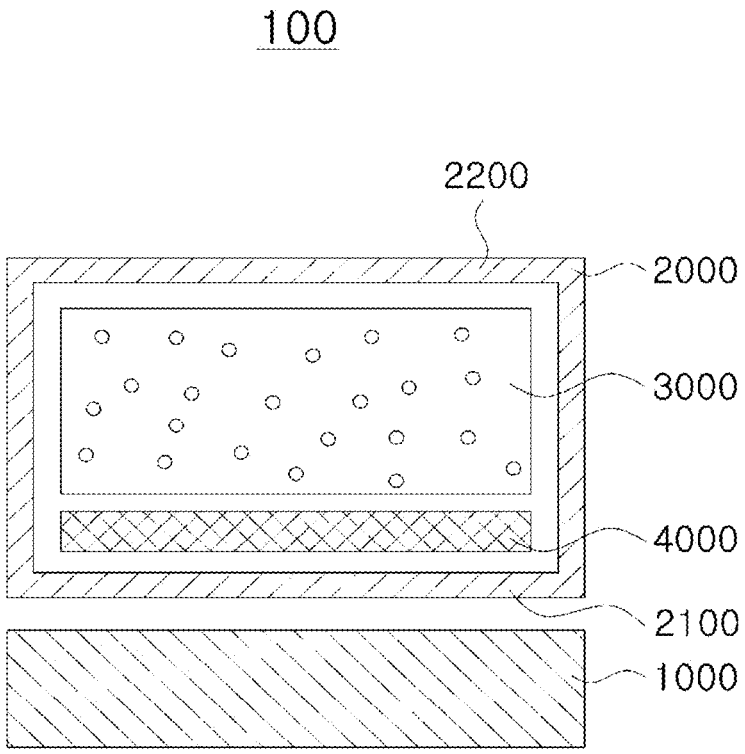
FIG. 49 is a view illustrating a structure of the feedback device to which the thermal buffer material is applied according to yet another embodiment of the present disclosure.

FIG. 49 is a view illustrating a structure of the feedback device to which the thermal buffer material is applied according to yet another embodiment of the present disclosure.

Referring to FIG. 49, the thermoelectric module 1000 and the heat radiator 2000 may be stacked in that order in the feedback device 100, and the liquid provider 3000 may be disposed inside the heat radiator 2000. Here, the thermal buffer material 4000 may be disposed at a lower end of the liquid provider 3000 inside the heat radiator 2000. Here, the thermal buffer material 4000 may be implemented in the form of a layer. The heat radiator 2000 may include the heat transferer 2100 and the heat dissipator 2200. The waste heat transfer path may be formed with the thermoelectric module 1000, the heat transferer 2100, the thermal buffer material 4000, the liquid provider 3000, and the heat dissipator 2200.

In an embodiment of the present disclosure, because the thermal buffer material 4000 is disposed at the lower end of the liquid provider 3000, the amount of waste heat being accumulated inside the feedback device 100 may be reduced for a predetermined amount of time, and transfer of waste heat from the heat transferer 2100 to the liquid provider 3000 may be delayed. As a specific example, when the waste heat generated in the thermoelectric module 1000 is transferred to the thermal buffer material 4000 through the heat transferer 2100, the temperature of the thermal buffer material 4000 may be increased to a phase change temperature due to the waste heat, but the temperature of the thermal buffer material 4000 may be maintained at the phase change structure until a phase change of the thermal buffer material 4000 is completed. Here, because the thermal buffer material 4000 absorbs waste heat while the temperature of the thermal buffer material 4000 is maintained at the phase change temperature, the amount of waste heat being accumulated inside the feedback device 100 may be reduced, and waste heat having a higher temperature than the phase change temperature may not be transferred from the thermal buffer material 4000 to the liquid provider 3000. Because of this, an influence of the waste heat on the user's thermal experience decreases while the temperature of the thermal buffer material 4000 is maintained at the phase change temperature, and thus the cold sensation providing performance of the feedback device 100 may be improved.

3.2.3.5. Fifth Embodiment

Figure 50:
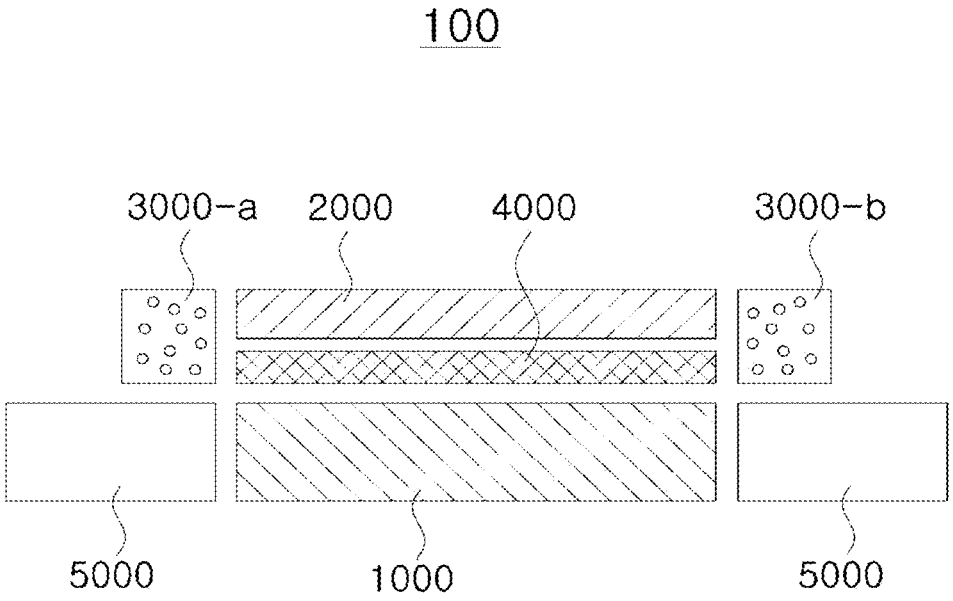
FIG. 50 is view illustrating a structure of the feedback device to which the thermal buffer material is applied according to yet another embodiment of the present disclosure.

FIG. 50 is view illustrating a structure of the feedback device to which the thermal buffer material is applied according to yet another embodiment of the present disclosure.

Referring to FIG. 50, the thermoelectric module 1000 and the heat radiator 2000 may be stacked in that order in the feedback device 100, and the liquid providers 3000-*a* and 3000-*b* may be disposed at both side surfaces of the heat radiator 2000. The supporter 5000 may be disposed at side surfaces of the thermoelectric module 1000, and the liquid providers 3000-*a* and 3000-*b* may be disposed at an upper end of the supporter 5000. The thermal buffer material 4000 may be disposed in the form of a layer between the thermoelectric module 1000 and the heat radiator 2000. Accordingly, the waste heat transfer path may be formed with the thermoelectric module 1000, the thermal buffer material 4000, and the heat radiator 2000. As described with reference to FIG. 30, because the liquid provides 3000-*a* and 3000-*b* are excluded from the waste heat transfer path, the waste heat transfer path may be shortened, and thus the waste heat dissipation performance may be improved.

Because the thermal buffer material 4000 is disposed between the thermoelectric module 1000 and the heat radiator 2000, and the temperature of the thermal buffer material 4000 is not increased in a phase change temperature section, the amount of waste heat being accumulated inside the feedback device 100 may be reduced while the temperature of the thermal buffer material 4000 is maintained at the phase change temperature, and transfer of waste heat from the thermoelectric module 1000 to the heat radiator 2000 may be delayed. In this way, because an influence of the waste heat on the user's thermal experience decreases while the temperature of the thermal buffer material 4000 is maintained at the phase change temperature, the cold sensation providing performance of the feedback device 100 may be improved.

Figure 51:
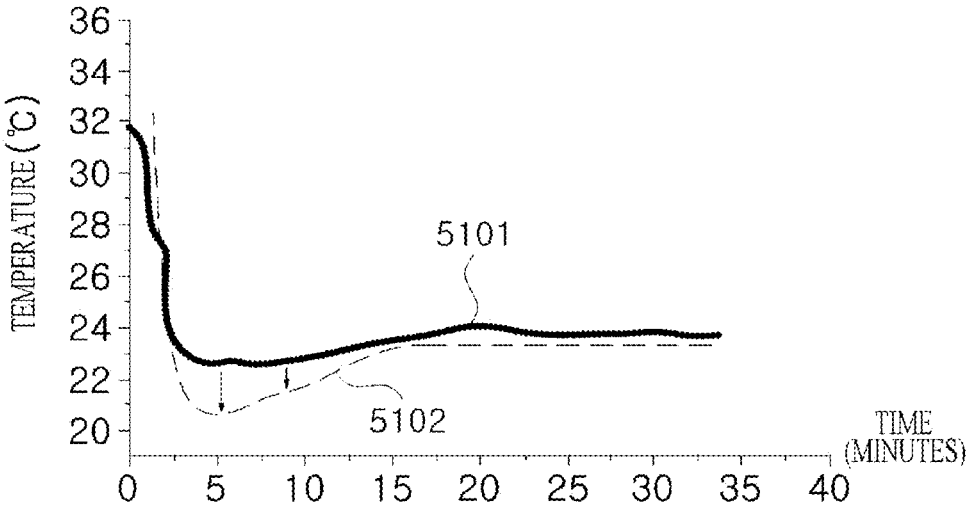
FIG. 51 is a view for describing cold sensation providing performance that is improved by the thermal buffer material according to an embodiment of the present disclosure.

FIG. 51 is a view for describing cold sensation providing performance that is improved by the thermal buffer material according to an embodiment of the present disclosure.

Referring to FIG. 51, the graph of FIG. 51 shows temperature of heat being provided from the feedback device 100 to the user. The x-axis of the graph indicates time, and the y-axis thereof indicates temperature. A line 5101 shows the temperature of the contact surface 1600 when the thermal buffer material 4000 is not included in the feedback device 100, and a line 5102 shows the temperature of the contact surface 1600 when the thermal buffer material 4000 is included in the feedback device 100.

In the graph of FIG. 51, the line 5102 shows a lower minimum temperature than that of the line 5101, and the amount of time taken for the line 5102 to reach a saturation temperature may be larger than the amount of time taken for the line 5101 to reach a saturation temperature. This may be due to the reduction in the amount of waste heat being accumulated inside the feedback device 100 for a predetermined amount of time due to the thermal buffer material 4000 and the delay in the transfer of waste heat from the thermoelectric module 1000 to another element as described above in the second embodiment to the fifth embodiment. Consequently, as shown in the graph of FIG. 51, when the thermal buffer material 4000 is included in the feedback device 100, the user may more steadily receive coldness at a lower temperature.

Figure 52:
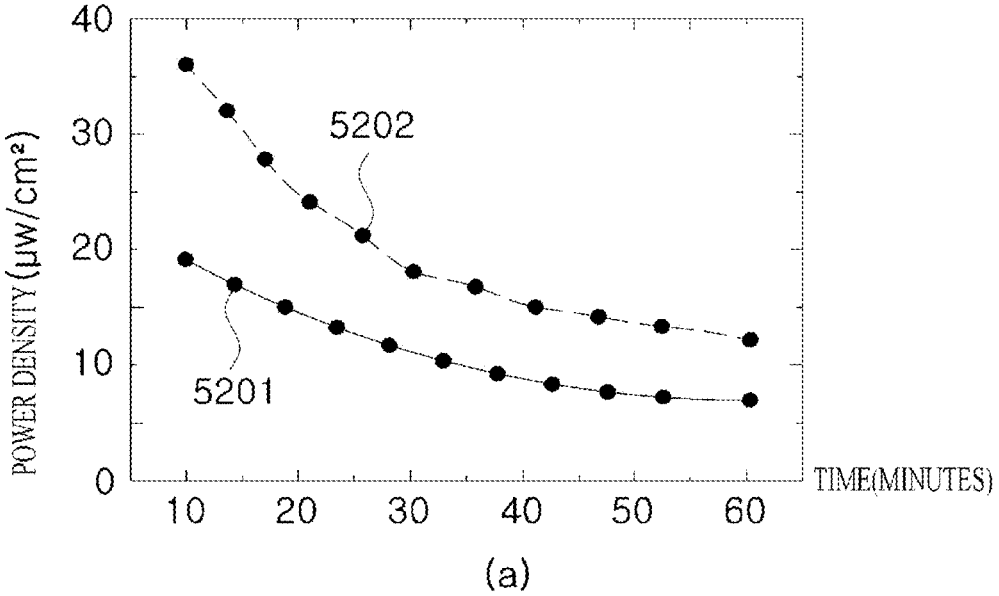
FIG. 52 is a view for describing cold sensation providing performance that is improved by the thermal buffer material according to another embodiment of the present disclosure.
Figure 52:
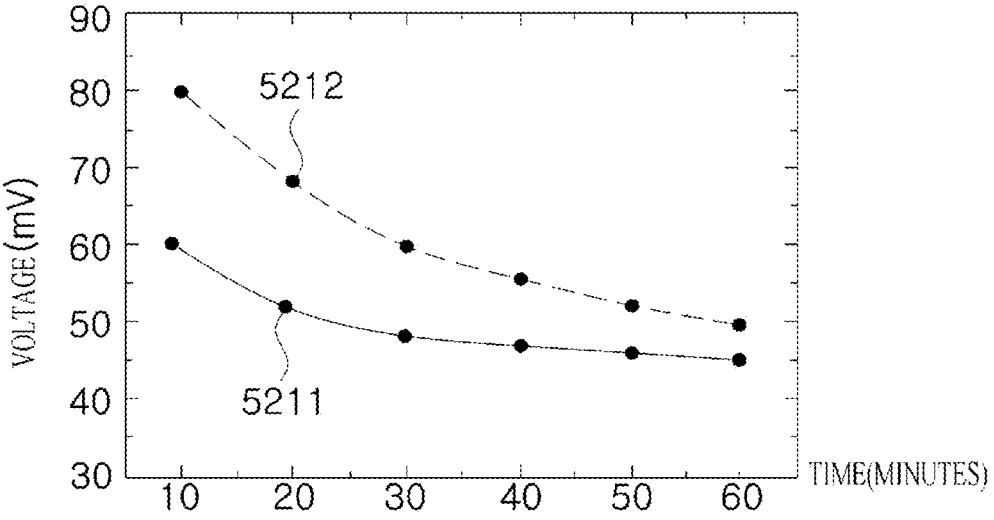

FIG. 52 is a view for describing cold sensation providing performance that is improved by the thermal buffer material according to another embodiment of the present disclosure.

Referring to FIG. 52, (a) is a graph showing density of power generated with time, and (b) is a graph showing a level of voltage of power being generated with time.

In the graph of (a), the x-axis indicates time, and the y-axis indicates power density ($\mu W/cm^2$) indicating a power generation amount per unit area generated in the feedback device 100. In the graph of (b), the x-axis indicates time, and the y-axis indicates a level of voltage (mV) of power being generated in the feedback device 100.

In the graphs of (a) and (b), a line 5201 shows a power density when the thermal buffer material 4000 is not included in the feedback device 100, a line 5211 shows a voltage when the thermal buffer material 4000 is not included in the feedback device 100, a line 5202 shows a power density when the thermal buffer material 4000 is included in the feedback device 100, and a line 5212 shows a voltage when the thermal buffer material 4000 is not included in the feedback device 100.

As shown in the graphs of (a) and (b), the power density or voltage, that is, power generation efficiency, may be higher in the case in which the thermal buffer material 4000 is included in the feedback device 100 in comparison to when the thermal buffer material 4000 is not included in the feedback device 100. This signifies that a temperature difference in the thermoelectric module 1000 increases when the thermal buffer material 4000 is included in the feedback device 100. The increase in the temperature difference in the thermoelectric module 1000 may indicate an improvement in the waste heat dissipation performance in the feedback device 100. The improvement in the waste heat dissipation performance may, as a result, indicate an improvement in the cold sensation providing performance. Consequently, when the thermal buffer material 4000 is included in the feedback device 100, performance of providing cold sensation to the user may be improved, and power generation efficiency may also be improved.

4. Method of Improving the User'S Perception Performance of Feedback Device

Hereinafter, a method of improving the user's perception performance of the feedback device 100 according to an embodiment of the present disclosure will be described.

4.1. Outline

As described above, the feedback device 100 may perform an endothermic operation and provide cold feedback to the user. Accordingly, the user may perceive cold sensation from the feedback device 100.

The feedback device 100 may control whether cold feedback is provided and adjust an intensity of cold feedback. Because the endothermic operation is performed in the feedback device 100, waste heat may be accumulated in the feedback device 100, and the cold feedback provided to the user may be affected by the accumulated feedback. Due to such factors, the user may receive cold feedback of various intensities at various times, and accordingly, the extent of cold sensation perceived by the user may vary.

More specifically, FIG. 53 is a view illustrating a graph related to a temperature of heat provided to a user from the feedback device according to an embodiment of the present disclosure. In the graph of FIG. 53, the x-axis indicates time, the y-axis indicates temperature, and the line 5301 indicates the temperature of the contact surface 1600 of the thermoelectric module 1000 with time. In FIG. 53, as a predetermined voltage at a single level is applied to the thermoelectric module 1000, the thermoelectric module 1000 may perform the endothermic operation, and as cold heat according to the endothermic operation is transferred to the contact surface 1600, the temperature of the contact surface 1600 may drop. However, as the thermoelectric module 1000 performs the endothermic operation, waste heat may be accumulated in the feedback device 100, and due to the influence of the waste heat, after reaching a minimum temperature, the temperature of the contact surface 1600 may rise and be maintained within the predetermined temperature section 5322.

In some embodiments of the present disclosure, cold heat transfer performance, which indicates performance in which cold heat is transferred, may be may include three indicators. The first indicator of the cold heat transfer performance is the amount of time taken to reach a minimum temperature that indicates a speed at which the minimum temperature is reached. In the example of FIG. 53, the amount of time taken to reach the minimum temperature may be the section 5311. When the temperature of the contact surface 1600 reaches the minimum temperature faster and the section 5311 is shortened, the cold heat transfer performance of the feedback device 100 may be improved. The second indicator of the cold heat transfer performance is a duration time that indicates how long the temperature of the contact surface lasts. This is because, when a large amount of waste heat is accumulated in the feedback device 100, the temperature of the contact surface 1600 rises instead of being maintained at a specific temperature due to the accumulated waste heat, and cold heat is unable to be normally transferred to the user due to the feedback device 100 becoming hot.

In the example of FIG. 53, the duration time may be time in which the temperature of the contact surface 1600 is maintained within the temperature section 5322. When the temperature of the contact surface 1600 is maintained within the temperature section 5322 for a larger amount of time, the cold heat transfer performance of the feedback device 100 may be improved. The third indicator of the cold heat transfer performance is a lasting temperature that indicates the temperature of the contact surface 1600 during the duration time. As described above, although the temperature of the contact surface 1600 is unable to be maintained at the minimum temperature due to the waste heat, because the waste heat is dissipated from the feedback device 100, the temperature of the contact surface 1600 may be maintained at a temperature higher than the minimum temperature, and the higher temperature may be the lasting temperature. Here, when a temperature value of the lasting temperature is increased, cold heat is unable to be normally transferred to the user due to the feedback device 100 becoming hot. In the example of FIG. 53, the lasting temperature may be the temperature section 5322. When the temperature in the temperature section 5322 is decreased, the cold heat transfer performance of the feedback device 100 may be improved.

As the indicators of the cold heat transfer performance are improved, the extent to which the user perceives cold feeling may be mostly improved. The improvements in the indicators of the cold heat transfer performance indicate that the feedback device 100 is not greatly affected by the waste heat. Because of this, the user receives cold feedback that is not greatly affected by the waste heat. In this way, the extent to which the user perceives cold sensation may be improved.

In an embodiment of the present disclosure, when a voltage value applied to the thermoelectric module 1000 is changed or a plurality of voltages having different voltage values are applied to the thermoelectric module 1000, the minimum temperature of the contact surface 1600 and the temperature section 5322 in which the temperature of the contact surface 1600 is maintained may be changed. Even when a time point at which a voltage is applied to the thermoelectric module 1000 is changed, the minimum temperature of the contact surface 1600 and the temperature section 5322 in which the temperature of the contact surface 1600 is maintained may be changed. As a result, cold heat provided to the user is changed according to a level of a voltage applied to the thermoelectric module 1000 and a time point at which the voltage is applied, and the amount of time taken to reach the minimum temperature, the duration time, and the lasting temperature, which are indicators of the cold heat transfer performance, are also changed such that the extent to which the user perceives cold sensation due to cold feedback provided from the feedback device 100 is also changed.

Hereinafter, a method of improving cold feeling perception of the user in a situation in which cold heat provided to the user changes due to various conditions will be described.

4.2. Method of Improving the User'S Perception Performance by Applying a Plurality of Voltages FIG. 54 is an operational flowchart illustrating a method of improving the user's perception performance by applying a plurality of voltages according to an embodiment of the present disclosure.

Figure 54:
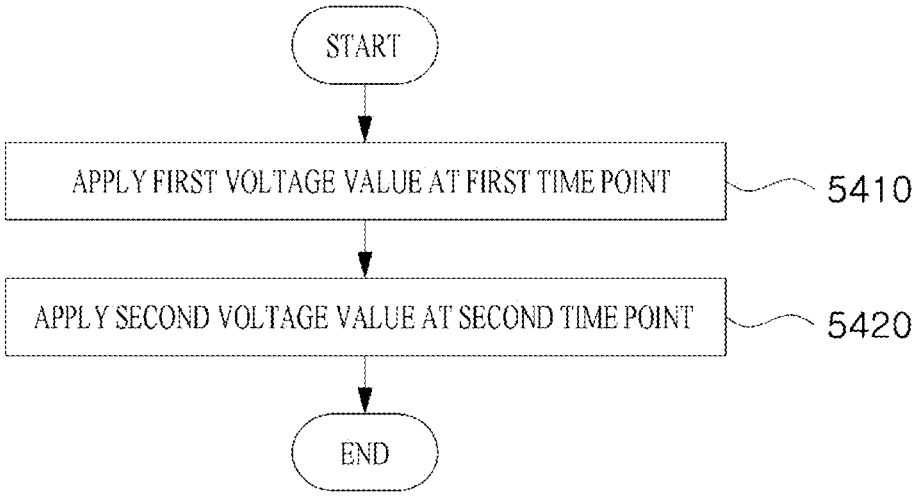
FIG. 54 is an operational flowchart illustrating a method of improving a user's perception performance by applying a plurality of voltages according to an embodiment of the present disclosure.

Referring to FIG. 54, when the feedback device 100 provides cold feedback, to improve a user's cold sensation perception performance(of cold feeling perception performance), the feedback device 100 may determine a voltage value of a voltage to be applied to the thermoelectric module 1000 and a time point at which the voltage is to be applied. When the feedback device 100 determines to apply voltage values at two different voltage levels at two different time points, the feedback device 100 may apply a first voltage value at a first time point (5410). Also, the feedback device 100 may apply a second voltage value at a second time point (5420). As Steps 5410 and 5420 are performed, the user's cold sensation perception performance may be improved. Hereinafter, Steps 5410 and 5420 will be described in more detail. Although an embodiment in which voltage values at two different voltage levels are applied at two different time points is described with reference to FIG. 54, embodiments are not limited thereto, and the method of improving the user's perception performance of the feedback device 100 according to an embodiment of the present disclosure may also be applied to a case in which voltage values at three or more different levels are applied at various time points.

Figure 55:
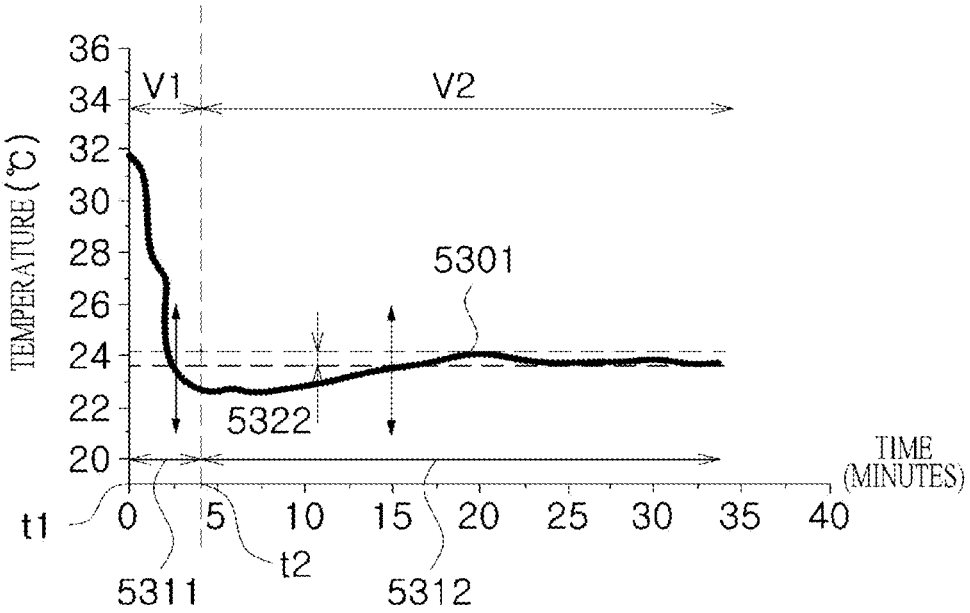
FIG. 55 is a view for describing cold heat transfer performance of the feedback device by adjusting a voltage according to an embodiment of the present disclosure.

FIG. 55 is a view for describing cold heat transfer performance of the feedback device by adjusting a voltage according to an embodiment of the present disclosure.

Referring to FIG. 55, the x-axis of the graph indicates time, the y-axis thereof indicates temperature, and, as in FIG. 53, the line 5301 indicates the temperature of the contact surface 1600 when a voltage Va, which is a voltage at a single level, is applied. Here, the line 5301 may be shown in different forms according to Step 5410 and Step 5420.

Specifically, in some embodiments of the present disclosure, in Step 5410, the feedback device 100 may apply a first voltage V1 at a first time point t1. In an embodiment, when the first voltage V1 is equal to the voltage Va, the temperature of the contact surface 1600 may be represented by a line equal to the line 5301.

However, in an embodiment, the first voltage V1 may be at a lower level than the voltage Va. In this case, the thermoelectric module 1000 may output thermal feedback at a lower intensity in comparison to when the voltage Va is applied, and accordingly, a wanted temperature at the contact surface 1600 when the first voltage V1 is applied may be higher than a wanted temperature at the contact surface 1600 when the voltage Va is applied. Consequently, in the section 5311, the temperature of the contact surface 1600 may be represented as being higher than the line 5301.

On the other hand, because the thermal feedback at the lower intensity in comparison to when the voltage Va is applied is output, when the first voltage V1 is applied, a smaller amount of waste heat may be generated in comparison to when the voltage Va is applied. Accordingly, an amount of time taken to reach a minimum temperature that indicates the amount of time for the temperature of the contact surface 1600 to reach the wanted temperature at the contact surface 1600 when the first voltage V1 is applied may be shortened in comparison to when the voltage Va is applied. However, according to circumstances, the amount of time taken for the temperature of the contact surface 1600 to reach the wanted temperature at the contact surface 1600 when the first voltage V1 is applied may be relatively large depending on a level of the first voltage V1. This may be due to the fact that, despite a small amount of waste heat being generated, a speed at which a temperature initially drops is slow in some of the thermoelectric pair arrays 1240. That is, a speed at which a temperature initially drops may be related to characteristics of the thermoelectric pair array 1240 in addition to the amount of waste heat being generated.

When the first voltage V1 is applied in the section 5311 while it is assumed that the voltage Va is applied in the section 5312, because the amount of waste heat generated in the section 5311 is smaller in comparison to when the voltage Va is applied in the section 5311, the duration time in the section 5312 may be longer. Because the small amount of waste heat is generated, the lasting temperature in the section 5312 may be lowered.

In another embodiment, the first voltage V1 may be at a higher level than the voltage Va. In this case, the thermoelectric module 1000 may output thermal feedback at a higher intensity in comparison to when the voltage Va is applied, and accordingly, the wanted temperature at the contact surface 1600 when the first voltage V1 is applied may be lower than the wanted temperature at the contact surface 1600 when the voltage Va is applied. Consequently, in the section 5311, the temperature of the contact surface 1600 may be represented as being lower than the line 5301.

In some of the thermoelectric pair arrays 1240, the amount of time taken to reach a wanted temperature may be smaller as a level of a voltage being applied thereto is higher. In this case, the amount of time taken to reach a minimum temperature when the first voltage V1 is applied may be smaller in comparison to when the voltage Va is applied.

On the other hand, because the thermal feedback at the higher intensity in comparison to when the voltage Va is applied is output, a larger amount of waste heat in comparison to when the voltage Va is applied may be generated. In this case, when the amount of waste heat is accumulated by a threshold value or more, the waste heat may affect the temperature of the contact surface 1600, and accordingly, the amount of time taken to reach the minimum temperature when the first voltage V1 is applied may be larger in comparison to when the voltage Va is applied.

When the first voltage V1 is applied in the section 5311 while it is assumed that the voltage Va is applied in the section 5312, because the amount of waste heat generated in the section 5311 is larger in comparison to when the voltage Va is applied in the section 5311, the duration time in the section 5312 may be shortened. Because the large amount of waste heat is generated, the lasting temperature in the section 5312 may be increased. This may vary according to the amount of waste heat being generated, and when a difference between the amount of waste heat when the voltage Va is applied in the section 5312 and the amount of waste heat when the first voltage V1 is applied in the section 5312 is not large, the duration time and the lasting temperature may be similar with those in the case in which the voltage Va is applied in the section 5312.

In some embodiments of the present disclosure, in Step 5420, the feedback device 100 may apply a second voltage V2 at a second time point t2. In an embodiment, when the first voltage V1 and the second voltage V2 are equal to the voltage Va, the temperature of the contact surface 1600 may be represented by a line equal to the line 5301.

However, in an embodiment, the second voltage V2 may be at a lower level than the voltage Va. In this case, the thermoelectric module 1000 may output thermal feedback at a lower intensity in comparison to when the voltage Va is applied, and accordingly, a wanted temperature at the contact surface 1600 when the second voltage V2 is applied may be higher than a wanted temperature at the contact surface 1600 when the voltage Va is applied. Consequently, in the section 5312, the lasting temperature when the second voltage V2 is applied may be higher in comparison to when the voltage Va is applied.

However, because the thermal feedback at the lower intensity in comparison to when the voltage Va is applied is output, when the second voltage V2 is applied, a smaller amount of waste heat may be generated in comparison to when the voltage Va is applied. When the lasting temperature in the case in which the voltage Va is applied is shown to be high due to the waste heat, a small amount of waste heat may be generated when the second voltage V2 is applied, and the lasting temperature may not be greatly affected by the waste heat when the second voltage V2 is applied. Because of this, although a wanted temperature at the contact surface 1600 when the second voltage V2 is applied is higher than a wanted temperature at the contact surface 1600 when the voltage Va is applied, a lasting temperature when the second voltage V2 is applied in the section 5312 may be lower in comparison to when the voltage Va is applied in the section 5312 according to circumstances.

Because the smaller amount of waste heat is generated when the second voltage V2 is applied in comparison to when the voltage Va is applied, a duration time when the second voltage V2 is applied may be longer in comparison to when the voltage Va is applied.

In another embodiment, the second voltage V2 may be at a higher level than the voltage Va. In this case, the thermoelectric module 1000 may output thermal feedback at a higher intensity in comparison to when the voltage Va is applied, and accordingly, the wanted temperature at the contact surface 1600 when the second voltage V2 is applied may be lower than the wanted temperature at the contact surface 1600 when the voltage Va is applied. Consequently, in the section 5312, the lasting temperature when the second voltage V2 is applied may be lower in comparison to when the voltage Va is applied.

However, because the thermal feedback at the higher intensity in comparison to when the voltage Va is applied is output, when the second voltage V2 is applied, a larger amount of waste heat may be generated in comparison to when the voltage Va is applied. According to circumstances, the lasting temperature may be affected by the waste heat, and in this case, the lasting temperature when the second voltage V2 is applied in the section 5312 may be higher in comparison to when the voltage Va is applied. Because a larger amount of waste heat is generated when the second voltage V2 is applied in comparison to when the voltage Va is applied, the duration time when the second voltage V2 is applied may be shorter in comparison to when the voltage Va is applied. According to the amount of waste heat being generated or characteristics of the feedback device 100, the duration time may not be greatly affected by the waste heat. In this case, the duration time when the second voltage V2 is applied may be similar to that when the voltage Va is applied.

Accordingly, the feedback device 100 may determine a voltage to be applied to the thermoelectric module 1000 so that the amount of time taken to reach a minimum temperature is reduced, the duration time is increased, and the lasting temperature is lowered and, through Step 5410 and Step 5420, may apply the determined voltage to improve the cold heat transfer performance.

Figure 56:
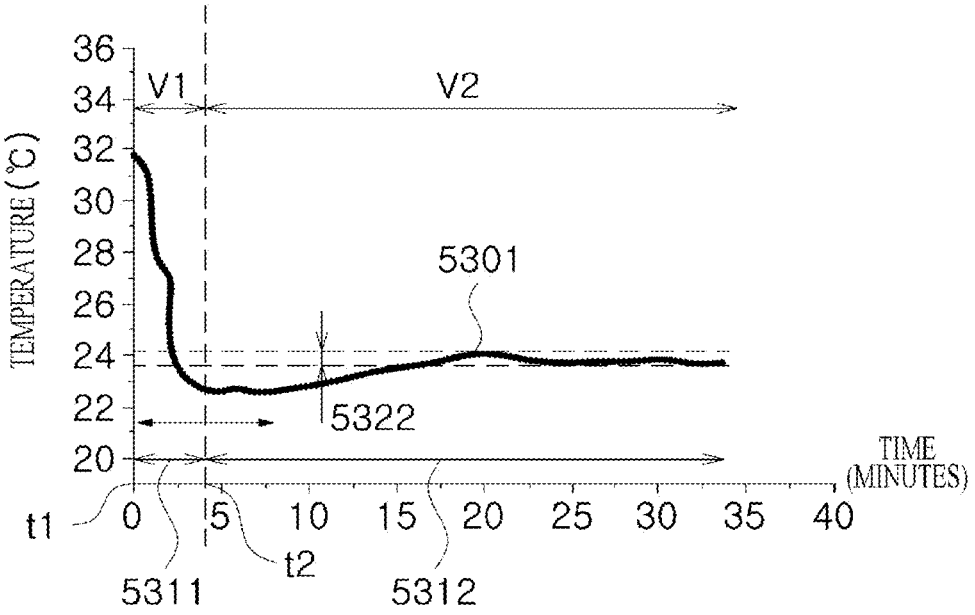
FIG. 56 is a view for describing cold heat transfer performance of the feedback device by adjusting a time point at which a voltage is applied according to an embodiment of the present disclosure.

FIG. 56 is a view for describing cold heat transfer performance of the feedback device by adjusting a time point at which a voltage is applied according to an embodiment of the present disclosure.

Referring to FIG. 56, the x-axis of the graph indicates time, the y-axis thereof indicates temperature, and, as in FIG. 53, the line 5301 indicates the temperature of the contact surface 1600 when the voltage Va, which is a voltage at a single level, is applied. Here, the line 5301 may be shown in different forms according to Step 5410 and Step 5420.

Specifically, in some embodiments of the present disclosure, in Step 5410, the feedback device 100 may apply the first voltage V1 at the first time point t1. In an embodiment, when the first voltage V1 is equal to the voltage Va, the temperature of the contact surface 1600 may be represented by a line equal to the line 5301.

In an embodiment, in Step 5420, the feedback device 100 may apply the second voltage V2 at the second time point t2. In an embodiment, when the first voltage V1 and the second voltage V2 are equal to the voltage Va, the temperature of the contact surface 1600 may be represented by a line equal to the line 5301.

However, in an embodiment, the first voltage V1 may be at a higher level than the second voltage V2, and the second time point t2 in FIG. 56 may be earlier than a time point at which the temperature of the contact surface 1600 reaches a minimum temperature in FIG. 53. In this case, the second time point t2 in FIG. 56 may be a time point before the temperature of the contact surface 1600 reaches the minimum temperature by the first voltage V1. Accordingly, the temperature of the contact surface 1600 may not reach the minimum temperature, and as a result, the user may not receive intended cold heat.

On the other hand, in another embodiment, the first voltage V1 may be at a higher level than the second voltage V2, and the second time point t2 in FIG. 56 may be later than the time point at which the temperature of the contact surface 1600 reaches the minimum temperature in FIG. 53. In this case, the second time point t2 in FIG. 56 may be a time point after the temperature of the contact surface 1600 reaches the minimum temperature by the first voltage V1, and the temperature of the contact surface 1600 may be maintained at the minimum temperature. However, because the first voltage V1 is continuously applied between the first time point t1 and the second time point t2, a larger amount of waste heat may be generated in comparison to when the second voltage V2 is applied. Because of this, the temperature of the contact surface 1600 may rise instead of being maintained at the minimum temperature, and the generated waste heat may also affect the temperature of the contact surface 1600 after the second time point t2. According to circumstances, due to the waste heat, the duration time may be shortened, and the lasting temperature may be increased. According to the amount of waste heat being generated or characteristics of the feedback device 100, the duration time may not be greatly affected by the waste heat. In this case, even when the second time point t2 in FIG. 56 is later than the time point at which the temperature of the contact surface 1600 reaches the minimum temperature in FIG. 53, the temperature of the contact surface 1600 may be maintained at the minimum temperature, and the influence on the duration time and the lasting temperature may be small.

Consequently, the feedback device 100 may determine a time point at which a voltage is to be applied so that the temperature of the contact surface 1600 reaches the minimum temperature and the duration time and the lasting temperature are improved and, through Step 5410 and Step 5420, may apply a voltage at the determined time point to improve the cold heat transfer performance.

Figure 57:
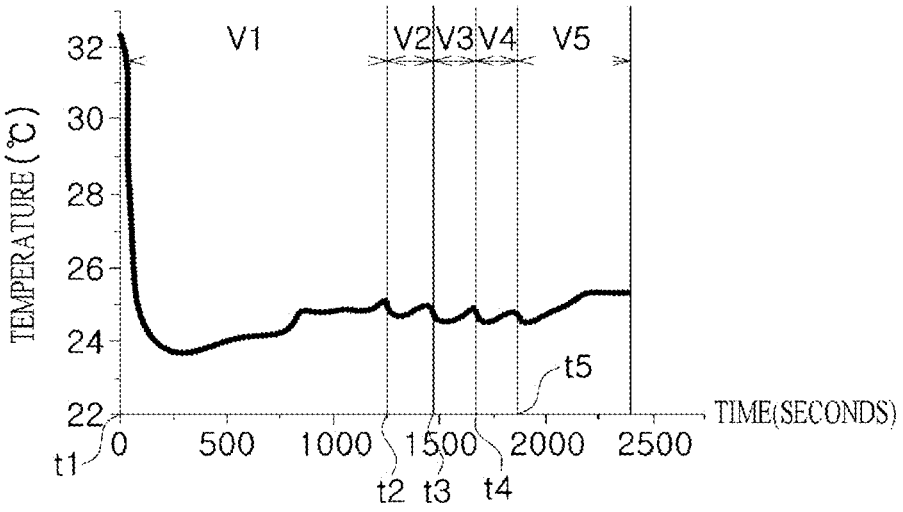
FIG. 57 is a view for describing cold heat transfer performance of the feedback device in response to applying a plurality of voltages according to an embodiment of the present disclosure.

FIG. 57 is a view for describing cold heat transfer performance of the feedback device in response to applying a plurality of voltages according to an embodiment of the present disclosure.

Referring to FIG. 57, Although the cold heat transfer performance of the feedback device 100 has been described on the basis of an embodiment in which voltages at two different levels are applied in the examples of FIGS. 55 and 56, an embodiment in which voltages at three or more different levels are applied as illustrated in FIG. 57 may also be applied to the present disclosure.

In FIG. 57, the x-axis of the graph indicates time, the y-axis thereof indicates temperature, and a line 5701 indicates temperature of the contact surface 1600 when a first voltage V1 to a fifth voltage V5 are applied.

In an embodiment of the present disclosure, when the feedback device 100 provides cold feedback, the feedback device 100 may determine levels of a plurality voltages to be applied to the thermoelectric module 1000 and time points at which the plurality of voltages are to be applied so that the user's cold sensation perception performance is improved.

In the example of FIG. 57, the first voltage V1 to the fifth voltage V5 may have sequentially higher voltage values in that order. That is, the first voltage V1 may be set to have the lowest voltage value, and the fifth voltage V5 may be set to have the highest voltage value. The first voltage V1 to the fifth voltage V5 may be set to be applied at a first time point t1 to a fifth time point to, respectively. In an embodiment, between the first time point t1 and a second time point t2, the temperature of the contact surface 1600 may reach a minimum temperature and then gradually rise due to waste heat. When the second voltage V2 is applied between the second time point t2 and a third time point to, the temperature of the contact surface 1600 may temporarily drop and then rise. Also, between the third time point to and a fourth time point to and between the fourth time point to and the fifth time point to, when a third voltage VA or a fourth voltage VA is applied, the temperature of the contact surface 1600 may temporarily drop and then rise. After the fifth time point to, when the fifth voltage V5 is applied, the temperature of the contact surface 1600 may temporarily drop and then rise, but in this case, the temperature of the contact surface 1600 may be maintained at a specific temperature.

In this way, according to circumstances, in the case in which voltages at sequentially higher levels are applied, because a wanted temperature of the contact surface 1600 is decreased when a voltage at a high level is applied, the temperature of the contact surface 1600 may be gradually decreased or maintained. Because the temperature of the contact surface 1600 temporarily drops at the second time point t2 to the fifth time point to, the user may feel strong cold sensation at the corresponding time points.

Accordingly, the feedback device 100 may determine a plurality of voltages and time points at which the plurality of voltages are to be applied corresponding to characteristics of the feedback device 100 and apply the plurality of voltages at the plurality of time points, thereby improving the cold heat transfer performance. Although the embodiment in which voltage values become sequentially higher has been described with reference to FIG. 57, embodiments are not limited thereto, and levels of the plurality of voltages to be applied to the thermoelectric module 1000 may be set to various values.

4.3. Method of Improving User'S Perception by Controlling Thermoelectric Operation As described above, in an embodiment, when the feedback device 100 performs the endothermic operation, after reaching the minimum temperature, the temperature of the contact surface 1600 may slightly rise due to waste heat and reach a lasting temperature, which is a temperature within a predetermined temperature range. The user may receive cold sensation from such a temperature change of the contact surface 1600.

However, even when cold heat is continuously transferred from the feedback device 100, the user may not feel coldness at a certain level. Particularly, in a section in which the feedback device 100 maintains the lasting temperature, the user's cold sensation perception may be degraded, and according to circumstances, the user may not feel coldness. This is due to a characteristic of sensory organs of the human body in that, when stimulation at a specific intensity is continued, the sensory organs of the human body are unable to feel stimulation at the corresponding intensity and may perceive a change in stimulation only when stimulations of a predetermined proportion or more with respect to the stimulation at the specific intensity are applied. This may be described also using the Weber's law.

Hereinafter, a method of improving the user's cold sensation perception by the feedback device 100 despite the characteristic of sensory organs of the human body will be described.

Figure 58:
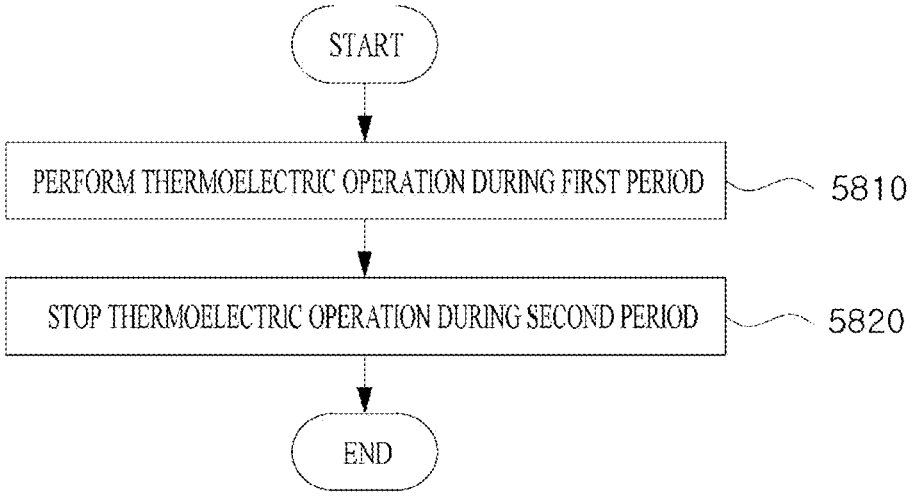
FIG. 58 is an operational flowchart illustrating a method of improving the user's perception performance by controlling a thermoelectric operation according to an embodiment of the present disclosure.

FIG. 58 is an operational flowchart illustrating a method of improving the user's perception performance by controlling a thermoelectric operation according to an embodiment of the present disclosure.

Referring to FIG. 58, the feedback device 100 may improve the user's cold sensation perception by performing a thermoelectric operation and stopping the thermoelectric operation.

Specifically, the feedback device 100 may determine a first period in which a thermoelectric operation is performed and a second period in which the thermoelectric operation is stopped. The feedback device 100 may perform a thermoelectric operation during the first period (5810). The feedback device 100 may stop the thermoelectric operation during the second period (5820). The feedback device may repeatedly perform Step 5810 and Step 5820 while cold sensation is provided to the user, and accordingly, the user's perception performance may be improved. Hereinafter, Step 5810 and Step 5820 will be described in more detail.

Figure 59:
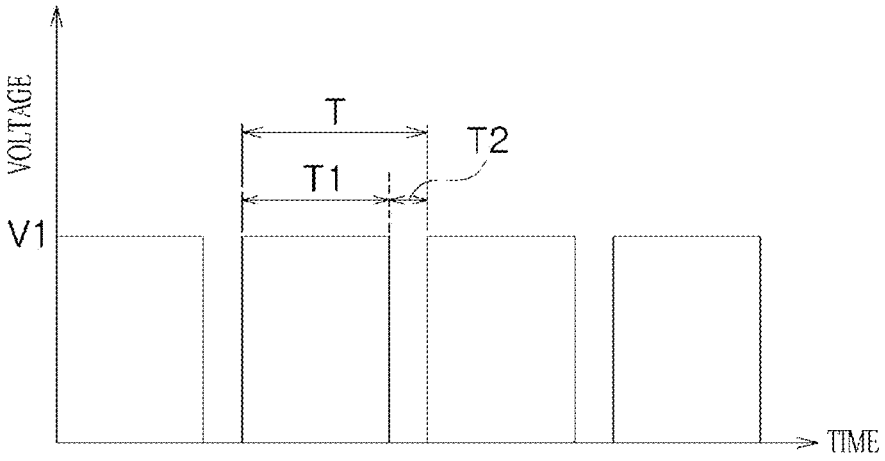
FIG. 59 is a view for describing periods for controlling a thermoelectric operation according to an embodiment of the present disclosure.

FIG. 59 is a view for describing periods for controlling a thermoelectric operation according to an embodiment of the present disclosure.

Referring to FIG. 59, the x-axis of the graph indicates time, and the y-axis thereof indicates voltage. The feedback device 100 may apply and not apply a voltage at a specific level to control a thermoelectric operation. Here, the thermoelectric operation may include an exothermic operation and an endothermic operation. For example, when the feedback device 100 applies a first voltage having a specific voltage value during a first period T1, the thermoelectric module 1000 may output cold feedback according to the first voltage, and when the feedback device 100 stops the application of the first voltage during a second period T2, the thermoelectric module 1000 may not output the cold feedback. The feedback device 100 may repeat the application of the first voltage and the stopping of the application of the first voltage according to the first period T1 and the second period T2 in accordance with an overall period T so that the extent to which the user perceives cold sensation is improved. Although controlling a thermoelectric operation when the same voltage is applied has been described with reference to FIG. 59, embodiments are not limited thereto, and a case in which a plurality of voltages having different voltage values are applied may also be applied to the method of improving the user's perception performance by controlling a thermoelectric operation according to an embodiment of the present disclosure.

Figure 60:
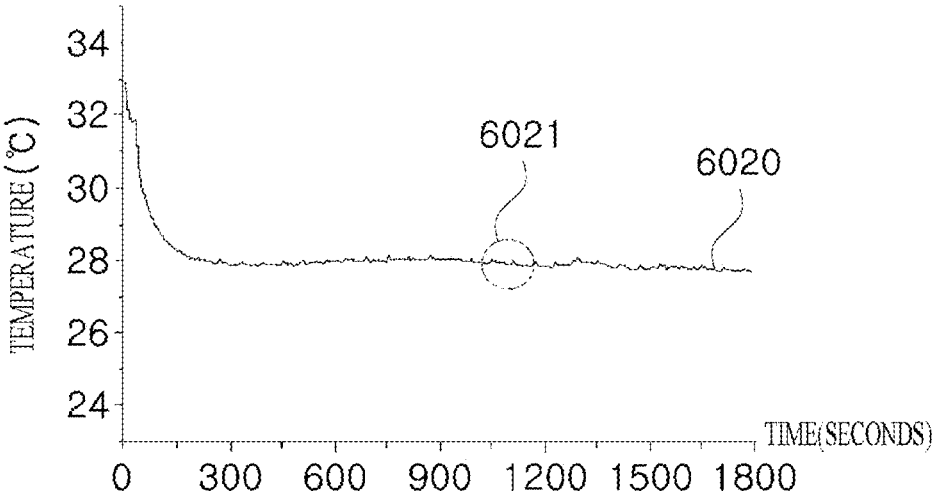
FIG. 60 is a view for describing a method of improving the user's perception performance by controlling a thermoelectric operation according to an embodiment of the present disclosure.

FIG. 60 is a view for describing a method of improving the user's perception performance by controlling a thermoelectric operation according to an embodiment of the present disclosure.

Referring to FIG. 60, the feedback device 100 may apply a first voltage having a specific voltage value to the thermoelectric module 1000. In the example of FIG. 60, the first voltage may be a voltage used in outputting cold feedback.

In the graph of FIG. 60, the x-axis indicates time, the y-axis indicates temperature, and a line 6020 indicates the temperature of the contact surface 1600. In FIG. 60, because the first voltage is applied to the thermoelectric module 1000, after reaching a minimum temperature from an initial temperature, the temperature of the contact surface 1600 may be maintained within a predetermined temperature section. However, when the temperature of the contact surface 1600 is maintained within the specific temperature range for a long period, the extent to which the user perceives cold sensation may be lowered due to the above-described Weber's law. To prevent this, the feedback device 100 may perform a thermoelectric operation during the first period in Step 5810 and stop the thermoelectric operation during the second period in Step 5820. Accordingly, after reaching the specific temperature section, the temperature of the contact surface 1600 may periodically rise and drop by a predetermined range or more. For example, after the temperature of the contact surface 1600 reaches the specific temperature range, the temperature of the contact surface 1600 may rise by a predetermined range during the second period and then drop by the predetermined range from the risen temperature during the first period. Here, the predetermined range may refer to a temperature range wider than the predetermined temperature section. Because of this, the user may receive cold heat in response to periodic temperature drop, and due to the cold heat, the user may perceive cold sensation better.

A line 6021 indicates a temperature change of the contact surface 1600 when Step 5810 and Step 5820 are repeatedly performed in the feedback device 100 while the temperature of the contact surface 1600 lasts within the specific temperature section. This will be described in detail with reference to FIGS. 61 and 62.

Figure 61:
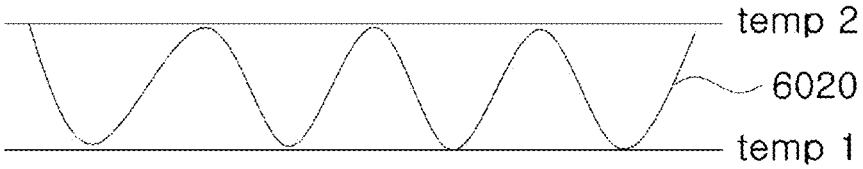
FIG. 61 is a view for describing a temperature change of a contact surface due to controlling a thermoelectric operation according to an embodiment of the present disclosure.

FIG. 61 is a view for describing a temperature change of a contact surface due to controlling a thermoelectric operation according to an embodiment of the present disclosure.

Referring to FIG. 61, the graph of FIG. 61 shows a temperature change of the contact surface 1600 when the feedback device 100 repeatedly performs Step 5810 and Step 5820. As shown in the graph of FIG. 61, the temperature of the contact surface 1600 may repeatedly rise and drop within a section between a first temperature tempo and a second temperature temp 2. Due to such temperature rise and temperature drop, the user's cold sensation perception performance may be improved.

In an embodiment of the present disclosure, the user's cold sensation perception performance may be improved when a temperature difference between the first temperature temp 1 and the second temperature temp 2 is a threshold temperature difference or larger. This is because, when the temperature difference between the first temperature temp 1 and the second temperature temp 2 is lower than the threshold temperature difference, stimulation at a certain level or higher is not applied to the user, and according to the Weber's law, it is difficult for the user to perceive a change in cold heat.

In some embodiments of the present disclosure, the feedback device 100 may preset the threshold temperature difference. According to the Weber's law, the user may perceive a change in cold sensation only when a temperature of cold heat newly transferred to the user differs from a temperature of cold heat previously transferred to the user by a predetermined proportion or more. Accordingly, the threshold temperature difference may vary according to cold heat previously transferred to the user. Consequently, when the temperature of the contact surface 1600 is maintained within a specific range, the feedback device 100 may check temperatures within the specific range and use the temperatures within the specific range to set the threshold temperature difference.

In some embodiments of the present disclosure, the feedback device 100 may control the threshold temperature difference to occur at the contact surface 1600. Specifically, the temperature variation of the contact surface 1600 in Step 5810 and Step 5820 may vary according to at least one of a level of voltage applied to the thermoelectric module 1000 in Step 5810 and Step 58020, the first period in which a thermoelectric operation is performed, and a second period in which the thermoelectric operation is stopped. For example, when the second period is short, the amount of time in which the temperature of the contact surface 1600 rises is reduced, and accordingly, the temperature variation may be decreased. When the first period is short, the amount of time in which the temperature of the contact surface 1600 drops is reduced, and accordingly, the temperature variation may be decreased. In Step 5810 and 5820, when a level of a voltage applied to the thermoelectric module 1000 is high, the temperature variation of the contact surface 1600 may be increased. The feedback device 100 may set the threshold temperature difference and adjust at least one of a level of the voltage applied to the thermoelectric module 1000 in Step 5810 and 5820, the first period during which a thermoelectric operation is performed, and the second period during which the thermoelectric operation is stopped so that the temperature variation of the contact surface 1600 is the threshold temperature difference or higher.

Figure 62:
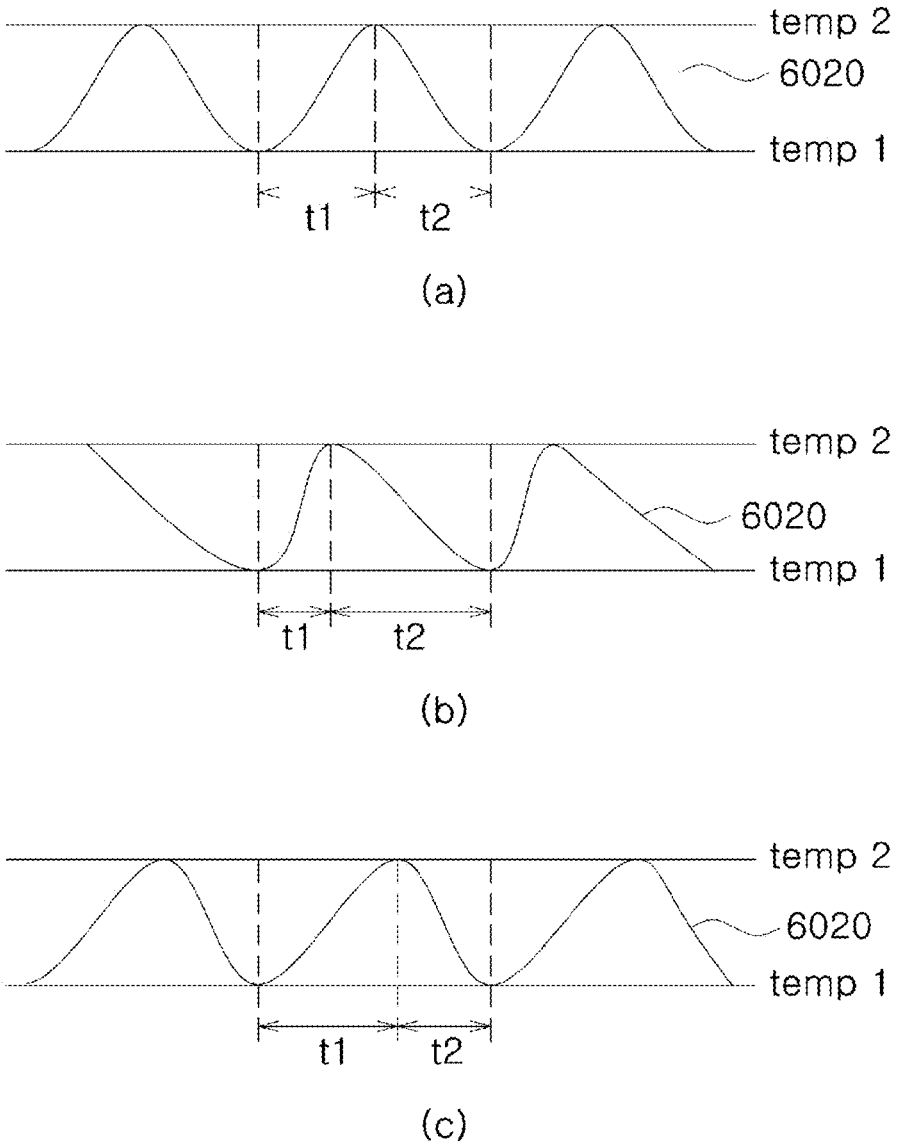
FIG. 62 is a view for describing a temperature change of the contact surface due to controlling a thermoelectric operation according to another embodiment of the present disclosure.

FIG. 62 is a view for describing a temperature change of the contact surface due to controlling a thermoelectric operation according to another embodiment of the present disclosure.

Referring to FIG. 62, a temperature change of the contact surface 1600 when the feedback device 100 repeatedly performs Step 5810 and Step 5820 is shown. As shown in the graph of FIG. 62, the temperature of the contact surface 1600 may periodically repeat rising and dropping within the section between the first temperature temp 1 and the second temperature temp 2. Here, within the section between the first temperature temp 1 and the second temperature temp 2, a time proportion between a first time period t1 that indicates a time at which the temperature of the contact surface 1600 rises and a second time period t2 at which the temperature of the contact surface 1600 drops may vary. In the example of (a), the first time period t1 and the second time period t2 may be equal to each other. However, in the example of (b), the first time period t1 may be shorter than the second time period t2, and in the example of (c), the first time period t1 may be longer than the second time period t2.

In an embodiment of the present disclosure, the feedback device 100 may adjust the time proportion between the first time period t1 and the second time period t2. Specifically, when the feedback device 100 outputs cold feedback, the first time period t1 is a time during which a thermoelectric operation is stopped, and the second time is a time during which the thermoelectric operation is performed. When the feedback device 100 outputs hot feedback, the first time period t1 is a time during which a thermoelectric operation is performed, and the second time period t2 is a time during which the thermoelectric operation is stopped. The feedback device 100 may adjust the time during which a thermoelectric operation is performed and the time during which the thermoelectric operation is stopped and adjust the time proportion between the first time period t1 and the second time period t2 so that a user's degree of perception is improved.

For example, in some embodiments of the present disclosure, when the feedback device 100 outputs cold feedback, it may be beneficial for the user's cold sensation perception that a section in which the temperature of the contact surface 1600 drops is shorter than a section in which the temperature of the contact surface 1600 rises. In this case, as shown in (c), the feedback device 100 may control the thermoelectric module 1000 so that the second time period t2 is shorter than the first time period t1.

When the feedback device 100 outputs hot feedback, it may be beneficial for the user's perception that a section in which the temperature of the contact surface 1600 rises is shorter than a section in which the temperature of the contact surface 1600 drops. In this case, as shown in (b), the feedback device 100 may control the thermoelectric module 1000 so that the first time period t1 is shorter than the second time period t2.

Figure 63:
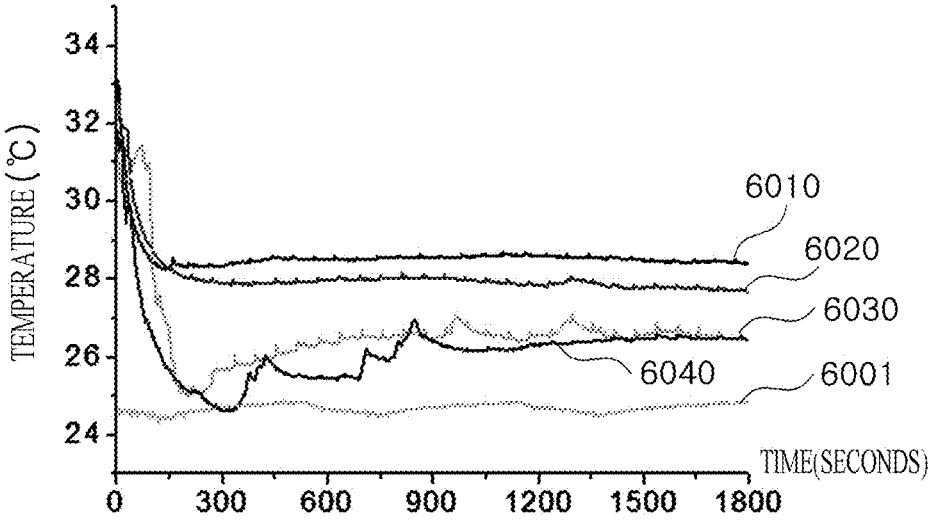
FIG. 63 is a first view describing a temperature change of the contact surface due to controlling a thermoelectric operation according to another embodiment of the present disclosure.
Figure 64:
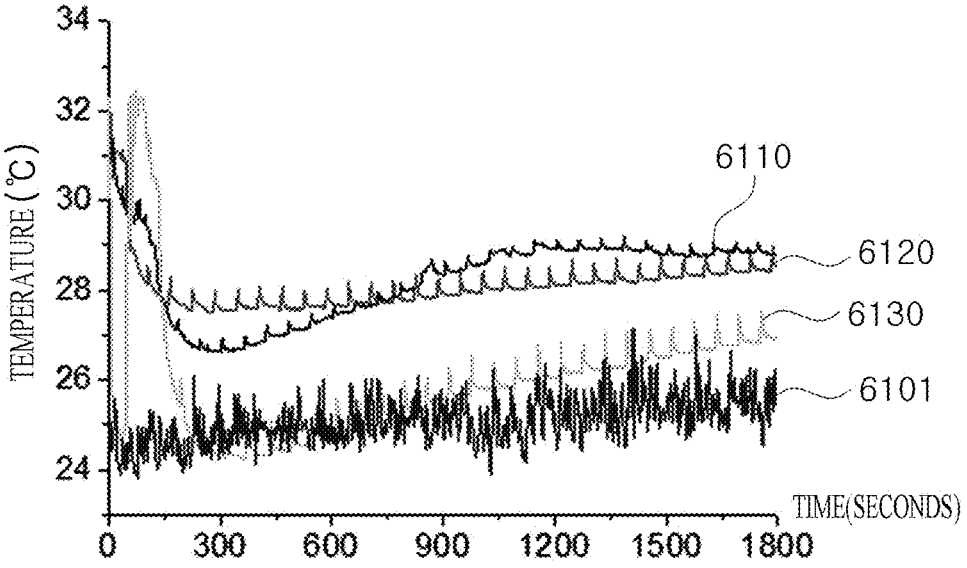
FIG. 64 is a second view for describing a temperature change of the contact surface due to controlling a thermoelectric operation according to still another embodiment of the present disclosure.
Figure 65:
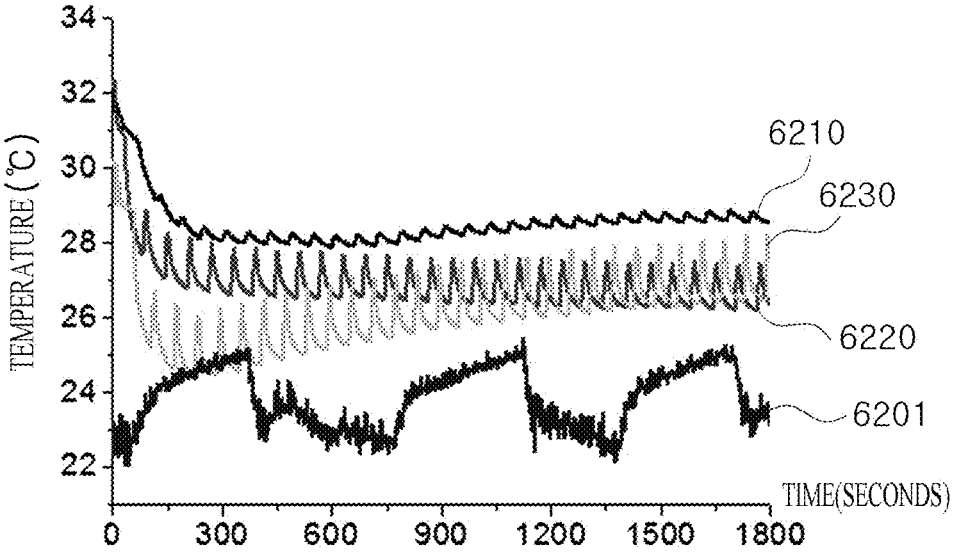
FIG. 65 is a third view for describing a temperature change of the contact surface due to controlling a thermoelectric operation according to still another embodiment of the present disclosure.

FIGS. 63 to 65 are views for describing a temperature change of the contact surface due to controlling a thermoelectric operation according to still another embodiment of the present disclosure.

Referring to FIG. 63, the graphs of FIGS. 63 to 65 show a temperature change of the contact surface 1600 when the feedback device 100 repeatedly performs Step 5810 and Step 5820. However, in the graphs of FIGS. 63 to 65, the first period during which a thermoelectric operation is performed and the second period in which the thermoelectric operation is stopped may be different. Specifically, in the graph of FIG. 63, the first period, the second period, and the overall period may be set as 59.5 seconds, 0.5 seconds, and 60 seconds, respectively; in the graph of FIG. 64, the first period, the second period, and the overall period may be set as 58 seconds, 2 seconds, and 60 seconds, respectively; and in the graph of FIG. 65, the first period, the second period, and the overall period may be set as 50 seconds, 10 seconds, and 60 seconds, respectively. The graphs of FIGS. 63 to 65 may show the temperature change of the contact surface 1600 when voltages at various levels are applied to the thermoelectric module 1000. Specifically, in the graphs of FIGS. 63 to 65, the x-axis indicates time, the y-axis indicates temperature, lines 6001, 6101, and 6201 indicate surrounding temperature, lines 6010, 6110, and 6210 indicate temperature of the contact surface 1600 when a first voltage is applied, lines 6020, 6120, and 6220 indicate temperature of the contact surface 1600 when a second voltage is applied, lines 6030, 6130, and 6230 indicate temperature of the contact surface 1600 when a third voltage is applied, and lines 6040, 6140, and 6240 indicate temperature of the contact surface 1600 when a fourth voltage is applied. Here, the level of the voltage may be higher in the order of the first voltage, the second voltage, the third voltage, and the fourth voltage.

In an embodiment of the present disclosure, as shown in the graphs of FIGS. 63 to 65, because the feedback device 100 repeatedly performs Step 5810 and Step 5820, even in a section in which the temperature of the contact surface 1600 is maintained to be a specific temperature, a temperature rise and a temperature drop may be repeated within a predetermined temperature range. Due to the repeated temperature rise and temperature drop, the user's cold sensation perception performance may be improved.

In another embodiment of the present disclosure, as shown in the graphs of FIGS. 63 to 65, as the proportion of the second period is higher in the overall period, a difference between the temperature of the contact surface 1600 in the first period and the temperature of the contact surface 1600 in the second period may be increased. For example, when the lines 6020, 6120, and 6220, which indicate the temperature of the contact surface 1600 when the second voltage is applied, are compared, even when the voltage at the same level is applied, the difference between the temperature of the contact surface 1600 in the first period and the temperature of the contact surface 1600 in the second period may be increased as the second period in which the thermoelectric operation is not performed is longer.

In an embodiment of the present disclosure, the feedback device 100 may properly adjust the first period and the second period to improve the user's degree of perception. For example, in a case in which the threshold temperature difference indicating a temperature difference through which the user may perceive a change in cold sensation described above with reference to FIG. 61 is lower than a first threshold value, and a difference between the temperature of the contact surface 1600 in the first period and the temperature of the contact surface 1600 in the second period in FIG. 63 is higher than the first threshold value, when the feedback device 100 performs Step 5810 and Step 5820 according to the first period and the second period in FIG. 63, the user may perceive a change in cold sensation.

In another example, in a case in which the threshold temperature difference is higher than the first threshold value but lower than a second threshold value, which is higher than the first threshold value, and a difference between the temperature of the contact surface 1600 in the first period and the temperature of the contact surface 1600 in the second period is higher than the second threshold value in FIG. 64, the feedback device 100 may perform Step 5810 and Step 5820 according to the first period and the second period in FIG. 64 and improve the user's perception performance. However, in this case, because the difference between the temperature of the contact surface 1600 in the first period and the temperature of the contact surface 1600 in the second period in FIG. 65 may also be higher than the second threshold value, the user's perception performance may be improved even when the feedback device 100 performs Step 5810 and Step 5820 according to the first period and the second period in FIG. 65. However, the second period in FIG. 65 may be longer than the second period in FIG. 64, and because of this, the amount of temperature rise in FIG. 65 may be higher than the amount of temperature rise in FIG. 64. However, according to circumstances, hot sensation may be provided to the user when the amount of temperature rise is high. Consequently, to improve the extent to which the user perceives cold sensation while not providing hot sensation to the user, when the threshold temperature difference is lower than the second threshold value, the feedback device 100 may perform Step 5810 and Step 5820 according to the first period and the second period in FIG. 64.

The method according to an embodiment may be implemented in the form of a program command that is executable by various computer means and be recorded in a computer readable recording medium. The computer readable recording medium may include a program command, a data file, a data structure, and the like solely or in combination. The program command recorded in the medium may be particularly designed for the embodiment or may be known by one of ordinary skill in the computer software art and usable. Examples of the computer readable recording medium include hardware devices particularly configured to store and execute program commands such as magnetic media such as a hard disk, a floppy disk, and a magnetic tape, optical media such as a compact disk read-only memory (CD-ROM) and a digital versatile disk (DVD), magneto-optical media such as a FL optical disk, and semiconductor storage devices such as a ROM, a random access memory (RAM), and a flash memory. Examples of the program command include high-level language codes that are computer-executable by using an interpreter and the like as well as machine language codes such as those formed by a compiler. The above-mentioned hardware device may be configured to serve as one or more software modules to execute operations of the embodiment, and vice versa.

According to the present disclosure, thermal feedback can be provided to a user.

Further, according to the present disclosure, waste heat generated in a feedback device can be effectively dissipated.

Further, according to the present disclosure, cold sensation can be more effectively provided to a user.

Further, according to the present disclosure, a user's degree of thermal feedback perception can be improved.

Advantageous effects of the present disclosure are not limited to the above-mentioned effects, and other unmentioned effects should be clearly understood by one of ordinary skill in the art to which the present disclosure pertains from the present specification and the accompanying drawings.

Although embodiments of the present disclosure have been described above using limited embodiments and drawings, one of ordinary skill in the art should be capable of modifying and changing the above-described embodiments in various ways. For example, the above-described techniques may be performed in a different order from the above-described method, and/or the above-described elements such as a system, a structure, a device, and a circuit may be coupled or combined in a different form from the above-described method, or suitable results may be achieved even when the elements are replaced or substituted with other elements or their equivalents.

Therefore, other implementations, embodiments, and equivalents of the appended claims also belong to the scope of the claims below.

What is claimed is:

1. A feedback device comprising:

a thermoelectric module including a flexible substrate, a thermoelement disposed on the substrate configured to perform a thermoelectric operation for thermal feedback, and a contact surface disposed on the substrate configured to transfer heat generated by the thermoelectric operation to a user, wherein the heat is transferred through the substrate and the contact surface to an output for the thermal feedback; and a feedback controller configured to control the thermoelectric module, wherein:

the thermoelectric operation includes an exothermic operation and an endothermic operation, the feedback controller controls the thermoelectric module so a temperature of the contact surface is maintained within a predetermined temperature range during a thermoelectric operation time interval after the temperature of the contact surface reaches a target temperature; and the feedback controller controls the thermoelectric module so a temperature rise or a temperature drop that exceeds a predetermined threshold value, periodically occurs in the contact surface after the temperature of the contact surface reaches the predetermined temperature range.

2. A feedback device for providing a thermal feedback including at least one of a hot feedback and a cold feedback, the feedback device comprising:

a thermoelectric module comprising a flexible substrate, a thermoelement disposed on the substrate configured to perform a thermoelectric operation for the thermal feedback, and a contact surface disposed on the substrate configured to transfer heat generated by the thermoelectric operation to a user; and a feedback controller configured to control the thermoelectric module, wherein the thermoelectric operation including at least one of an exothermic operation and an endothermic operation, wherein the heat being transferred through the substrate and the contact surface to an output for the thermal feedback, wherein the feedback controller controls the thermoelectric module so a temperature rise and a temperature drop occur in the contact surface periodically after a temperature of the contact surface reaches a target temperature related to the thermal feedback, and wherein the temperature of the contact surface is maintained within a predetermined temperature range while the temperature rise and the temperature drop occur.

3. The feedback device of claim 2, wherein:

the feedback controller applies a first electric signal having a constant voltage or a constant current to the thermoelectric module to cause that the temperature of the contact surface reaches the target temperature related to the thermal feedback for providing a cold sensation to the user, and the feedback controller applies a second electric signal having a duty cycle to the thermoelectric module to cause that the temperature of the contact surface repeats the temperature rise and the temperature drop for enhancing the cold sensation of the user.

4. The feedback device of claim 3, wherein the first electric signal and the second electric signal cause the thermoelectric module to perform the endothermic operation.

5. The feedback device of claim 4, wherein:

waste heat is accumulated inside the feedback device while the thermoelectric module performs the endothermic operation by an on-period of the duty cycle; and the temperature of the contact surface rises due to the waste heat in an off-period of the duty cycle.

6. The feedback device of claim 5, wherein:

the feedback device further comprises a heat radiator configured to dissipate at least a portion of the waste heat to the outside of the feedback device; and while the portion of the waste heat is dissipated to the outside of the feedback device by the heat radiator, the temperature of the contact surface is maintained within the predetermined temperature range.

7. The feedback device of claim 5, wherein:

the feedback controller controls the thermoelectric module so a temperature variation of the contact surface between the on-period of the duty cycle and the off-period of the duty cycle is larger than or equal to a threshold temperature difference, and the threshold temperature difference indicating a temperature difference that allows the user to perceive a temperature change.

8. The feedback device of claim 7, wherein the temperature variation of the contact surface is adjusted according to a proportion between the on-period of the duty cycle and the off-period of the duty cycle.

9. The feedback device of claim 7, wherein a proportion of the off-period .of the duty cycle to the on-period of the duty cycle is higher than or equal to 0.9.

10. The feedback device of claim 2, wherein the target temperature is lower than an initial temperature.

11. The feedback device of claim 10, wherein the predetermined temperature range is higher than the target temperature and lower than the initial temperature.

12. The feedback device of claim 2, wherein the feedback controller applies a third electric signal having a constant voltage, a constant current or a duty cycle to the thermoelectric module to cause that the temperature of the contact surface reaches the target temperature related to the thermal feedback for providing a cold sensation to the user and repeats the temperature rise and the temperature drop for enhancing the cold sensation of the user.

13. The feedback device of claim 2, wherein:

the feedback controller applies a fourth electric signal having a constant voltage or a constant current to the thermoelectric module to cause that the temperature of the contact surface reaches the target temperature related to the thermal feedback for providing a hot sensation to the user, and the feedback controller applies a fifth electric signal having a duty cycle to the thermoelectric module to cause that the temperature of the contact surface repeats the temperature rise and the temperature drop for enhancing the hot sensation of the user.

14. The feedback device of claim 13, wherein the fourth electric signal and the fifth electric signal cause the thermoelectric module to perform the exothermic operation.

15. The feedback device of claim 13, wherein the target temperature is higher than an initial temperature.

16. The feedback device of claim 15, wherein the predetermined temperature range is lower than the target temperature and higher than the initial temperature.

17. The feedback device of claim 2, wherein the feedback controller applies a sixth electric signal having a constant voltage, a constant current or a duty cycle to the thermoelectric module to cause that the temperature of the contact surface reaches the target temperature related to the thermal feedback for providing a hot sensation to the user and repeats the temperature rise and the temperature drop for enhancing the hot sensation of the user.

18. A method for providing a thermal feedback including at least one of a hot feedback and a cold feedback, the feedback device comprising:

a thermoelectric module comprising a flexible substrate, a thermoelement disposed on the substrate configured to perform a thermoelectric operation for the thermal feedback, and a contact surface disposed on the substrate configured to transfer heat generated by the thermoelectric operation to a user; and a feedback controller configured to control the thermoelectric module, wherein:

the thermoelectric operation includes at least one of an exothermic operation and an endothermic operation, and the heat is transferred through the substrate and the contact surface to an output for the thermal feedback, the method comprising:

controlling the thermoelectric module such that a temperature of the contact surface reaches a target temperature related to the thermal feedback, and controlling the thermoelectric module so a temperature rise and a temperature drop occur in the contact surface periodically after the temperature of the contact surface reaches the target temperature related to the thermal feedback, wherein the temperature of the contact surface is maintained within a predetermined temperature range while the temperature rise and the temperature drop occur.

19. A non-transitory computer readable medium storing a program to execute the method of claim 18.

* * * * *